US011324325B2

(12) United States Patent
Ludwig et al.

(10) Patent No.: US 11,324,325 B2
(45) Date of Patent: May 10, 2022

(54) SEATING ARRANGEMENT

(71) Applicant: Steelcase Inc., Grand Rapids, MI (US)

(72) Inventors: James Nolan Ludwig, Grand Rapids, MI (US); Nickolaus William Charles Deevers, Holland, MI (US); Kurt Heidmann, Grand Rapids, MI (US); Bruce Michael Smith, East Grand Rapids, MI (US); Mark William Spoelhof, Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 15/863,374

(22) Filed: Jan. 5, 2018

(65) Prior Publication Data

US 2018/0125246 A1 May 10, 2018

Related U.S. Application Data

(63) Continuation of application No. 15/096,809, filed on Apr. 12, 2016, now Pat. No. 10,021,984.

(60) Provisional application No. 62/232,784, filed on Sep. 25, 2015, provisional application No. 62/153,266, filed on Apr. 27, 2015, provisional application No. 62/146,666, filed on Apr. 13, 2015, provisional application No. 62/146,672, filed on Apr. 13, 2015, provisional application No. 62/146,678, filed on Apr. 13, 2015.

(51) Int. Cl.
*A47C 7/54* (2006.01)
*A47C 7/44* (2006.01)

(52) U.S. Cl.
CPC ..... *A47C 7/54* (2013.01); *A47C 7/445* (2013.01)

(58) Field of Classification Search
None
See application file for complete search history.

(56) References Cited

U.S. PATENT DOCUMENTS

| | | | |
|---|---|---|---|
| 120,382 | A | 10/1871 | Heywood |
| 362,796 | A | 5/1887 | Tait |
| 386,142 | A | 7/1888 | Lewis |
| 501,317 | A | 7/1893 | Boland |
| 786,326 | A | 4/1905 | Travers |
| 847,880 | A | 3/1907 | Barker et al. |

(Continued)

FOREIGN PATENT DOCUMENTS

| | | |
|---|---|---|
| AT | 505212 A1 | 11/2008 |
| BE | 519252 | 4/1953 |

(Continued)

*Primary Examiner* — David E Allred
(74) *Attorney, Agent, or Firm* — Price Heneveld LLP

(57) ABSTRACT

A seating arrangement includes a base, a lower shell including a first portion coupled to the base and comprising a substantially horizontal portion, a curved transition portion and a backrest portion, a pair of laterally spaced front links extending upwardly from a forward portion of the first portion, a rear link extending upwardly from a rearward portion of the first portion of the lower shell and forwardly of the transition region of the lower shell, and an upper shell comprising a seating portion coupled to the pair of front links and to the rear link, a curved transition portion spaced apart from the curved transition portion of the lower shell and defining an open lateral pass through therebetween, and a backrest portion connected to the backrest portion of the lower shell.

35 Claims, 41 Drawing Sheets

(56) References Cited

U.S. PATENT DOCUMENTS 1,541,644 A 6/1925 Herbermann
1,732,647 A 10/1929 Flintermann
1,789,337 A 1/1931 Knabusch et al.
1,825,581 A 9/1931 Comerford
1,886,308 A 11/1932 Schultes
1,962,464 A 6/1934 Richtsteig
2,028,633 A 1/1936 Thomas
2,055,990 A 9/1936 Stickney
2,264,485 A 12/1941 Smith
2,271,925 A 2/1942 Niles
2,321,385 A 6/1943 Herold
2,343,739 A 3/1944 Bernstein
2,440,324 A 4/1948 Blakeslee
2,530,924 A 11/1950 Turner
2,540,823 A 2/1951 Heller
2,562,260 A 7/1951 Caldwell
2,579,502 A 12/1951 Lorenz
2,615,496 A 10/1952 Lorenz et al.
2,616,484 A 11/1952 Christie
2,731,078 A 1/1956 Cadman et al.
2,746,520 A 5/1956 Ducrot
2,764,228 A 9/1956 Donohue
2,818,911 A 1/1958 Syak
2,830,650 A 4/1958 Lorenz
D183,440 S 8/1958 Williams
2,855,984 A 10/1958 Majorana et al.
2,921,622 A 1/1960 Henrikson et al.
2,979,116 A 4/1961 Schliephacke
2,993,733 A 7/1961 Pinkham
D192,165 S 2/1962 Brandon
3,027,191 A 3/1962 Lie
3,052,459 A 9/1962 Belsky
3,053,571 A 9/1962 Fox
3,081,077 A 3/1963 Sudman
3,120,407 A 2/1964 Propst
3,121,590 A 2/1964 Schliephacke
3,133,765 A 5/1964 Kramer
3,135,551 A 6/1964 Andreoli et al.
3,165,307 A 1/1965 Edwards
D200,640 S 3/1965 Yamasaki
3,171,623 A 3/1965 Lawson et al.
3,201,172 A 8/1965 Bliss
3,230,862 A 1/1966 Sherwood et al.
3,231,225 A 1/1966 Bakke
3,241,884 A 3/1966 Thatcher et al.
3,284,131 A 11/1966 Fletcher
3,300,251 A 1/1967 Helms
3,309,136 A 3/1967 Kehoe
3,316,018 A 4/1967 Stith
3,316,624 A 5/1967 Brudevold
D207,955 S 6/1967 Rodrigo
3,337,267 A 8/1967 Rogers, Jr.
3,353,869 A 11/1967 Getz et al.
3,369,840 A 2/1968 Dutton
3,370,885 A 2/1968 Gale
3,377,756 A 4/1968 Polhamus
3,557,264 A 1/1971 Getz et al.
3,560,048 A 2/1971 Flint
3,565,482 A 2/1971 Blodee
3,570,108 A 3/1971 Sarra
3,583,759 A 6/1971 Kramer
3,586,370 A 6/1971 Barecki et al.
3,602,537 A 8/1971 Kerstholt et al.
3,669,496 A 6/1972 Chisholm
3,669,499 A 6/1972 Semplonius et al.
3,689,013 A 9/1972 Neugebauer
3,693,925 A 9/1972 Weinstein
3,701,171 A 10/1972 Fritzsche
3,711,156 A 1/1973 Bloomfield
3,712,666 A 1/1973 Stoll
3,740,096 A 6/1973 Bridger
3,741,607 A 6/1973 Cramer
D227,829 S 7/1973 Klose
3,756,656 A 9/1973 Weick
3,758,159 A 9/1973 Morris
D228,717 S 10/1973 Kramer
3,780,353 A 12/1973 Gordon et al.
3,806,192 A 4/1974 Ohlrogge et al.
3,815,954 A 6/1974 Rogers et al.
3,815,956 A 6/1974 Bocksch et al.
3,823,980 A 6/1974 Harnick
3,827,750 A 8/1974 Fantoni
3,829,599 A 8/1974 Fujioka
3,841,704 A 10/1974 Plainer et al.
3,851,917 A 12/1974 Horstmann et al.
3,856,981 A 12/1974 Boundy
3,862,454 A 1/1975 Mazzucconi
3,874,727 A 4/1975 Mehbert et al.
3,877,750 A 4/1975 Scholpp
3,883,173 A 5/1975 Shephard et al.
3,883,176 A 5/1975 Morton
3,913,975 A 10/1975 Carter
3,964,789 A 6/1976 Platner et al.
4,013,258 A 3/1977 Doerner
4,032,190 A 6/1977 Muller-Deisig et al.
4,036,527 A 7/1977 Faul
4,054,317 A 10/1977 Stumpf
4,088,367 A 5/1978 Atkinson et al.
4,123,105 A 10/1978 Frey et al.
4,143,910 A 3/1979 Geffers et al.
4,159,148 A * 6/1979 Schulz ..... B60N 2/753 297/411.32
4,200,332 A 4/1980 Brauning
D255,183 S 6/1980 Locher
D255,184 S 6/1980 Locher
4,205,880 A 6/1980 Trotman et al.
4,226,473 A 10/1980 Johnson
4,308,418 A 12/1981 Van Kuik et al.
4,331,360 A 5/1982 Roudybush et al.
4,368,917 A 1/1983 Urai
4,371,142 A 2/1983 Bottemiller et al.
4,379,589 A 4/1983 Marino
4,380,352 A 4/1983 Diffrient
4,384,741 A 5/1983 Flum et al.
4,390,204 A 6/1983 Fleishman
4,410,155 A 10/1983 Wetterhorn et al.
4,411,468 A 10/1983 Apissomian
4,411,469 A 10/1983 Drabert et al.
4,418,958 A 12/1983 Watkin
4,429,917 A 2/1984 Diffrient
4,429,934 A 2/1984 VandenHoek et al.
4,432,582 A 2/1984 Wiesmann et al.
4,451,085 A 5/1984 Franck et al.
4,471,994 A 9/1984 Zuend et al.
4,478,454 A 10/1984 Faiks
4,479,679 A 10/1984 Fries et al.
4,498,702 A 2/1985 Raftery
4,502,729 A 3/1985 Locher
4,502,731 A 3/1985 Snider
4,519,651 A 5/1985 Whitwam
4,521,053 A 6/1985 de Boer
4,526,421 A 7/1985 Brennan et al.
4,529,247 A 7/1985 Stumpf et al.
4,533,174 A 8/1985 Fleishman
4,533,177 A 8/1985 Latone
4,556,254 A 12/1985 Roberts
4,560,199 A 12/1985 Sapper
4,575,150 A 3/1986 Smith
4,577,907 A 3/1986 Talmon et al.
4,585,272 A 4/1986 Ballarini
4,586,748 A 5/1986 Dingier et al.
4,607,883 A 8/1986 Tzu-Chun
4,609,225 A 9/1986 Loucks
4,638,963 A 1/1987 Hernandez
4,640,548 A 2/1987 Desanta
4,647,109 A 3/1987 Christophersen et al.
D289,120 S 4/1987 Chadwick et al.
4,660,887 A 4/1987 Fleming et al.
4,671,570 A 6/1987 Hockenberry et al.
4,673,212 A 6/1987 Mayer
4,682,814 A 7/1987 Hansen
4,685,730 A 8/1987 Linguanotto
4,689,624 A 8/1987 Kago et al.
4,695,093 A 9/1987 Suhr et al.

(56) References Cited

U.S. PATENT DOCUMENTS 4,707,026 A 11/1987 Johansson
4,709,962 A 12/1987 Steinmann
4,711,491 A 12/1987 Ginat
4,711,497 A 12/1987 Kazaoka et al.
4,713,918 A 12/1987 Cioffi
4,718,716 A 1/1988 Stumpf et al.
4,732,281 A 3/1988 Hall, II et al.
4,733,910 A 3/1988 Brennan
4,744,603 A 5/1988 Knoblock
4,761,033 A 8/1988 Lanuzzi et al.
4,765,679 A 8/1988 Lanuzzi et al.
4,773,706 A 9/1988 Hinrichs
4,775,185 A 10/1988 Scholin et al.
4,776,633 A 10/1988 Knoblock et al.
4,783,121 A 11/1988 Luyk et al.
4,789,203 A 12/1988 van Zee et al.
4,790,501 A 12/1988 Waters
4,790,595 A 12/1988 Hensel et al.
4,790,598 A 12/1988 Locher
4,816,966 A 3/1989 Frankowski
4,834,453 A 5/1989 Makiol
4,838,612 A 6/1989 Cross
4,848,837 A 7/1989 Völkle
4,854,641 A 8/1989 Reineman et al.
4,856,845 A 8/1989 Massonnet
4,856,846 A 8/1989 Lohmeyer
4,865,284 A 9/1989 Desanta
4,869,552 A 9/1989 Tolleson et al.
4,877,290 A 10/1989 Schetl
4,882,885 A 11/1989 Chatterson et al.
4,883,320 A 11/1989 Izumida et al.
4,889,385 A 12/1989 Chadwick et al.
4,890,886 A 1/1990 Opsvik
4,892,356 A 1/1990 Pittman et al.
4,899,252 A 2/1990 Birzer
4,911,501 A 3/1990 Decker et al.
D307,221 S 4/1990 Mudge
4,913,493 A 4/1990 Heidmann
4,935,640 A 6/1990 Boucherie
4,938,530 A 7/1990 Snyder et al.
4,938,532 A 7/1990 Burgess
4,948,198 A 8/1990 Crossman et al.
4,953,913 A 9/1990 Graebe
4,962,962 A 10/1990 Machate
4,962,964 A 10/1990 Snodgrass
4,966,411 A 10/1990 Katagiri et al.
4,979,778 A 12/1990 Shields
4,981,326 A 1/1991 Heidmann
4,988,145 A 1/1991 Engel
5,015,038 A 5/1991 Mrotz, III
5,018,787 A 5/1991 Estkowski et al.
5,022,709 A 6/1991 Marchino
5,029,940 A 7/1991 Golynsky et al.
5,029,942 A 7/1991 Rink
5,039,163 A 8/1991 Tolleson
5,042,876 A 8/1991 Faiks
5,050,931 A 9/1991 Knoblock
5,052,753 A 10/1991 Buchacz
5,071,189 A 12/1991 Kratz
5,076,646 A 12/1991 Matte
5,080,318 A 1/1992 Takamatsu et al.
5,080,433 A 1/1992 Hayden
5,080,435 A 1/1992 Desanta
5,100,201 A 3/1992 Becker, III et al.
5,102,196 A 4/1992 Kaneda et al.
5,123,702 A 6/1992 Caruso
5,143,422 A * 9/1992 Althofer ..... A47C 7/541 297/411.36
5,154,485 A 10/1992 Fleishman
5,192,114 A 3/1993 Hollington et al.
5,195,801 A 3/1993 Franck et al.
5,201,306 A 4/1993 Kinny
5,203,853 A 4/1993 Caruso
5,214,836 A 6/1993 Beals
5,224,758 A 7/1993 Takamatsu et al.
RE34,354 E 8/1993 Sondergeld
5,249,839 A 10/1993 Faiks et al.
5,251,958 A 10/1993 Roericht et al.
5,265,938 A * 11/1993 Melhuish ..... A47C 1/0305 297/411.36
5,267,777 A 12/1993 Valtri
5,288,138 A 2/1994 Stulik et al.
5,303,978 A 4/1994 Murrey
5,308,144 A 5/1994 Korn
5,308,145 A 5/1994 Koepke et al.
5,314,237 A 5/1994 Koepke et al.
5,314,240 A 5/1994 Ishi et al.
5,318,346 A 6/1994 Roossien et al.
5,320,373 A 6/1994 Robertson et al.
5,320,410 A 6/1994 Faiks et al.
5,333,368 A 8/1994 Kriener et al.
5,333,934 A 8/1994 Knoblock
5,335,969 A 8/1994 Yamaguchi et al.
5,338,099 A 8/1994 Ishi et al.
5,338,133 A 8/1994 Tornero
5,340,197 A 8/1994 Vogtherr
5,348,367 A 9/1994 Mizelle
5,348,372 A 9/1994 Takamatsu et al.
D351,744 S 10/1994 Caruso et al.
5,352,022 A 10/1994 Knoblock
5,354,120 A 10/1994 Völkle
5,366,274 A 11/1994 Roericht et al.
5,380,063 A 1/1995 Dauphin
5,381,994 A 1/1995 Welch
5,388,892 A * 2/1995 Tornero ..... A47C 1/0305 297/411.36
5,397,165 A 3/1995 Grin et al.
5,401,077 A 3/1995 Hosoe
5,406,760 A 4/1995 Edwards
5,407,249 A * 4/1995 Bonutti ..... A47C 16/00 297/411.35
D358,514 S 5/1995 Lovegrove
5,411,316 A 5/1995 Lovegrove et al.
5,419,617 A 5/1995 Schultz
5,425,566 A 6/1995 Buchacz
D360,316 S 7/1995 Hodge et al.
5,462,336 A 10/1995 Desanta
5,462,338 A 10/1995 Baumann
5,462,339 A 10/1995 Schmale et al.
5,486,035 A 1/1996 Koepke et al.
5,487,591 A 1/1996 Knoblock
5,499,413 A 3/1996 Van Hekken
5,518,294 A 5/1996 Ligon, Sr. et al.
5,536,067 A 7/1996 Pinto
5,536,070 A * 7/1996 Lemmen ..... A47C 1/03 297/411.36
5,538,326 A 7/1996 Lorbiecki
5,540,481 A 7/1996 Roosien et al.
5,564,783 A 10/1996 Elzenbeck et al.
5,567,012 A 10/1996 Knoblock
5,577,807 A 11/1996 Hodge et al.
5,577,811 A 11/1996 Ogg
D376,982 S 12/1996 Otto
5,582,459 A 12/1996 Hama et al.
5,584,533 A 12/1996 Schrewe
5,586,811 A 12/1996 Fornero
5,599,069 A 2/1997 Lorbiecki
5,601,336 A 2/1997 Troyas-Bermejo
D378,480 S 3/1997 Doerner
5,611,598 A 3/1997 Knoblock
5,626,389 A 5/1997 Logan, Jr.
5,630,643 A 5/1997 Scholten et al.
5,642,593 A 7/1997 Shieh
5,649,740 A 7/1997 Hodgdon
5,653,499 A 8/1997 Goodall
5,658,045 A 8/1997 Van Koolwijk et al.
5,660,439 A 8/1997 Unwalla
5,660,442 A 8/1997 Tornero
5,662,381 A 9/1997 Roossien et al.
5,664,835 A 9/1997 Desanta
5,664,842 A * 9/1997 Tseng ..... A47C 1/0305 297/411.36
5,681,092 A 10/1997 Hanson et al.
5,681,093 A 10/1997 Pfister

(56) References Cited

U.S. PATENT DOCUMENTS 5,716,099 A 2/1998 McDiarmid
5,725,277 A 3/1998 Knoblock
5,733,005 A 3/1998 Aufrere et al.
5,755,650 A * 5/1998 Urso ..... A47C 9/002 248/118
5,765,914 A 6/1998 Britain et al.
5,769,497 A 6/1998 Tsai
5,775,774 A 7/1998 Okano
5,804,763 A 9/1998 Smeenge
5,806,258 A 9/1998 Miedema et al.
5,806,930 A 9/1998 Knoblock
5,810,438 A 9/1998 Newhouse
5,810,440 A 9/1998 Unwalla
5,826,940 A 10/1998 Hodgdon
5,839,784 A 11/1998 Breen
5,839,786 A * 11/1998 Cvek ..... A47C 1/03 297/411.35
5,842,264 A 12/1998 Roossien et al.
5,857,739 A 1/1999 Smith
5,868,466 A 2/1999 Massara et al.
5,868,468 A 2/1999 Wang
5,871,258 A 2/1999 Battey et al.
5,873,553 A 2/1999 Stahl et al.
5,901,512 A 5/1999 Bullwinkle
5,913,439 A 6/1999 Von Arx
5,934,758 A 8/1999 Ritch et al.
5,944,387 A 8/1999 Stumpf
5,953,871 A 9/1999 MacConnell et al.
5,957,534 A 9/1999 Wilkerson et al.
5,964,503 A 10/1999 Inoue
5,971,481 A 10/1999 Emmenegger et al.
5,979,985 A 11/1999 Bauer et al.
5,984,411 A 11/1999 Galumbeck
5,997,094 A 12/1999 Cvek
6,000,755 A 12/1999 Uhlenbrock
6,015,187 A 1/2000 Roslund, Jr. et al.
6,021,712 A 2/2000 Harrop et al.
6,047,508 A 4/2000 Goodman et al.
6,050,637 A 4/2000 Haland et al.
6,056,361 A 5/2000 Cvek
6,056,366 A 5/2000 Haynes et al.
6,074,004 A 6/2000 Carmichael
6,076,892 A 6/2000 van Hekken et al.
6,094,875 A 8/2000 Laine
6,099,075 A 8/2000 Watkins
6,109,693 A 8/2000 Bauer et al.
6,116,688 A 9/2000 Wilkerson et al.
6,120,096 A 9/2000 Miotto
6,173,536 B1 1/2001 Boyce
D437,497 S 2/2001 Bräuning
6,223,478 B1 5/2001 Wheeler
6,224,160 B1 5/2001 Takeuchi et al.
6,234,573 B1 5/2001 Roder et al.
6,238,000 B1 5/2001 Hallmark et al.
D445,580 S 7/2001 Pennington et al.
6,253,509 B1 7/2001 Hellwig et al.
6,257,665 B1 7/2001 Nagamitsu et al.
6,273,506 B1 8/2001 Niergarth et al.
6,295,775 B2 10/2001 Osterman et al.
6,296,313 B1 10/2001 Wu
6,343,839 B1 2/2002 Simons, Jr. et al.
6,361,110 B2 3/2002 Roslund, Jr. et al.
6,388,190 B1 5/2002 Laukhuf et al.
6,394,548 B1 5/2002 Battey et al.
6,402,244 B1 6/2002 Schönenbert et al.
6,406,096 B1 6/2002 Barile, Sr.
6,409,266 B1 6/2002 Chen
6,409,268 B1 6/2002 Cvek
6,412,869 B1 7/2002 Pearce
6,422,650 B1 7/2002 Chien-Shen
D461,660 S 8/2002 Koepke et al.
D461,661 S 8/2002 Koepke et al.
6,431,649 B1 8/2002 Hensel
6,439,661 B1 8/2002 Brauning
D462,536 S 9/2002 Levy
6,447,063 B1 9/2002 Beggs
6,460,932 B1 * 10/2002 Kopish ..... A47C 1/03 248/118.3
6,471,293 B2 10/2002 Ware et al.
6,481,801 B1 11/2002 Schmale
6,490,829 B1 12/2002 Schreiner et al.
6,511,128 B2 1/2003 Pirei
6,513,222 B2 2/2003 Von Ehr et al.
6,523,896 B1 2/2003 Uhlenbrock
6,533,352 B1 3/2003 Glass et al.
6,536,841 B1 3/2003 Pearce et al.
D474,346 S 5/2003 Saylor et al.
D474,926 S 5/2003 Koepke et al.
6,557,310 B2 5/2003 Marshall et al.
6,565,152 B2 5/2003 Craft et al.
6,568,760 B2 5/2003 Davis et al.
6,572,195 B1 6/2003 Lee
D476,821 S 7/2003 Koepke et al.
6,607,244 B2 8/2003 Stulik et al.
6,609,755 B2 8/2003 Koepke et al.
6,616,231 B2 9/2003 Koepke et al.
6,626,497 B2 9/2003 Nagamitsu et al.
6,634,717 B2 10/2003 Kown
6,644,741 B2 11/2003 Nelson et al.
6,659,560 B1 12/2003 Chi
6,664,467 B1 12/2003 de la Borbolla
6,669,292 B2 12/2003 Koepke et al.
6,679,551 B2 1/2004 Ware et al.
6,688,687 B2 2/2004 Chu
6,688,690 B2 2/2004 Watson et al.
6,688,693 B2 2/2004 Christofferson et al.
6,692,075 B2 2/2004 Sander et al.
6,695,404 B2 2/2004 Brüske
6,695,410 B2 2/2004 Hsia
6,709,057 B2 3/2004 Sander et al.
6,709,058 B1 3/2004 Diffrient
6,710,244 B1 3/2004 Pferschy
6,722,735 B2 4/2004 Lucci et al.
6,729,688 B2 5/2004 Erne
6,729,691 B2 5/2004 Koepke et al.
6,739,663 B2 5/2004 Gevaert
6,752,459 B2 6/2004 Deisig
6,755,467 B1 6/2004 Chu
6,755,473 B2 6/2004 Reed et al.
6,779,846 B2 8/2004 Spendlove et al.
6,783,184 B2 8/2004 DiBattista et al.
6,786,544 B1 9/2004 Muraishi
6,786,548 B2 9/2004 Pearce et al.
6,811,215 B2 11/2004 Horiki et al.
6,811,218 B2 11/2004 Deimen et al.
6,817,667 B2 11/2004 Pennington et al.
6,820,388 B2 11/2004 Newhouse et al.
6,820,934 B2 11/2004 Ware et al.
6,820,935 B1 11/2004 Cioncada
D501,333 S 2/2005 Piretti
6,863,346 B2 3/2005 Zund
6,869,142 B2 3/2005 Heidmann et al.
6,871,909 B2 3/2005 Hobb et al.
6,874,852 B2 4/2005 Footitt
6,877,816 B1 4/2005 Farmont
6,880,886 B2 4/2005 Bodnar et al.
6,890,030 B2 5/2005 Wilkerson et al.
6,896,327 B1 5/2005 Barile, Sr.
6,896,328 B2 5/2005 Goodworth
6,896,329 B2 5/2005 Sander et al.
6,908,159 B2 6/2005 Prince et al.
6,929,327 B2 8/2005 Piretti
6,932,430 B2 8/2005 Bedford et al.
6,932,431 B2 8/2005 Koch et al.
6,935,690 B2 8/2005 Lucci et al.
D509,388 S 9/2005 Koepke et al.
6,945,602 B2 9/2005 Fookes et al.
6,945,605 B2 9/2005 Kinoshita et al.
D510,668 S 10/2005 Eldøy
6,951,085 B2 10/2005 Hodges et al.
6,957,862 B2 10/2005 Chen
6,957,863 B2 10/2005 Heidmann et al.
6,959,965 B2 11/2005 Diffrient
6,986,549 B2 1/2006 Kniese

(56) References Cited

U.S. PATENT DOCUMENTS 7,004,543 B2 2/2006 Caruso et al.
D516,831 S 3/2006 Eldøy
7,021,712 B2 4/2006 Spendlove et al.
7,029,071 B2 4/2006 Watson et al.
7,048,335 B2 5/2006 Norman et al.
7,066,537 B2 6/2006 Coffield et al.
7,066,538 B2 6/2006 Machael et al.
D525,445 S 7/2006 Liu et al.
D525,446 S 7/2006 Farber
7,070,242 B2 7/2006 Mears et al.
7,097,249 B2 8/2006 Igarashi et al.
7,108,322 B2 9/2006 Erker
7,118,177 B2 10/2006 Piretti
7,159,943 B2 1/2007 Costaglia
7,185,910 B2 3/2007 Beauchesne et al.
D542,574 S 5/2007 Johnson
D543,399 S 5/2007 Johnson
7,213,886 B2 5/2007 Schmitz et al.
7,226,130 B2 6/2007 Fubergen et al.
7,234,772 B2 6/2007 Wells
7,234,774 B2 6/2007 Heidmann et al.
7,234,775 B2 6/2007 Serber
7,237,841 B2 7/2007 Norman et al.
7,243,993 B2 7/2007 Igarashi et al.
7,243,997 B1 7/2007 Tornero
7,250,091 B2 7/2007 Gupta et al.
7,262,371 B2 8/2007 Makwinski et al.
7,264,311 B2 9/2007 Heidmann
D551,868 S 10/2007 Chu
D552,368 S 10/2007 Scheper et al.
D553,380 S 10/2007 Natuzzi
7,275,788 B2 10/2007 Dettmann et al.
7,275,793 B2 10/2007 Fujita et al.
7,278,688 B1 10/2007 Hung
7,281,764 B2 10/2007 Thole
7,287,815 B2 10/2007 Leguen et al.
D557,025 S 12/2007 Chen
D559,002 S 1/2008 Williams et al.
7,320,503 B2 1/2008 Eysing
D560,918 S 2/2008 Fuksas
7,334,845 B2 2/2008 Peterson et al.
7,360,835 B2 4/2008 Tubergen et al.
7,364,233 B2 4/2008 Donati
D571,568 S 6/2008 Overthun et al.
7,408,114 B2 8/2008 VanderVelde et al.
7,416,256 B2 8/2008 Fujita et al.
D576,810 S * 9/2008 Christianson ..... A47C 7/40 D6/356
7,419,215 B2 9/2008 Wilkerson et al.
7,419,222 B2 9/2008 Schmitz et al.
7,429,081 B2 9/2008 Roslund et al.
7,434,880 B2 10/2008 Rønnestad
7,441,839 B2 10/2008 Pennington et al.
7,448,168 B2 11/2008 Waalkes et al.
7,513,570 B2 4/2009 Roslund et al.
D596,871 S 7/2009 Farber
7,568,763 B2 8/2009 Bedford et al.
7,589,286 B2 9/2009 VanderVelde et al.
7,600,814 B2 10/2009 Link
7,600,820 B2 10/2009 Bouche et al.
D604,535 S 11/2009 Parker et al.
7,625,045 B2 12/2009 Hatcher et al.
7,648,201 B2 1/2010 Eysing
7,654,616 B2 2/2010 Kinoshita et al.
D610,824 S 3/2010 Piretti
7,681,952 B2 3/2010 Piretti
7,695,067 B2 4/2010 Goetz et al.
D616,213 S 5/2010 Parker et al.
7,708,349 B2 5/2010 Chen
7,716,797 B2 5/2010 Kismarton et al.
7,717,519 B2 5/2010 Kismarton et al.
7,735,923 B2 6/2010 Roslund et al.
7,753,447 B2 7/2010 Sulzer
7,770,973 B2 8/2010 Gehner et al.
7,784,870 B2 8/2010 Machael et al.
7,798,573 B2 9/2010 Pinnington et al.
7,806,481 B2 10/2010 Eberlein
7,837,265 B2 11/2010 Machael et al.
7,857,390 B2 12/2010 Schmitz et al.
7,862,120 B2 1/2011 Ueda
7,862,122 B1 * 1/2011 Shammas ..... B60N 2/787 297/411.23
7,878,598 B2 2/2011 Oda
7,896,439 B2 3/2011 Kan et al.
7,922,248 B2 4/2011 Aldrich et al.
7,926,879 B2 4/2011 Schmitz et al.
7,926,880 B2 4/2011 Heidmann et al.
7,992,936 B2 8/2011 Schmitz et al.
7,997,652 B2 8/2011 Roslund et al.
8,002,351 B2 8/2011 Golynsky
8,025,334 B2 9/2011 Schmitz et al.
8,025,335 B2 9/2011 Gehner
D646,074 S 10/2011 Cantarutti
8,029,060 B2 10/2011 Parker et al.
8,061,775 B2 11/2011 Diffrient
8,087,727 B2 1/2012 Parker et al.
8,096,615 B2 1/2012 Parker et al.
8,104,838 B2 1/2012 Tsai
8,162,397 B2 4/2012 Booth et al.
8,172,332 B2 5/2012 Masunaga et al.
8,100,476 B2 6/2012 Jenkins
8,210,611 B2 7/2012 Aldrich et al.
8,215,710 B2 7/2012 Erker
8,235,468 B2 8/2012 Fookes et al.
8,272,693 B2 9/2012 Hall et al.
D669,279 S 10/2012 Eldøy
8,282,169 B2 10/2012 Schmitz et al.
8,282,172 B2 10/2012 Schmitz et al.
8,313,140 B2 11/2012 Niitsuma et al.
D678,690 S 3/2013 Eldøy
8,388,064 B2 3/2013 Bertolini et al.
8,414,073 B2 4/2013 Schmitz et al.
8,414,075 B2 4/2013 Ko
8,419,133 B2 4/2013 Holt et al.
8,419,135 B2 4/2013 Moeseneder et al.
8,449,037 B2 5/2013 Behar et al.
8,459,746 B2 6/2013 Lai
8,469,454 B2 6/2013 Holt et al.
8,480,171 B2 7/2013 Chadwick et al.
8,550,564 B1 10/2013 Kismarton et al.
8,562,073 B2 10/2013 Niitsuma et al.
8,567,864 B2 10/2013 Deisig et al.
8,602,501 B2 12/2013 Walker et al.
8,613,481 B2 12/2013 Parker et al.
8,616,640 B2 12/2013 van Hekken
8,622,474 B2 1/2014 Jenkins
8,646,839 B2 2/2014 Moreschi
8,668,265 B2 3/2014 Parker et al.
8,668,267 B2 3/2014 Piretti
8,714,645 B2 5/2014 Cvek
8,752,896 B2 6/2014 Takeuchi et al.
8,777,312 B2 7/2014 Diffrient
8,820,835 B2 9/2014 Minino et al.
D714,563 S 10/2014 Amdal et al.
8,888,183 B2 11/2014 Parker et al.
8,960,796 B2 2/2015 Aldrich et al.
8,967,726 B2 3/2015 Schmitz et al.
8,973,995 B2 3/2015 Donati
D727,076 S 4/2015 Usumoto
8,998,337 B2 4/2015 Miyamoto
8,998,338 B2 4/2015 Vander Veen et al.
8,998,339 B2 4/2015 Peterson et al.
9,004,597 B2 4/2015 Battey et al.
9,010,839 B2 4/2015 Schijve et al.
9,033,421 B2 5/2015 Wilkinson et al.
9,039,093 B2 5/2015 Nishiura et al.
9,049,936 B2 6/2015 Leone et al.
9,056,569 B2 * 6/2015 Lindloff ..... B62J 1/28
9,132,760 B2 9/2015 Matsumoto et al.
9,161,627 B2 10/2015 Donati
9,168,855 B2 10/2015 Evans et al.
9,211,826 B2 12/2015 Matsumoto et al.
9,510,684 B2 12/2016 Schmitz et al.
10,016,060 B2 7/2018 Schmitz et al.

(56) References Cited

U.S. PATENT DOCUMENTS 10,016,061 B2 7/2018 Brueske
10,021,984 B2 7/2018 Ludwig et al.
10,098,466 B2 10/2018 Donati
10,206,513 B2 2/2019 Brueske
2001/0000939 A1 5/2001 Roslund, Jr. et al.
2002/0000745 A1 1/2002 Conte
2002/0005659 A1* 1/2002 Schaffner ..... A61G 5/125 297/367 R
2002/0021040 A1 2/2002 Caruso et al.
2002/0041118 A1 4/2002 Howell
2002/0109384 A1 8/2002 Hansen
2003/0075961 A1 4/2003 Struppler et al.
2003/0132653 A1 7/2003 Thole
2003/0137171 A1 7/2003 Deimen et al.
2003/0189367 A1 10/2003 Erker
2004/0051362 A1* 3/2004 Heidmann ..... A47C 1/03255 297/342
2004/0160109 A1 8/2004 Bottemiller
2004/0217521 A1 11/2004 DiBattista et al.
2004/0224127 A1 11/2004 DiBattista et al.
2004/0245827 A1* 12/2004 Bedford ..... A47C 7/28 297/300.1
2004/0262977 A1 12/2004 Dibattista et al.
2005/0035638 A1 2/2005 Pennington et al.
2005/0116525 A1 6/2005 Holcomb et al.
2005/0206209 A1* 9/2005 Schweikarth ..... A47C 7/402 297/411.36
2005/0264071 A1 12/2005 Costaglia
2006/0001296 A1* 1/2006 Riach ..... A61G 13/0018 297/68
2006/0101724 A1 5/2006 Hoekstra et al.
2006/0138837 A1 6/2006 Ronnestad
2006/0175884 A1 8/2006 Jenkins
2006/0181126 A1 8/2006 Eysing
2006/0202530 A1 9/2006 Lin
2006/0238009 A1 10/2006 Igarashi et al.
2007/0001497 A1 1/2007 Diffrient
2007/0007812 A1 1/2007 Doricko
2007/0057562 A1 3/2007 Gregory et al.
2007/0108821 A1* 5/2007 Ueda ..... A47C 1/03255 297/301.1
2007/0108831 A1 5/2007 Ueda
2007/0126271 A1 6/2007 Brodeur
2007/0222265 A1 9/2007 Machael et al.
2007/0241599 A1 10/2007 Hodgdon
2007/0262634 A1 11/2007 Brill et al.
2008/0067848 A1 3/2008 Brauning
2008/0191537 A1* 8/2008 Oda ..... A47C 1/03 297/411.36
2008/0217977 A1* 9/2008 Aldrich ..... A47C 1/023 297/284.3
2008/0290712 A1* 11/2008 Parker ..... A47C 1/023 297/354.11
2009/0015047 A1 1/2009 Baumann
2009/0091170 A1 4/2009 Grentzelius et al.
2009/0102268 A1 4/2009 Schmitz et al.
2009/0146476 A1 6/2009 Kan et al.
2009/0211194 A1 8/2009 Fyfe et al.
2009/0261644 A1 10/2009 Piretti
2010/0117419 A1 5/2010 Schmitz et al.
2010/0164263 A1 7/2010 Malenotti
2010/0289308 A1 11/2010 Schmitz et al.
2011/0215632 A1 9/2011 Gleyal
2011/0241405 A1 10/2011 Slagh
2012/0025574 A1 2/2012 Wilkinson et al.
2012/0091769 A1 4/2012 Parker et al.
2012/0228911 A1 9/2012 Piretti
2013/0082499 A1 4/2013 Schmitz et al.
2013/0099534 A1 4/2013 Barile, Jr. et al.
2013/0099548 A1 4/2013 Schmitz et al.
2013/0119744 A1 5/2013 Panozzo et al.
2013/0134756 A1 5/2013 Hisamoto
2013/0169017 A1 7/2013 Masunaga et al.
2013/0207427 A1 8/2013 Masunaga et al.
2013/0278025 A1 10/2013 Wakabayashi et al.
2014/0023451 A1* 1/2014 Aucoin ..... A61G 3/0808 410/3
2014/0077548 A1 3/2014 Peterson et al.
2014/0077551 A1 3/2014 Battey et al.
2014/0077573 A1 3/2014 Schneider et al.
2014/0103688 A1 4/2014 Wilson
2014/0110983 A1 4/2014 Sander et al.
2014/0139004 A1 5/2014 Matsumoto et al.
2014/0152064 A1 6/2014 Sander et al.
2014/0175849 A1 6/2014 Berti et al.
2014/0183915 A1 7/2014 Deisig et al.
2014/0354026 A1 12/2014 Gorgi
2015/0044419 A1 2/2015 Carson, Jr. et al.
2015/0091353 A1 4/2015 Horn
2015/0130254 A1 4/2015 Yamaguchi et al.
2015/0216308 A1 8/2015 Wilkinson et al.
2015/0265058 A1* 9/2015 Igarashi ..... A47C 7/445 297/285
2015/0314501 A1 11/2015 Maslakow
2015/0343747 A1 12/2015 Meermann et al.
2016/0135603 A1* 5/2016 Chan ..... A47C 7/36 297/284.7
2016/0256342 A1* 9/2016 Alvarez ..... A47C 7/506
2017/0135487 A1 5/2017 Donati
2020/0245768 A1* 8/2020 Ega ..... A47C 1/026

FOREIGN PATENT DOCUMENTS

BE 702816 1/1968
CA 1235055 4/1988
CA 2125728 A1 * 12/1995 ..... A47C 1/03
CN 1531401 A 9/2004
CN 103876498 A1 6/2014
CN 104736018 A 6/2015
DE 1779854 5/1961
DE 6925165 10/1969
DE 1404657 1/1970
DE 2026929 6/1970
DE 2241209 3/1973
DE 2222840 11/1973
DE 2931072 2/1980
DE 3116459 A1 11/1982
DE 3139448 A1 4/1983
DE 3203401 A1 8/1983
DE 8419826 7/1984
DE 3322450 A1 1/1985
DE 3423857 A1 1/1985
DE 3530868 A1 3/1987
DE 3605809 A1 8/1987
DE 3618705 A1 12/1987
DE 3735256 4/1989
DE 3735256 A1 4/1989
DE 3737491 5/1989
DE 3821042 A1 12/1989
DE 4023607 A1 1/1992
DE 4121768 C1 10/1992
DE 4235691 A1 6/1993
DE 4216159 A1 11/1993
DE 4303021 A1 8/1994
DE 4424096 A1 1/1996
DE 29517548 2/1996
DE 4433663 A1 3/1996
DE 4442246 A1 5/1996
DE 19607136 A1 8/1996
DE 29704906 U1 7/1997
DE 19611345 A1 9/1997
DE 19620260 A1 11/1997
DE 29717573 U1 2/1998
DE 19640564 A1 4/1998
DE 19714546 A1 10/1998
DE 10051840 A1 5/2002
DE 10122945 12/2002
DE 202004004800 U1 5/2004
DE 102005054125 B3 5/2007
DE 202006005645 U1 9/2007
DE 202007010030 U1 9/2007
DE 102006056928 6/2008
DE 202007001395 6/2008

(56) References Cited

FOREIGN PATENT DOCUMENTS

| | | | | | |
|---|---|---|---|---|---|
| DE | 102009019232 | | | 11/2009 | |
| DE | 202010008739 | U1 | | 1/2012 | |
| DE | 102013205784 | A1 | | 10/2014 | |
| DE | 102013022122 | A1 | | 7/2015 | |
| EP | 0006840 | A1 | | 1/1980 | |
| EP | 0014001 | A1 | | 8/1980 | |
| EP | 0049310 | A1 | | 4/1982 | |
| EP | 0081102 | A1 | | 6/1983 | |
| EP | 0107627 | A1 | | 5/1984 | |
| EP | 0151816 | A2 | | 8/1985 | |
| EP | 0202386 | A2 | | 11/1986 | |
| EP | 0247312 | | | 12/1987 | |
| EP | 284272 | A1 | | 9/1988 | |
| EP | 0298928 | A2 | | 1/1989 | |
| EP | 0338050 | | | 10/1989 | |
| EP | 0339089 | | | 11/1989 | |
| EP | 0434897 | | | 7/1991 | |
| EP | 0434897 | A1 | | 7/1991 | |
| EP | 0552388 | A1 | | 7/1993 | |
| EP | 0559185 | A1 | | 9/1993 | |
| EP | 0578276 | A1 | | 1/1994 | |
| EP | 0591932 | | | 4/1994 | |
| EP | 0592369 | | | 4/1994 | |
| EP | 0678260 | A1 | | 10/1995 | |
| EP | 0540711 | B1 | | 9/1996 | |
| EP | 0860355 | A1 | | 2/1997 | |
| EP | 0870443 | A2 | | 10/1998 | |
| EP | 0982179 | A2 | | 7/1999 | |
| EP | 0982180 | A1 | | 8/1999 | |
| EP | 0960586 | A2 | | 12/1999 | |
| EP | 1040999 | A2 | | 4/2000 | |
| EP | 1316651 | A2 | | 4/2000 | |
| EP | 1066776 | | | 1/2001 | |
| EP | 1161905 | A1 | | 12/2001 | |
| EP | 1559348 | A2 | | 1/2005 | |
| EP | 1886798 | A2 | | 7/2007 | |
| EP | 1854378 | A1 | | 11/2007 | |
| EP | 2070443 | | | 12/2007 | |
| EP | 2047769 | A1 | | 4/2009 | |
| EP | 2070446 | A1 | | 6/2009 | |
| EP | 2100539 | A1 | | 9/2009 | |
| EP | 2110050 | A1 | | 10/2009 | |
| EP | 2110051 | A1 | | 10/2009 | |
| EP | 2110052 | A1 | | 10/2009 | |
| EP | 2335527 | A1 | | 6/2011 | |
| EP | 2520199 | A1 | | 11/2012 | |
| EP | 2582267 | A1 | | 4/2013 | |
| EP | 2765026 | A1 | | 8/2014 | |
| EP | 2787860 | A1 | | 10/2014 | |
| FR | 820791 | | | 11/1937 | |
| FR | 1518777 | | | 3/1968 | |
| FR | 1531798 | | | 7/1968 | |
| FR | 2045120 | | | 2/1971 | |
| FR | 2233799 | | | 6/1973 | |
| FR | 2461472 | | | 2/1981 | |
| FR | 2533428 | | | 3/1984 | |
| FR | 2715124 | A1 | | 7/1995 | |
| GB | 469313 | | | 7/1937 | |
| GB | 608327 | | | 9/1948 | |
| GB | 770169 | | | 3/1957 | |
| GB | 2028119 | | | 3/1980 | |
| GB | 2092438 | | | 8/1982 | |
| JP | 07246123 | | | 6/1995 | |
| JP | H0889359 | A | | 4/1996 | |
| JP | 1099158 | A | | 4/1998 | |
| JP | 2000270965 | A | * | 10/2000 | ..... A47C 1/03 |
| JP | 2002119357 | A | | 4/2002 | |
| JP | 2004049658 | | | 2/2004 | |
| JP | 2013132403 | A | | 7/2013 | |
| JP | 2014083103 | A | * | 5/2014 | ..... A47C 1/03 |
| JP | 2015177979 | A | | 10/2015 | |
| NO | 120698 | B | | 11/1970 | |
| TW | 414257 | B | | 11/2013 | |
| WO | 9220262 | A1 | | 11/1992 | |
| WO | 0074531 | | | 8/2001 | |
| WO | 0176418 | A1 | | 10/2001 | |
| WO | 0191614 | A1 | | 12/2001 | |
| WO | 02058514 | A1 | | 8/2002 | |
| WO | 02091880 | A1 | | 11/2002 | |
| WO | 2004103121 | A1 | | 12/2004 | |
| WO | 2007012418 | A1 | | 2/2007 | |
| WO | 2007110732 | A2 | | 10/2007 | |
| WO | 2007112236 | | | 10/2007 | |
| WO | 2008000295 | A1 | | 1/2008 | |
| WO | 2008092562 | | | 8/2008 | |
| WO | 2008146887 | A1 | | 12/2008 | |
| WO | 2008149224 | | | 12/2008 | |
| WO | 2009039231 | A2 | | 3/2009 | |
| WO | 2009134451 | | | 11/2009 | |
| WO | 2009153811 | | | 12/2009 | |

* cited by examiner

SEATING ARRANGEMENT

CROSS REFERENCE TO RELATED APPLICATIONS

This application is a continuation of U.S. patent application Ser. No. 15/096,809, filed on Apr. 12, 2016, entitled "SEATING ARRANGEMENT," now U.S. Pat. No. 10,021,984 which claims the benefit of U.S. Provisional Patent Application No. 62/146,666, filed Apr. 13, 2015, entitled "COMPLIANT SEATING ARRANGEMENT WITH CUT-OUTS," U.S. Provisional Patent Application No. 62/146,672, filed Apr. 13, 2015, entitled "COMPLIANT SEATING ARRANGEMENT WITH ACTIVE BACK," U.S. Provisional Patent Application No. 62/146,678, filed Apr. 13, 2015, entitled "SEATING WITH COMPLIANT FOUR-BAR ARRANGEMENT AND ACTIVE-BACK," U.S. Provisional Patent Application No. 62/153,266 filed Apr. 27, 2015, entitled "SEATING ARRANGEMENT," and U.S. Provisional Patent Application No. 62/232,784, filed Sep. 25, 2015, entitled "SEATING ARRANGEMENT," the entire disclosures of which are incorporated herein by reference.

TECHNICAL FIELD

Various embodiments relate to a seating arrangement, and in particular to a seating arrangement that includes various combinations of a pair of flexibly resilient shell members, a flexibly resilient support member and a rigid support member that cooperate to form a deformable and flexibly resilient four-bar linkage, and an active back arrangement having a movement that may be separated from movement of an associated seat support arrangement.

BRIEF SUMMARY

In one embodiment, a seating arrangement includes a base, a lower shell including a first portion coupled to the base and comprising a substantially horizontal portion, a curved transition portion and a backrest portion, a pair of laterally spaced front links extending upwardly from a forward portion of the first portion, a rear link extending upwardly from a rearward portion of the first portion of the lower shell and forwardly of the transition region of the lower shell, and an upper shell comprising a seating portion coupled to the pair of front links and to the rear link, a curved transition portion spaced apart from the curved transition portion of the lower shell and defining an open lateral pass through there between, and a backrest portion connected to the backrest portion of the lower shell.

In another embodiment, a seating arrangement includes a base, a lower shell including a first portion coupled to the base and comprising a substantially horizontal portion, a front link extending upwardly from a forward portion of the first portion, a rear link extending upwardly from a rearward portion of the first portion, and an upper shell comprising a seating portion coupled to the front and rear links and that cooperates with the substantially horizontal portion of the first portion of the lower shell to define an open lateral pass through there between, and a backrest portion extending upwardly from the seating portion. The embodiment further includes a support member positioned at least partially within the pass through, and at least one of an armrest assembly, a leg assembly and a tilt limiter supported by the support member within the pass through.

Yet another embodiment includes a seating arrangement that includes a base, a lower shell comprising a first portion coupled to the base and including a substantially horizontal portion, a front link extending upwardly from a forward portion of the first portion, a rear link extending upwardly from a rearward portion of the first portion, an upper shell comprising a seating portion coupled to the front and rear links and that cooperates with the substantially horizontal portion of the first portion of the lower shell to define an open lateral pass through there between, and a backrest portion extending upwardly from the seating portion, and a support member positioned at least partially within the pass through, the support member configured to support a seating arrangement accessory.

These and other features, advantages, and objects of various embodiments will be further understood and appreciated by those skilled in the art by reference to the following specification, claims, and appended drawings.

DETAILED DESCRIPTION OF THE PREFERRED EMBODIMENTS

Figure 1:
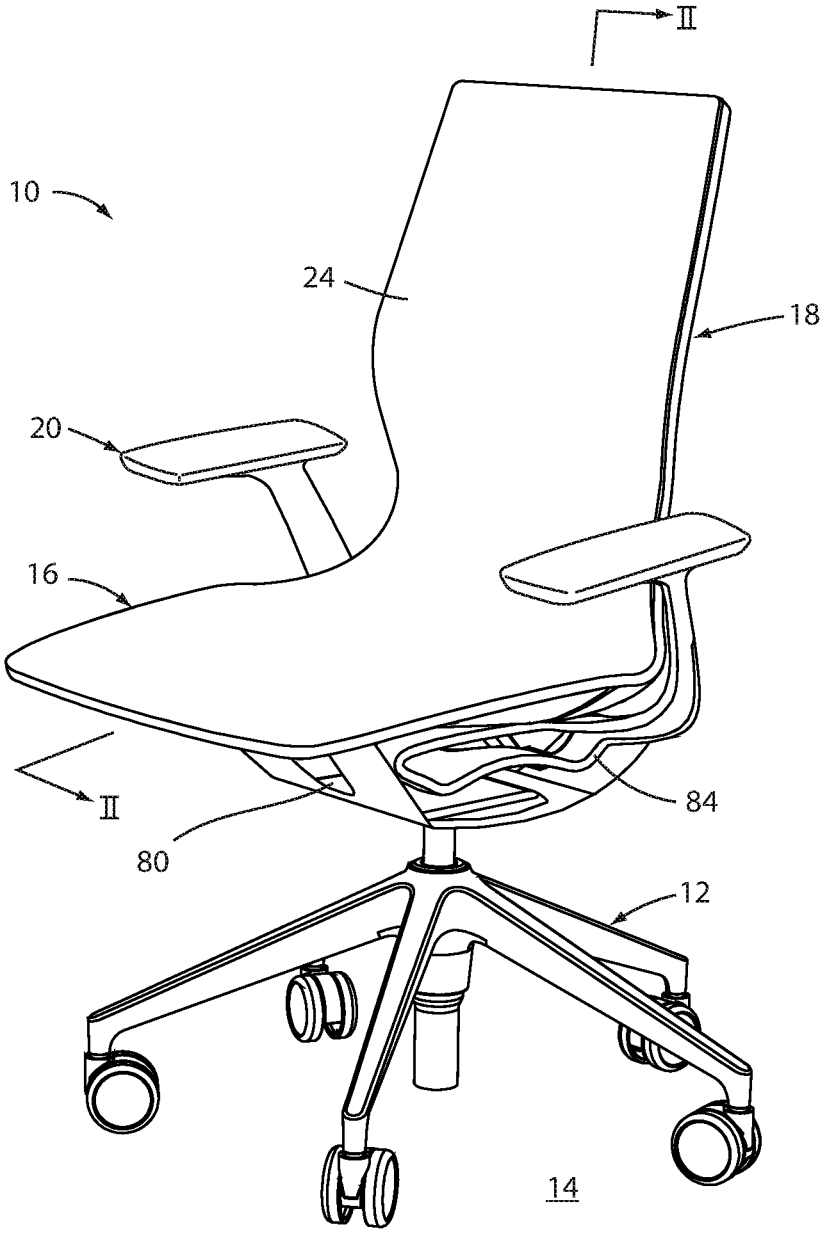
FIG. 1 is a perspective view of an embodiment of a seating arrangement.

For purposes of description herein, the terms "upper," "lower," "rear," "front," "vertical," "horizontal," and derivatives thereof shall relate to the various seating embodiments as oriented in FIGS. 1, 9, 17 and 22. However, it is to be understood that certain embodiments may assume various alternative orientations and step sequences, except where expressly specified to the contrary. It is also to be understood that the specific devices and processes illustrated in the attached drawings, and described in the following specification are exemplary embodiments of the concepts defined in the appended claims. Hence, specific dimensions and other physical characteristics relating to the embodiments disclosed herein are not to be considered as limiting, unless the claims expressly state otherwise. The various embodiments disclosed herein may be utilized within and incorporated into various seating arrangements, including office chairs, general office seating, vehicle seating, home seating, aircraft seating, stadium seating, theater seating, and the like.

The reference numeral 10 (FIG. 1) generally designates an embodiment of a seating arrangement. In the illustrated example, the seating arrangement 10 is provided in the form of an office chair assembly and includes a cantered base or support assembly 12 supported above a ground or floor surface 14, a seat arrangement 16 and a back arrangement 18 each supported above the base assembly 12, and a pair of arm assemblies 20. The seating arrangement 10 (FIGS. 2 and 3) includes a front or first shell member 22 covered by a fabric layer 24 (FIG. 1) and a rear or second shell member 26. The shell members 22, 26 may be formed as a single, integral piece or comprise multiple, individual components. The shell members 22, 26 each comprise a flexibly resilient polymer material such as any thermoplastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 22, 26 to conform and move in response to forces exerted by a user. Other suitable materials may also be utilized, such as metals, including, for example, steel or titanium; plywoods; or composite material including plastics, resin-based composites, metals and/or plywood. A variety of other suitable energy-storing materials may also be utilized. In some embodiments, shell members 22, 26 may comprise the same material or materials, while in certain embodiments, shell members 22, 26 may each comprise a different material or materials.

The front shell member 24 includes a horizontally-extending bottom or first portion or first link member 28, a vertically-extending upper or second portion 30 extending upwardly from the first portion 28, and an arcuately-shaped transition portion 32 extending between the first portion 28 and the second portion 30. The first portion 28 includes a forward portion 34, a rearward portion 36 and a central portion 38 located therebetween and extending laterally across the first portion 28. A pair of laterally-extending reliefs or apertures 40 are located within the central portion 38 and divide the forward portion 34 from the rearward portion 36 as further described below. The second portion 30 includes a lower portion 44, an upper portion 46 and a mid-portion 48 located therebetween that may be arcuately-shaped and forwardly convex so as to support the lumbar region of a user's back. It is noted that the front shell member 24 may alternatively be referred to herein as the forward shell member, the first shell member, the support member or support shell member, and the top shell or shell member.

The rear shell member 26 includes a horizontally-extending bottom or first portion or second link member 50 supported by a height adjustable pneumatic cylinder 12*a* at a connection point 12*b*, a vertically-extending upper or second portion 52 extending upwardly from the first portion 50, and an arcuately-shaped transition portion 54 extending between the first portion 50 and the second portion 52. Preferably, the rear shell member 26 comprises carbon fiber, however, other materials may also be utilized as described above. The second portion 52 of the rear shell member 26 includes a lower portion 56, an upper portion 58 and a mid-portion 60 located therebetween that may be arcuately-shaped and forwardly convex. The upper portion 58 of the second portion 52 of the rear shell member 26 is connected to the upper portion 46 of the second portion 30 of the front shell member 22 at a location 62, such as by sonic welding, an adhesive, integral molding, mechanical fasteners, and the like. It is noted that the rear shell member 26 may alternatively be referred to herein as the rearward shell member, the second shell member, the bottom shell or shell member, or the control arrangement. The front shell member 22 and the rear shell member 26 are configured so as to define a gap 64 between at least a portion of the upper portion 30 and upper portion 52, between the mid-portion 48 and the mid-portion 60, between the lower portion 44 and the lower portion 56, between the transition portion 32 and the transition portion 54, and/or between the first portion 28 and first portion 50. In certain embodiments, the front shell member 22 and the rear shell member 26 may be connected at the lower portions or mid-portions of their respective second portions 30 and 52 or at their respective transition portions 21 and 54. For example, the front shell member 22 and the rear shell member 26 may be connected at their respective lower portions 44 and 56 such that seating arrangement 10 essentially has a single shell second portion with a gap 64 between the first portions 28 and 50.

The seating arrangement 10 further includes a laterally-extending, flexibly resilient forward support member 66, and a laterally-extending, rigid rearward support member 68, each extending between the first portion 28 of the front shell member 22 and the first portion 50 of the rear shell member 26. In the illustrated example, the forward support member 66 is integral and forms a single-piece with the first portion 50 of the rear shell member 26, while the rearward support member 68 is formed as and is a separate piece from the front shell member 22 and the rear shell member 26. However, either or both the forward support member 66 and the rearward support member 68 may be formed integrally with or as a separate piece from the front shell member 22 and/or the rear shell member 26. In the present example, the rearward support member 68 preferably comprises a rigid, relatively lightweight carbon fiber, however, other material or materials may also be utilized depending on the application, including those listed above with respect to the front and rear shell members 24. The rearward support member 68 includes a body portion 70, an upper flange 72 secured to a bottom surface 74 of the first portion 28 at a location 74*a*, and a lower flange 76 secured to an upper surface 78 of the first portion 50 at a location 78*a*. The upper flange 72 and the lower flange 76 are secured to the first portion 28 and the first portion 50 by sonic welding, an adhesive, mechanical fasteners, friction fit and the like. Both the forward support member 66 and the rearward support member 68 angle forwardly from bottom to top, while the forward support member 66 includes a V-shaped notch or aperture 80 extending therethrough. In certain embodiments, the forward support member 66 may include one or more apertures, notches, or slots of varying shapes in order to promote a desired flexibility of the support member. Similarly, in some embodiments, the forward support member 66 may be a solid member shaped to promote a desired flexibility. The various configurations of the rear shell member as described herein, whether provided as a single, integral, one-piece unit or as a multiple-piece assembly allows the rear shell member to act as a control member to control various recline movements and support characteristics of the front shell member.

Figure 4A:
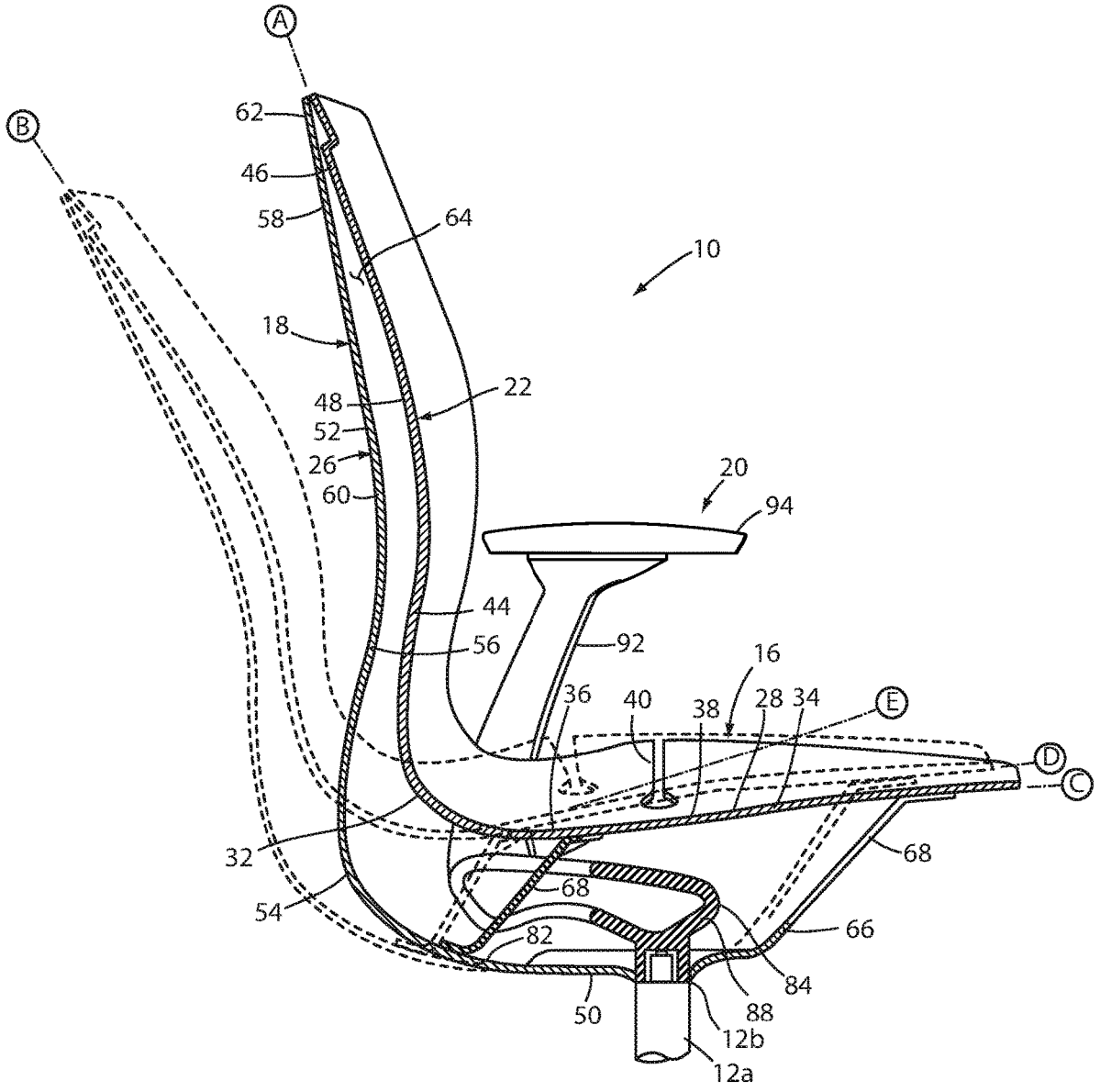
FIG. 4*a* is a cross-sectional side elevational view of the embodiment of the seating arrangement shown in FIG. 1 shown in an upright position in solid line and in a reclined position in dashed line.
Figure 4B:
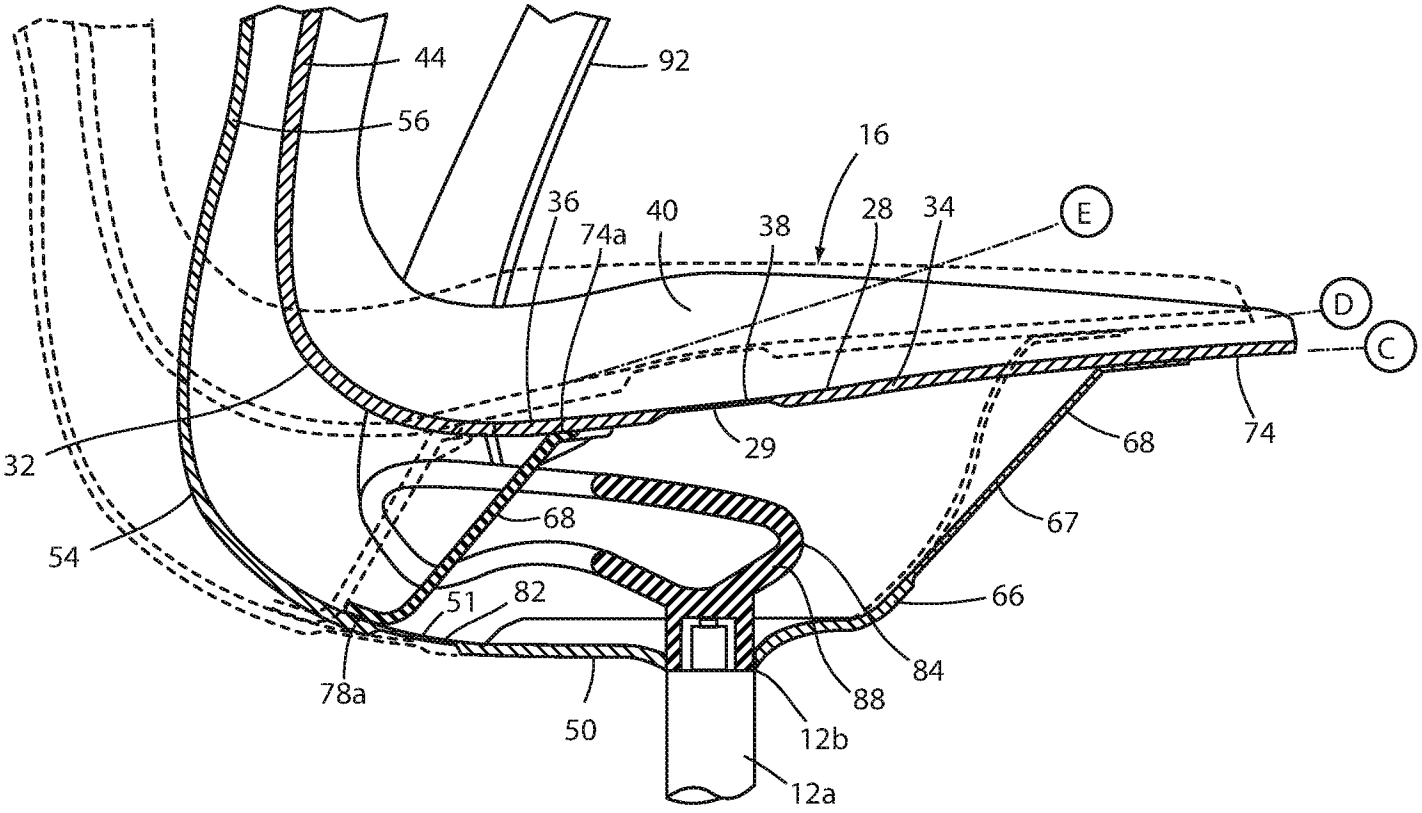
FIG. 4*b* is an enlarged cross-sectional side elevational view of another embodiment of a seating arrangement.

In operation, a user can move or recline the back arrangement 18 (FIG. 4*a*), including the second portion 30 of the front shell member 22 and the second portion 52 of the rear shell member 26, from an upright position A to a reclined position B by flexing the front shell member 22 and the rear shell member 26. The first portion or first link member 28, the first portion or second link member 50, the forward support member or third link member 66 and the rearward support member or fourth link member 68 cooperate to form a four-bar linkage arrangement such that movement of the second portion 30 of the first shell member 22 and the second portion 52 of the rear shell member 26 from the upright position A to the reclined position B causes the first portion 28 of the front shell member 22 to move rearward and to a reclined position. It is contemplated that the four-bar linkage arrangement as used and described herein is inclusive of linkage arrangements comprising additional linkage members, such as five-bar linkage arrangements, six-bar linkage arrangements, and the like. FIG. 4 illustrates in solid line the first portion 28 of the front shell member 22 in a substantially horizontal orientation C when not acted upon by external forces, such as a force exerted by a seated user. The apertures or reliefs 40 allow the rearward portion 36 to rotate more rapidly and to a greater recline angle than the forward portion 34 during recline of the back arrangement 18. Specifically, the forward portion 34 is moved from the position C to a rearward and reclined position D, while the rearward portion 36 of the first portion 28 is moved from the position C to a rearward and more reclined position E. In certain embodiments, apertures 40 may be positioned in first portion 28, either in the central portion 38, forward portion 34, or rearward portion 36, so as to achieve a desired rotation and recline angle during the recline of back arrangement 18. It is further noted that the rearward support member 68 remains rigid or substantially rigid during the entire recline movement of the seating arrangement 10, while most deformation of the front shell member 22 and the rear shell member 26 occurs in a portion 82 of the rear shell member 26 just forward of the location at which the rearward support member 68 is connected to the rear shell member 26, in the central portion 38 of the first portion 28 of the first shell member 22, and in the forward support member 26. Further, in some instances, the fourth link 68 may include at least a portion of the back arrangement 18. In various embodiments, the thickness of one or more links may be determined to achieve a desired performance characteristic, including for example, the flexibility of the link. Further, in certain embodiments, the thickness of a link may vary along the length of the link to achieve a desired flexibility or rigidity across the link or in a localized portion of the link. For example, the first link member 28, the second link member 50 and the forward link member 66 may all be more flexible than the rear link member 68 to achieve the desired flexibility of the four-bar linkage. In some embodiments, the various links may be more flexible in a particular portion or localized area of the link such that the links are generally flexible in the localized area and are generally not flexible or less flexible in any other area of the link. An example of this embodiment is illustrated in FIG. 4*b* where certain portions of the first link member 28, the second link member 50, and the third link member 66 include certain portions with a reduced relative thickness. Specifically, in the illustrated example, the first link member 28 includes an area of reduced thickness or flexing region or flexing zone 29 located in the central portion thereof, the second link member 50 includes an area of reduced thickness or flexing region or flexing zone 51 positioned rearward of the location at which the fourth link member attaches to the second link member 50, and the third link member 66 includes an area of reduced thickness or flexing region or flexing zone 67. It is noted that the relative areas of reduced thickness may extend along a short distance or the majority of the length of the associated link depending upon the support and bending characteristics desired.

Figure 2:
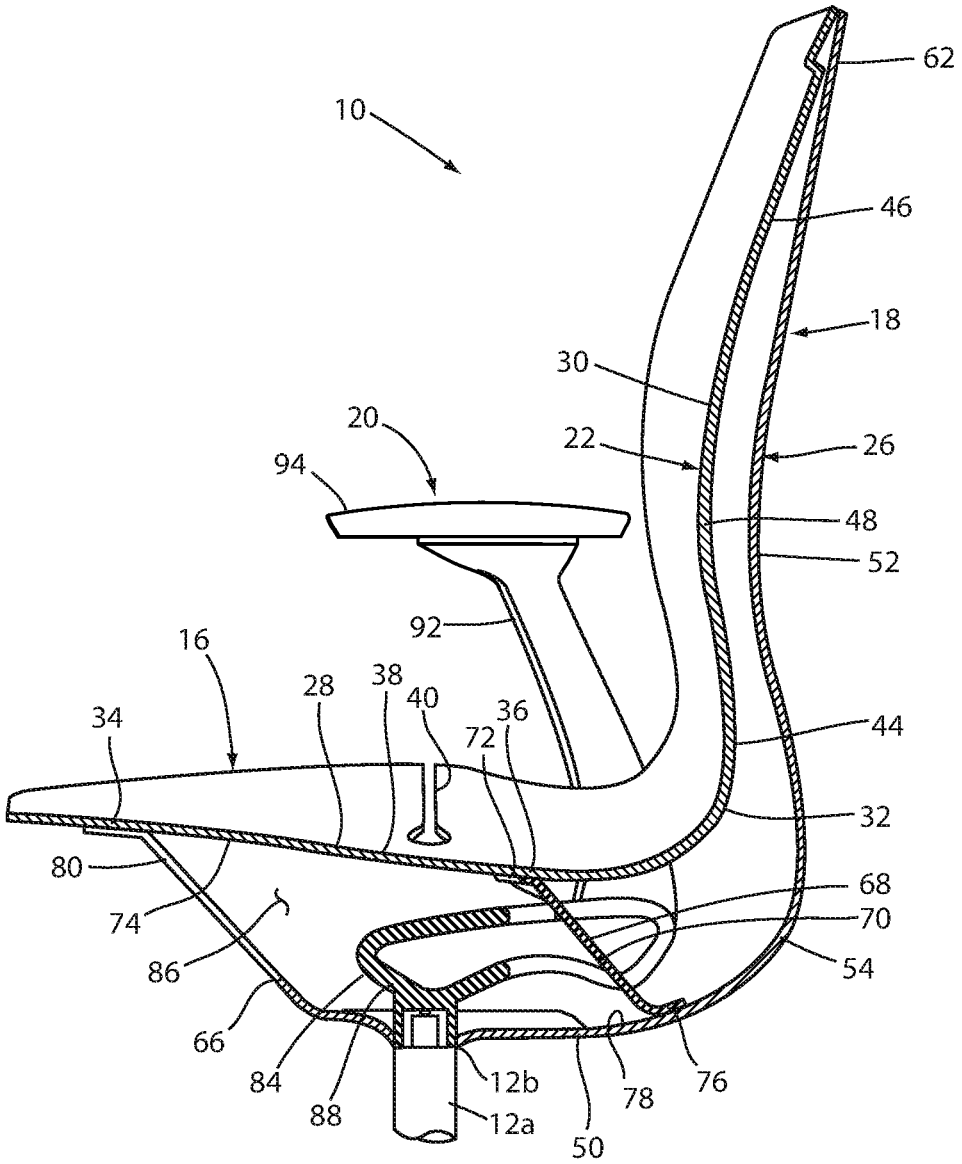
FIG. 2 is a cross-sectional side elevational view of the embodiment of the seating arrangement shown in FIG. 1 taken along the line II-II, FIG. 1.
Figure 3:
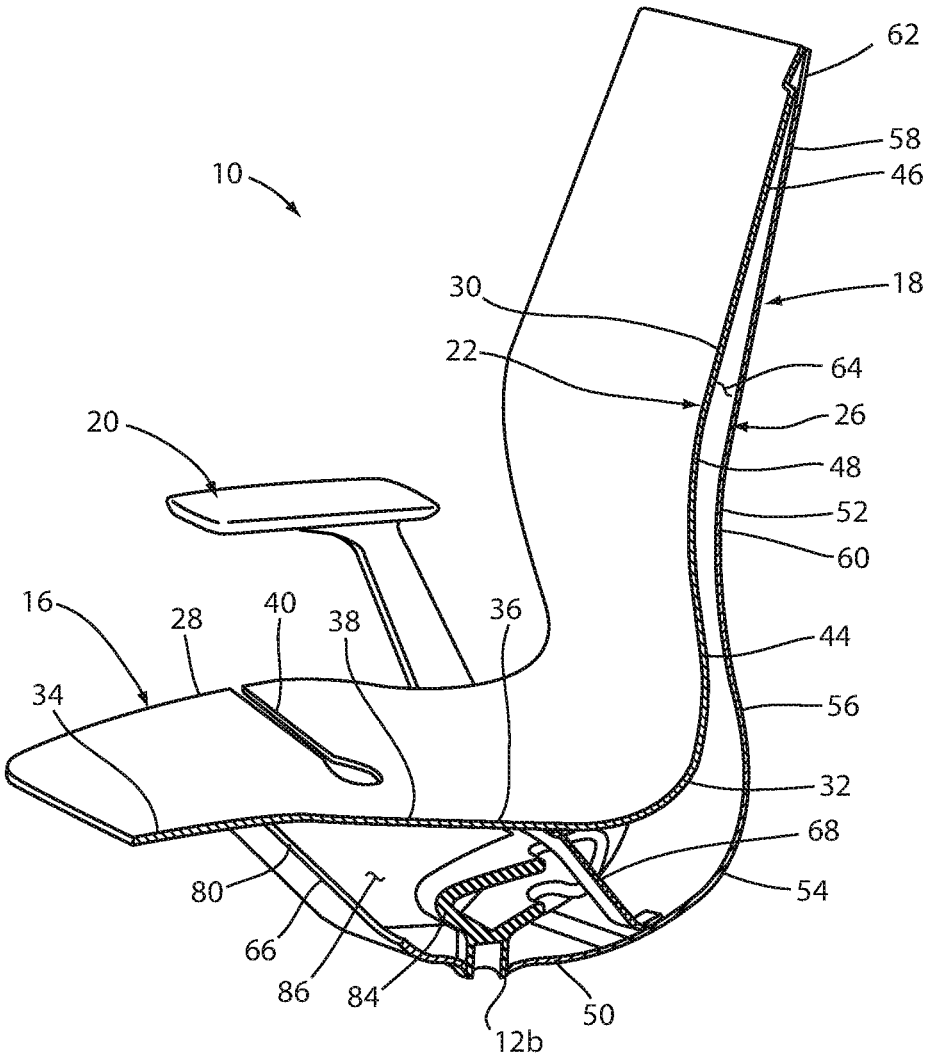
FIG. 3 is a cross-sectional perspective view of the embodiment of the seating arrangement shown in FIG. 1 taken along the line II-II, FIG. 1.

The seating arrangement 10 further includes a support member 84 (FIGS. 1-3) at least partially located within an interior space 86 defined by the four-bar linkage arrangement, namely, the first link member 28, the second link member 50, the third link member 66 and the fourth link member 68. In the illustrated example, the support member 84 includes an open, loop-shaped body portion 86, the forward portion of which extends into the interior space 86, and the rearward portion of which is configured to support the arm assemblies 20. As best illustrated in FIG. 2, each arm assembly 20 includes an arm support member 92 integrally formed with and extending upwardly from the rear portion of the body portion 88 of the support member 84. An arm cap 94 is secured to an upper end of the arm support member 92 and may be movably adjustable with respect thereto. As best illustrated in FIG. 4, it is noted that the support member 84 and the arm assemblies 20 are grounded and remain substantially stationary as the back arrangement 18 is moved from the upright position A to the reclined position B.

Figure 5:
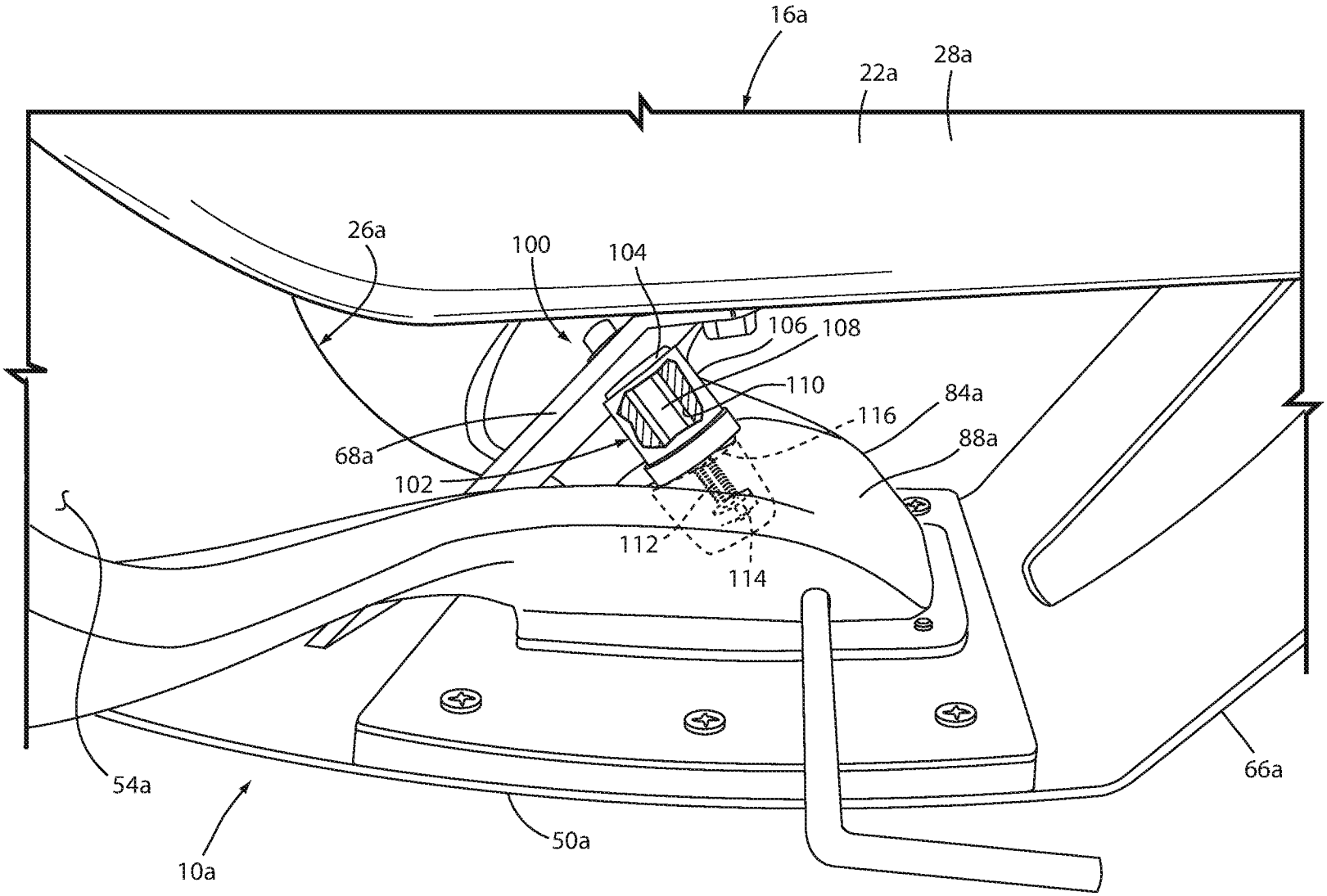
FIG. 5 is an enlarged perspective view of a first embodiment of a stop arrangement, wherein the associated seating arrangement is in a fully forward position.
Figure 6:
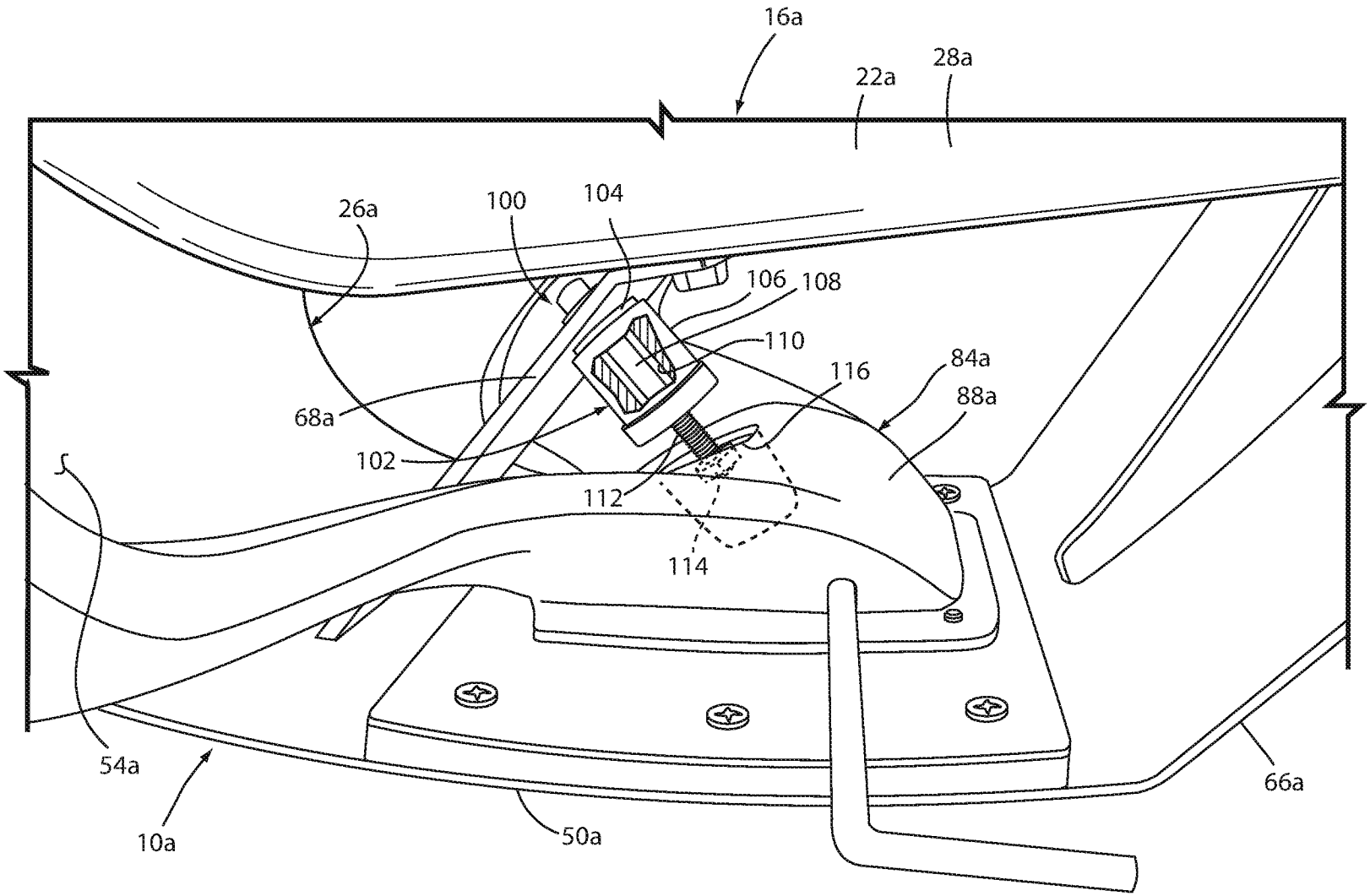
FIG. 6 is an enlarged perspective view of the first embodiment of a stop arrangement, wherein the associated seating arrangement is in a fully reclined position.

The reference numeral 10*a* (FIG. 5) generally designates another embodiment of a seating arrangement, having a stop arrangement 100. Since the seating arrangement 10*a* is similar to the previously described seating arrangement 10, similar parts appearing in FIGS. 1-4 and FIGS. 5 and 6 respectively are represented by the same, corresponding reference numeral, except for the suffix "a" in the numerals of the latter. In the illustrated example, the stop arrangement 100 includes a bushing assembly 102 positioned between the body portion 88*a* and the rearward support member 68*a*. The bushing assembly 102 includes an elastically deformable bushing member 104, a sleeve member 106 extending about the bushing member 104, and a stop link 108 slidably extending through a centrally disposed aperture 110 of the bushing member 104 and having a first end fixably coupled to the rearward support member 68*a* and a second end 112 slidably received within an interior of the body portion 88*a* of the support member 84*a*. A stop plate 114 is affixed to the second end 112 of the stop link 108.

In operation, the bushing member 104 is compressed between the body portion 88*a* of the support member 84*a* and the rearward support member 68*a* as the back arrangement is moved in a forward direction from the reclined position to a fully forward upright position, thereby limiting the forward movement of the back arrangement. As the back arrangement is moved from the upright position to the reclined position, the stop link 108 is drawn from within an interior of the body portion 88*a* until the stop plate 114 abuts an inner surface 116 of the body portion 88*a*, thereby limiting movement of the rearward support member 68*a* and thus the rearward movement of the back assembly from the upright position toward the reclined position.

Figure 7:
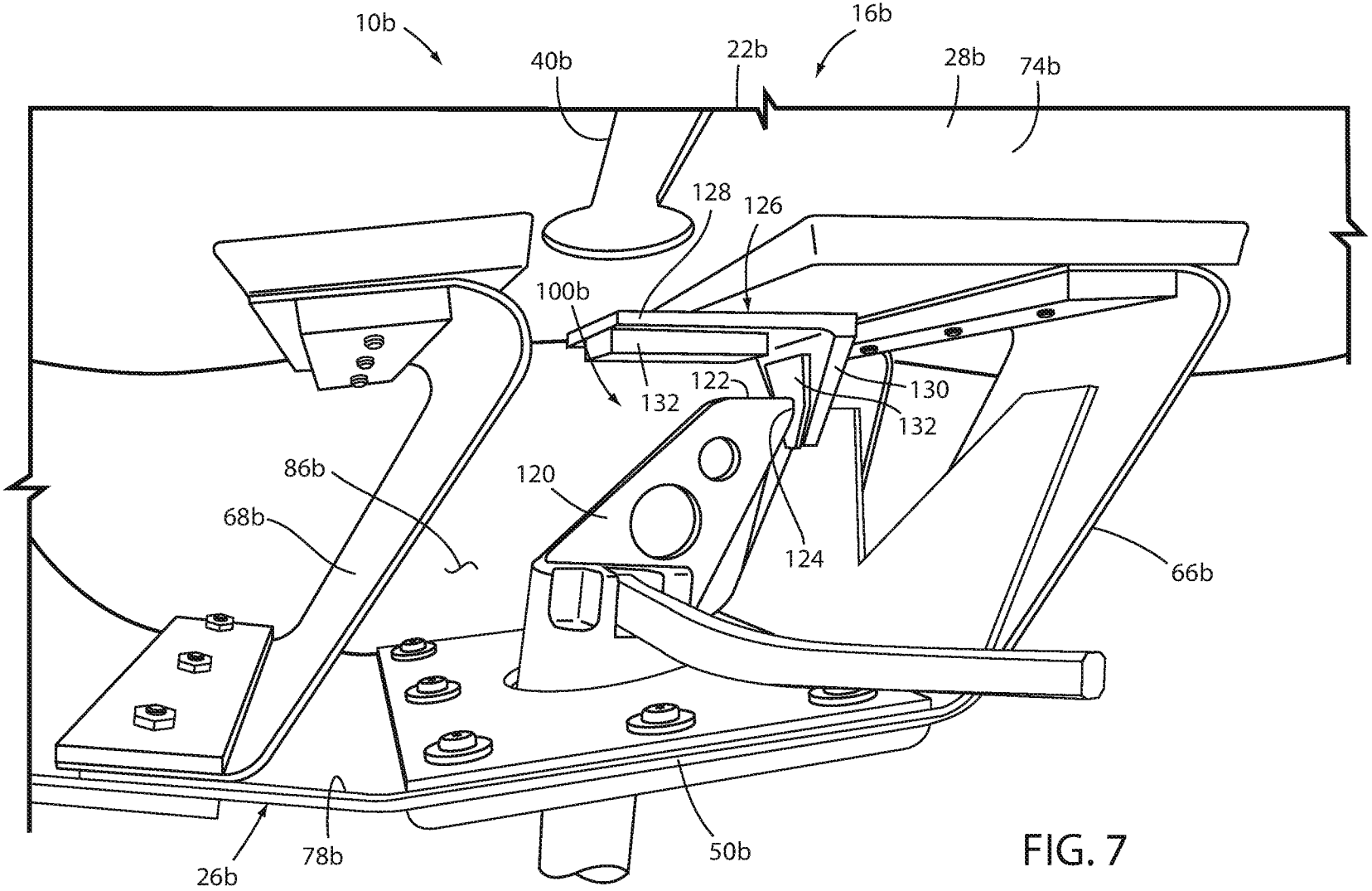
FIG. 7 is an enlarged perspective view of an alternative embodiment of the stop arrangement, wherein the associated seating arrangement is shown in a fully reclined position.
Figure 8:
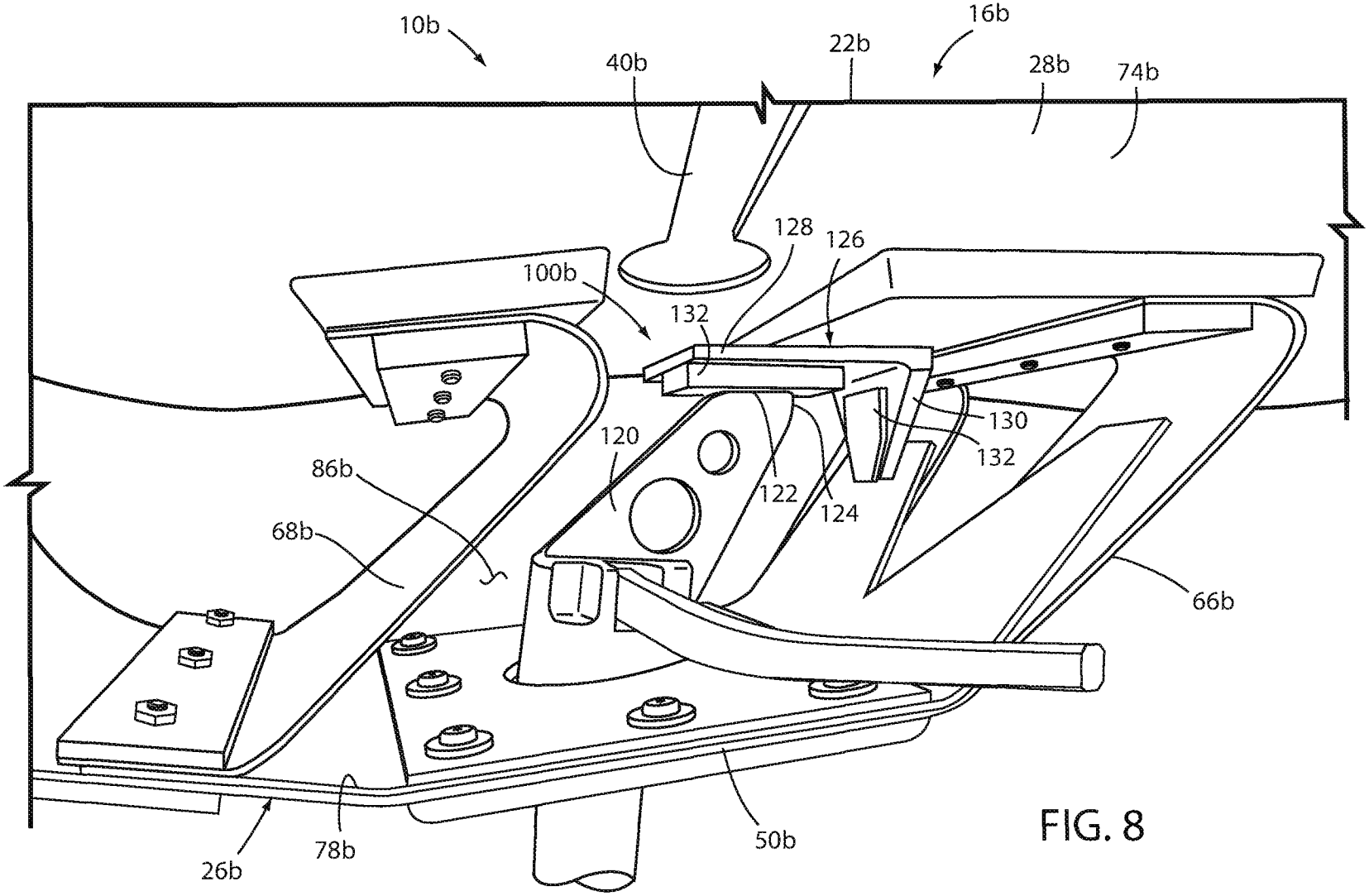
FIG. 8 is an enlarged perspective view of the alternative embodiment of the stop arrangement, wherein the associated seating arrangement is shown in a fully forward position.
Figure 9:
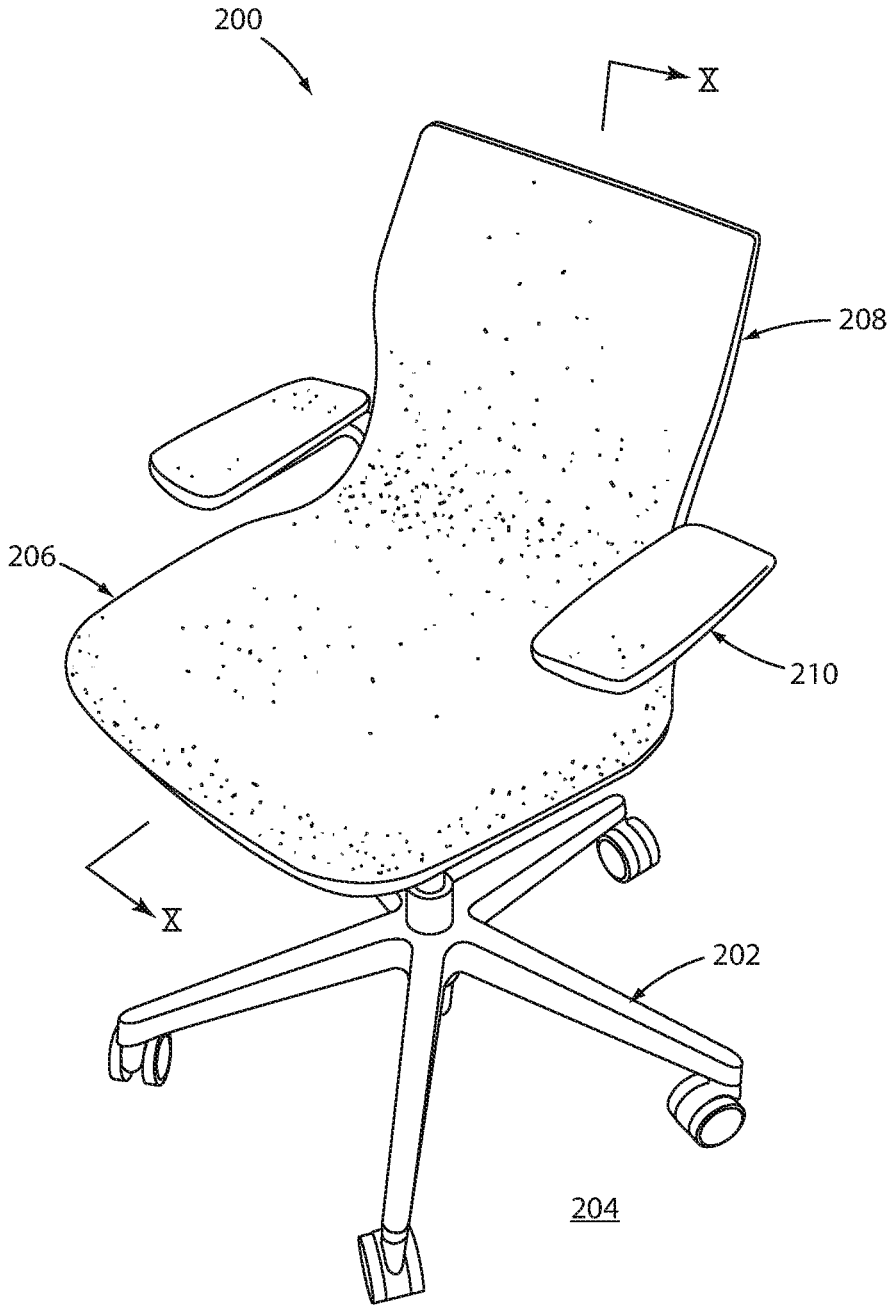
FIG. 9 is a perspective view of another embodiment of a seating arrangement.

The reference numeral 10*b* (FIGS. 7 and 8) generally designates another embodiment of a seating arrangement, having a stop arrangement 100*b*. Since the seating arrangement 10*b* is similar to the previously described seating arrangement 10*a*, similar parts appearing in FIGS. 5 and 6 and FIGS. 6 and 7 respectively are represented by the same, corresponding reference numeral, except for the suffix "b" in the numerals of the latter. In the illustrated example, the stop arrangement 100*b* includes a stop member 120 located within the interior space 86*b*. The stop member 120 is secured to an upper surface 78*b* of the first portion 50*b* of the rear shell member 26*b* and extends upwardly therefrom into the interior space 86*b* positioned between the first link member 28*b*, the second link member 50*b*, the third link member 66*b* and the fourth link member 68*b*. The stop member 120 includes an upper or first stop surface 122 and a forward or second stop surface 124. A stop bracket 126 is secured to the bottom surface 74*b* of the first portion or first link member 28*b*, and includes a first portion 128 extending substantially parallel with the first portion or first link member 28*b*, and a second portion 130 extending orthogonally downward from the first portion 128. Elastically deformable abutment pads 132 are attached to the first portion 128 and the second portion 130.

In operation, the stop member 120 is configured to abut the pad 132 attached to the first portion 128 as the back assembly is moved from the reclined position toward a fully forward position, thereby limiting the amount of forward travel of the first portion or first link member 28*b* and the back assembly 12 in the forward direction. The stop member 120 is further configured such that the forward stop surface 124 contacts the pad 132 attached to the second portion 130 when the back arrangement is moved from the upright position to the reclined position, thereby limiting the amount of rearward travel of the first portion or first link member 28*b* and the back arrangement in the rearward direction.

Figure 10:
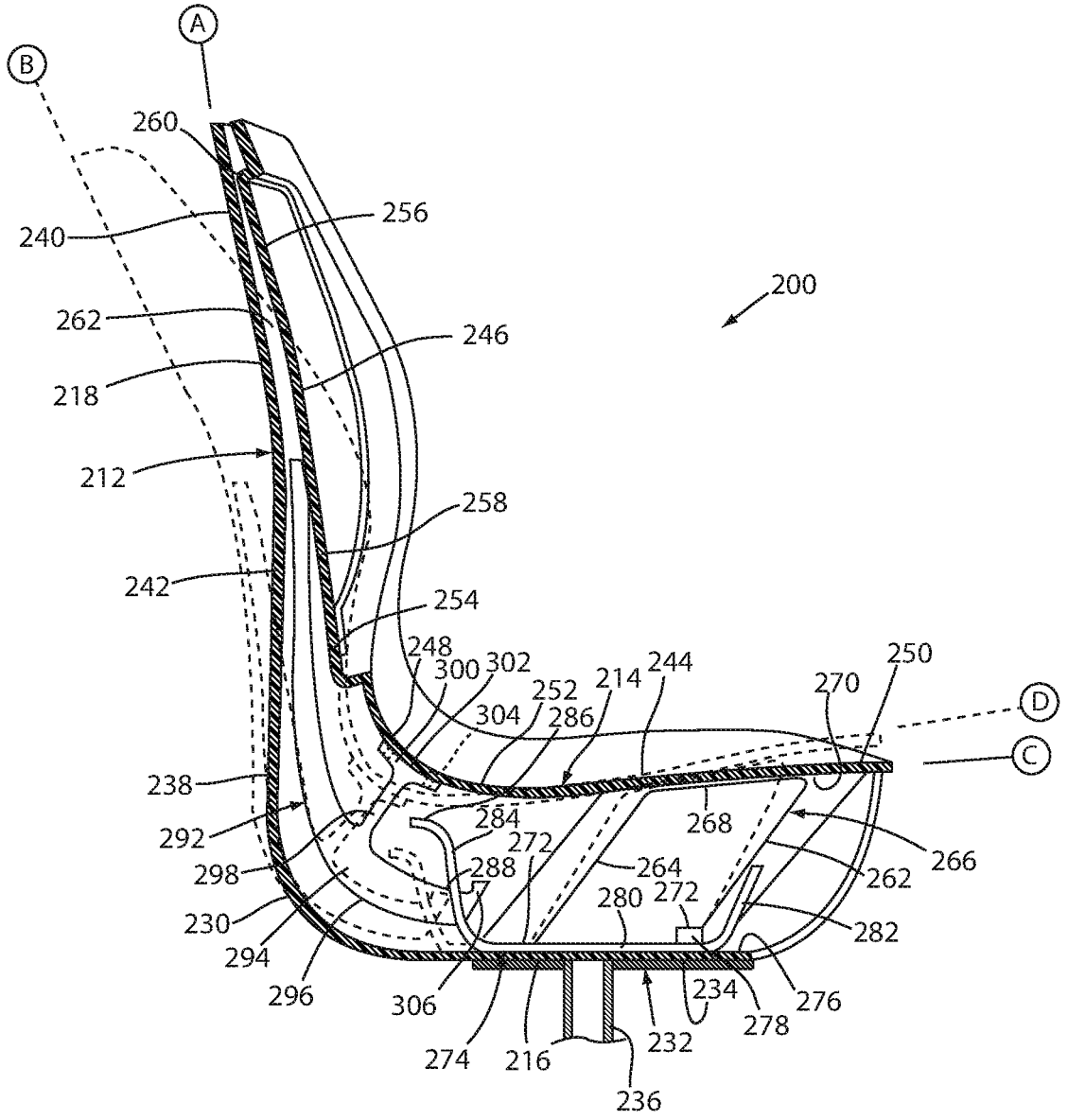
FIG. 10 is a cross-sectional side elevational view of the embodiment of the seating arrangement shown in FIG. 9 taken along the line X-X, FIG. 9.
Figure 11:
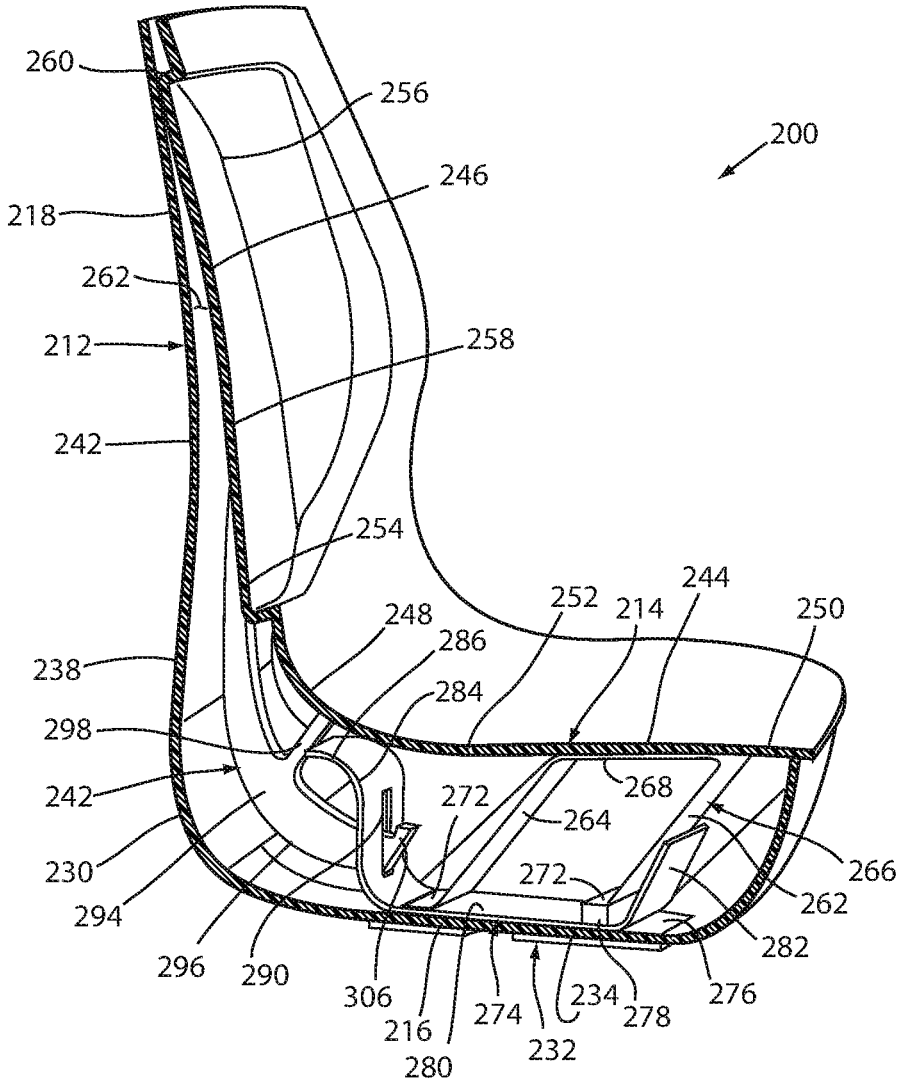
FIG. 11 is a cross-sectional perspective view of the embodiment of the seating arrangement shown in FIG. 9 taken along the line X-X, FIG. 9.

The reference numeral 200 (FIG. 9) generally designates another embodiment of a seating arrangement. In the illustrated example, the seating arrangement or chair assembly 200 includes a cantered base assembly 202 abutting a floor surface 204, a seat assembly 206 and a back assembly 208 each supported above the base assembly 202, and a pair of arm assemblies 210. In the illustrated example, the chair assembly 200 (FIGS. 10 and 11) includes a front or a first shell member 214 and a rear or second shell member 212. The shell members 212, 214 may be formed as a single, integral piece or comprise multiple, individual components. The shell members 212, 214 each comprise a flexibly resilient polymer material such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 212, 214 to conform and move in response to forces exerted by a user. Although a polymer material is preferred, other suitable materials may also be utilized, such as metals, including, for example, steel or titanium; plywood; or a composite material including plastics, resin-based composites, metals and/or plywood. A variety of other suitable energy-storing materials may also be utilized.

The rear shell member 212 includes a horizontally-extending bottom or first portion 216, a vertically-extending upper or second portion 218 extending upwardly from the first portion 216, and an arcuately-shaped transition portion 230 extending between the first portion 216 and the second portion 218. In the illustrated example, the first portion 216 is supported by a support plate 232 that abuts a bottom surface 234 of the first portion 216, and which is in turn supported by a column 236 of the pedestal assembly 202. In the illustrated example, the column 236 comprises a pneumatic height adjustment cylinder. The second portion 218 of the rear shell member 212 includes a lower portion 238, an upper portion 240 and an arcuately-shaped, forwardly convex mid-portion 242 located therebetween.

The front shell member 214 includes a horizontally-extending bottom or first portion 244, a vertically-extending upper or second portion 246 extending upwardly from the first portion 244, and an arcuately-shaped transition portion 248 extending between the first portion 244 and the second portion 246. The first portion 244 includes a forward portion 250 and a rearward portion 252, while the second portion 246 includes a lower portion 254, an upper portion 256 and an arcuately-shaped, forwardly convex mid-portion 258 located therebetween and configured to support the lumbar region of a user's back. The upper portion 256 of the second portion 246 of the front shell member 214 is connected to the upper portion 240 of the second portion 218 of the rear shell member 212 at a location 260, such as by sonic welding, an adhesive, integral molding, mechanical fasteners, and the like. The second shell member 212 and the first shell member 214 are configured so as to define a gap 262 between at least a portion of the upper portion 256 and the upper portion 240, between the mid-portion 258 and the mid-portion 242, between the lower portion 254 and the lower portion 238, between the transition portion 248 and the transition portion 230, and between the second portion 246 and the second portion 218.

The chair assembly 200 further includes a pair of laterally-extending, flexibly resilient support members, including a forward support member 262 and a rearward support member 264, each extending between the second portion 246 of the first shell member 214 and the second portion 218 of the second shell member 212. In the illustrated example, the forward support member 262 and the rearward support member 264 are integrally formed within a single spring member 266, however, the forward support member 262 and the rearward support member 264 may be formed as separate pieces, or as integral portions of the second shell member 212 and/or the first shell member 214. In the present example, the spring member 266 comprises a single sheet of metal material shaped to include the forward support member 262, the rearward support member 264, a support portion 268 attached to an underside or bottom surface 270 of the second portion 246 of the first shell member 214, and a pair of connection portions 272 extending rearwardly from the associated forward support member 262 and rearward support member 264. The connection portions 272 are secured to a spring stop member 274 which is described below. Alternatively, the connection portions 272 of the spring member 266 may be attached directly to an upper surface 276 of the second portion 218 of the second shell member 212. In the illustrated example, the connection portion 272 associated with the rearward support member 264 is attached to an upper surface of the spring stop member 274, while the connection portion 272 of the forward support member 262 is attached to and spaced from the upper surface of the spring stop member 274 by a spacer member 278 that is in turn attached to the upper surface of the spring stop member 274.

In operation, a user can move or recline the second portion 218 of the second shell member 212 and the second portion 246 of the first shell member 214 from an upright position A to a reclined position B by flexing the second shell member 212 and the first shell member 214. Movement of the second portion 218 of the second shell member 212 and the second portion 246 of the first shell member 214 from the upright position A to the reclined position B causes the first portion 244 of the first shell member 214 to move from a first position C to a rearward and reclined position D. Specifically, the first portion 216 of the second shell member 212, the first portion 244 of the first shell member 214, the forward support member 262 and the rearward support member 264 cooperate to form a flexible or deformable four-bar linkage allowing movement of the second portion 246 of the first shell member 214 to the first position C to the reclined position D. In some embodiments, the forward support member 262 and the rearward support member 264 are each more flexible than the second portion 246 of the first shell member 214, and the second portion 246 of the first shell member 214 is more flexible than the second portion 218 of the second shell member 212. In other embodiments, the various thicknesses of the links or members comprising the deformable four-bar linkage may vary so as to provide specific support and bending characteristics as previously described. It is noted that the deformable four-bar linkage does not include specific pivot assemblies and the components typically associated therewith, thereby reducing the complexity of the overall system. The spring member 266 is configured to return the four-bar linkage to the original position once the external force is removed. In the illustrated example, the forward support member 262 and the rearward support member 264 are substantially the same length, however as noted above, the connection portion 272 of the forward support member 262 is spaced from the spring stop member 274 or the upper surface 276 of the second portion 218 of the second shell member 212 by the spacer member 278, thereby effectively changing the moment arm length of the forward support member 262. As a result, the forward portion 250 of the second portion 246 of the first shell member 214 rises at a greater rate than the rearward portion 258 of the second portion 246 as the second portion 246 of the first shell member 214 is moved from the first position C to the reclined position D.

The spring stop member 274 includes a body portion 280 attached to the upper surface 276 of the second portion 218 of the second shell member 212, a forward stop portion 282 extending angularly forward and upward from the body portion 280, and a rearward stop portion 284 extending angularly rearward and upward from the body portion 280. The forward stop portion 282 is configured such that the forward support member 262 contacts the forward stop portion 282 thereby limiting the forward movement of the forward support member 262. In the illustrated example, the forward stop portion 282 is substantially flexible, thereby providing a spring effect or cushioning to the forward movement of the forward support member 262. However, the forward stop portion 282 may also comprise a substantially rigid material. The rearward stop portion 284 includes an arcuately-shaped upper end 286, and a mid-portion 288 that includes a vertically-extending slot 290. In operation, the upper end 286 is configured to abut the transition portion 248 of the first shell member 214, thereby limiting the rearward travel of the transition portion 248 with respect to the transition portion 230. In the illustrated example, the upper end 286 and the mid-portion 288 of the spring stop member 274 are flexibly resilient, so as to provide a softstop or cushioning to the rearward motion of the transition portion 248 to the transition portion 230.

A spacer 292 is positioned between the transition portion 230 of the second shell member 212 and the transition portion 248 of the first shell member 214. In the illustrated example, the spacer 292 includes an arcuately-shaped body portion 294 having a rearwardly-facing arcuately-shaped abutment surface 296, wherein the abutment surface 296 is complementary to the shape of the transition portion 230 of the second shell member 212. The spacer 292 further includes an arm portion 298 and a forward abutment portion 300 located at a distal end of the arm portion 298. The forward abutment portion 300 includes a forwardly-facing arcuately-shaped forward abutment surface 302 that abuts and is complementary to the shape of the transition portion 248 of the first shell member 214. The forward abutment portion 300 is secured to the transition portion 248 of the first shell member 214 by a plurality of mechanical fasteners such as bolts 304. In operation, the abutment surface 296 is spaced from the transition portion 230 of the second shell member 212 when the second shell member 212 and the first shell member 214 are in the upright position A. The abutment surface 296 moves rearwardly toward the transition portion 230 of the second shell member 212 as the second shell member 212 and the first shell member 214 are moved from the upright position A toward the reclined position B, until the abutment surface 296 abuts the transition portion 230, thereby reducing the total amount of flexure possible of the second shell member 212 and the first shell member 214 and maintaining a structural shape to the transition portion 230 and the transition portion 248. The spacer 292 further includes a stop member 306 extending upwardly from a forward end of the body portion 294 and received within the slot 290 of the mid-portion 288 of the spring stop member 274. The stop member 306 abuts an upper end of the slot 290, thereby providing a limit to the rearward recline of the second shell member 212 and the first shell member 214.

Figure 12:
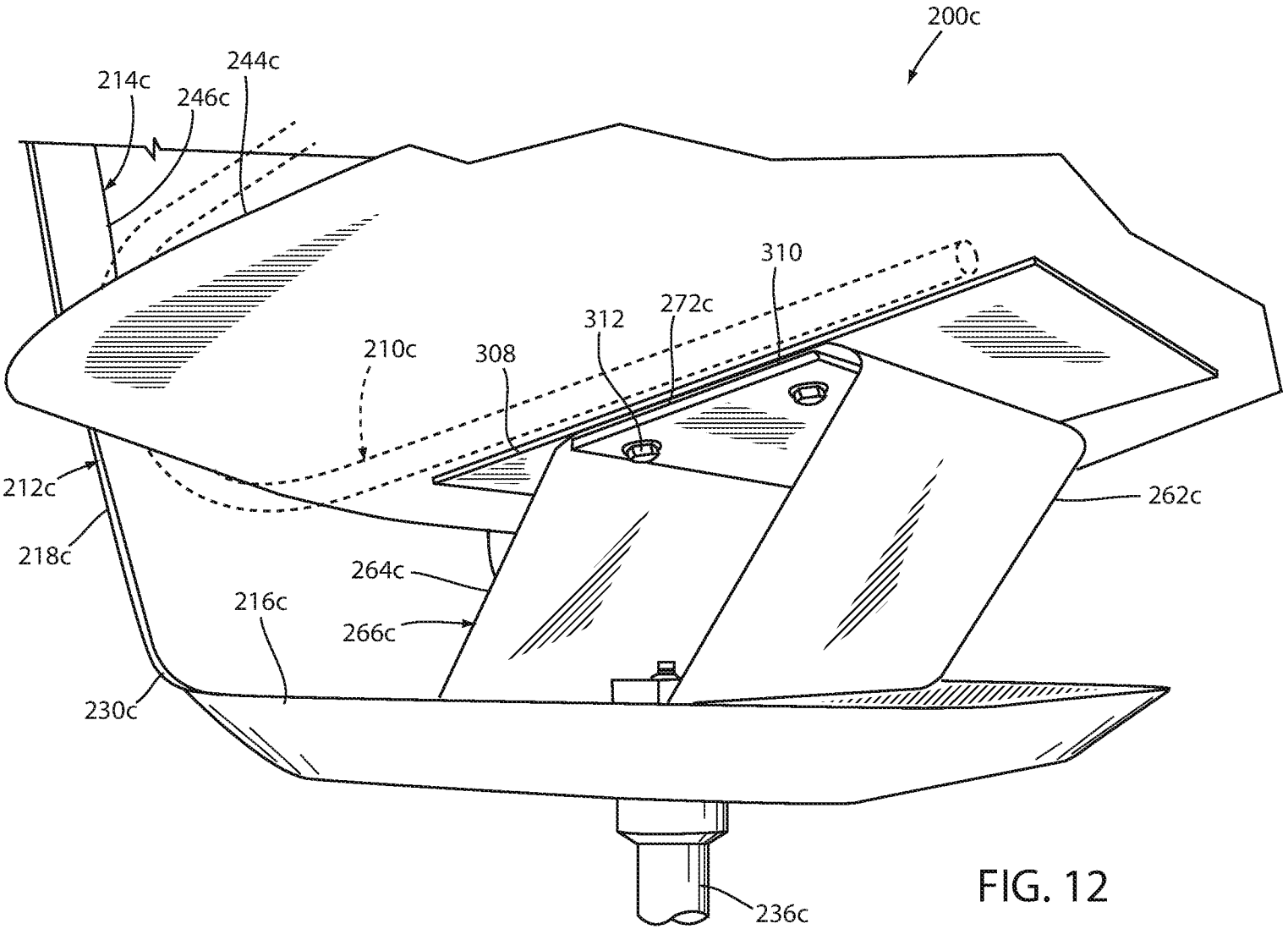
FIG. 12 is a bottom perspective view of yet another embodiment of the seating arrangement.

Alternatively, a chair assembly 200*c* (FIG. 12) may be provided with a pair of reinforcement plates that structurally support and secure the connection portion 272*c* of the spring member 266*c* to the second portion 246*c* of the first shell member 214*a*. Since the chair assembly 200*c* is similar to the previously described chair assembly 200, similar parts appearing in FIGS. 9-11 and in FIG. 12 respectively are represented by the same, corresponding reference numeral, except for the suffix "c" in the numerals of the latter. As illustrated, the chair assembly 200*c* includes an upper reinforcement or support plate 308 positioned above the connection portion 272*c* of the spring member 266*c*, and a lower or second support plate 310 positioned below the connection portion 272*c* of the spring stop member 274*c*, thereby sandwiching the connection portion 272*c* therebetween. The plates 308, 310 and the second portion 272*c* of the spring member 266*c* are coupled to the first portion 244*c* of the second shell member 214*a* by a plurality of mechanical fasteners such as bolts 312. The plate 308 may also be configured to support the arm assemblies 210*c*.

Figure 13:
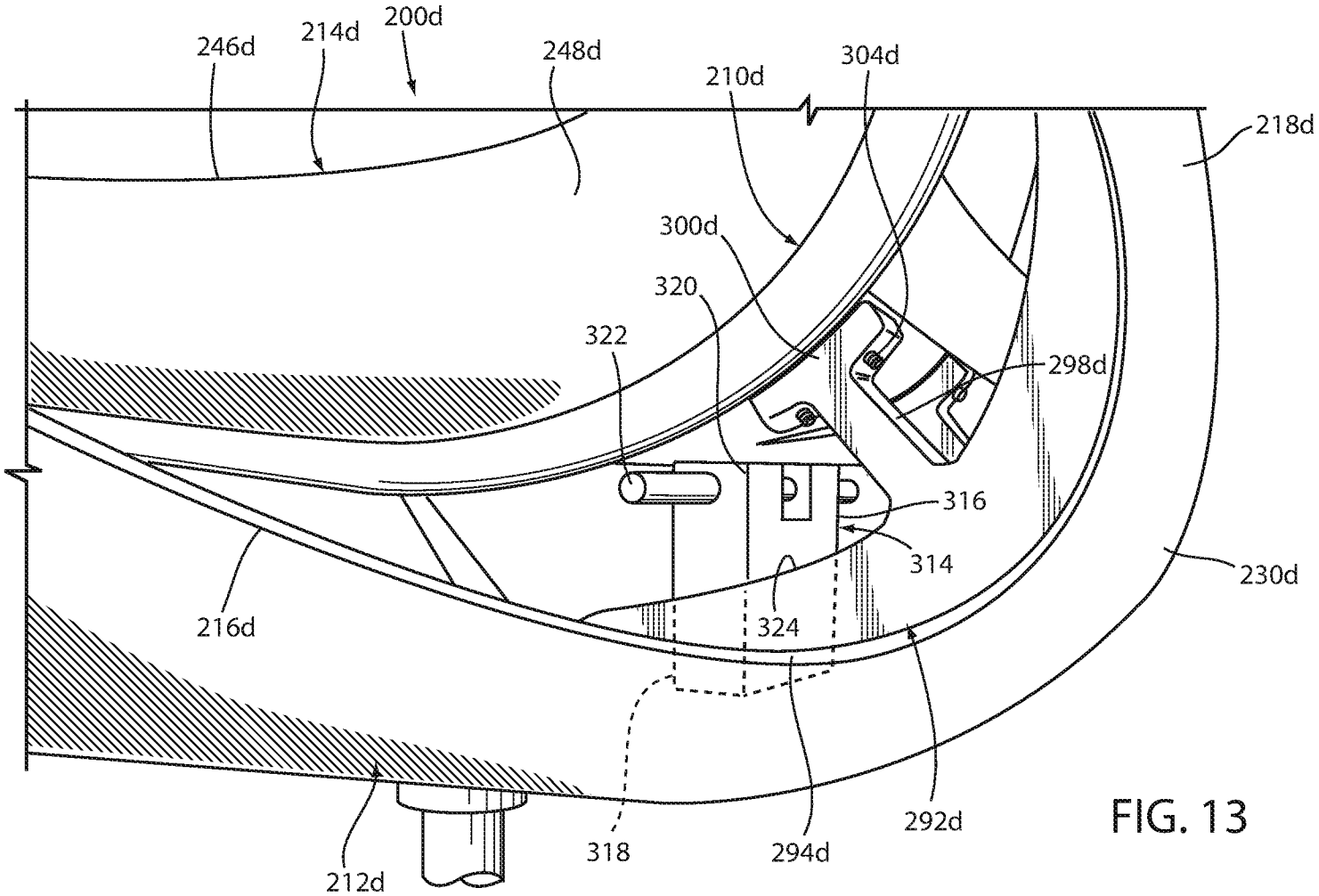
FIG. 13 is a bottom perspective view of still yet another embodiment of the seating arrangement, wherein the seating arrangement is in an upright position.
Figure 14:
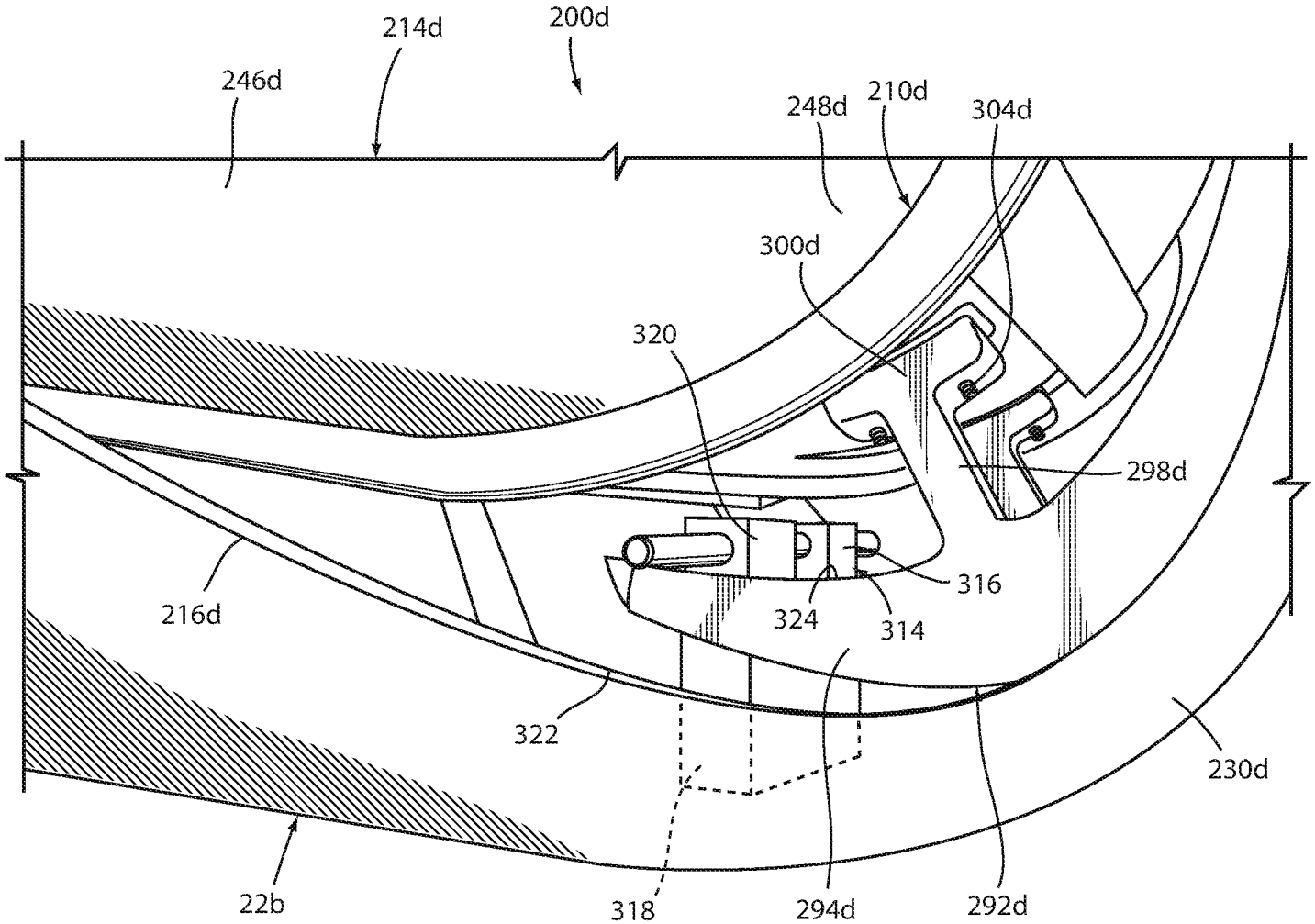
FIG. 14 is a bottom perspective view of the embodiment of the seating arrangement of FIG. 13, wherein the seating arrangement is in a reclined position.

Another alternative embodiment is illustrated in FIG. 13, wherein the chair assembly 200*d* includes an upright stop member 314. Since the chair assembly 200*d* is similar to the previously described chair assembly 200, similar parts appearing in FIGS. 9-11 and FIG. 13 are respectively represented by the same, corresponding reference numeral, except for the suffix "d" in the numerals of the latter. The upright stop member 314 includes a substantially rectangular block-shaped body portion 316 having a proximal end 318 secured to the first portion 216*d* of the second shell member 212*d*, and a distal portion 320. The upright stop member 314 further includes a pair of stop members such as pins 322 extending laterally outward from the distal portion 320. As best illustrated in FIG. 13, the body portion 294*d* of each of the spacers 292*d* are spaced from the associated pins 322 when the second shell member 212*d* and the first shell member 214*d* are in the upright position. As best illustrated in FIG. 14, the spacers 292*d* rotate rearwardly with the transition portion 248*d* of the first shell member 214*d* until an upper surface 324 of the body portion 294*d* of each of the spacers 292*d* contact or abut the pins 320, thereby preventing the second shell member 212*d* and the first shell member 214*d* from further reclining.

Figure 15:
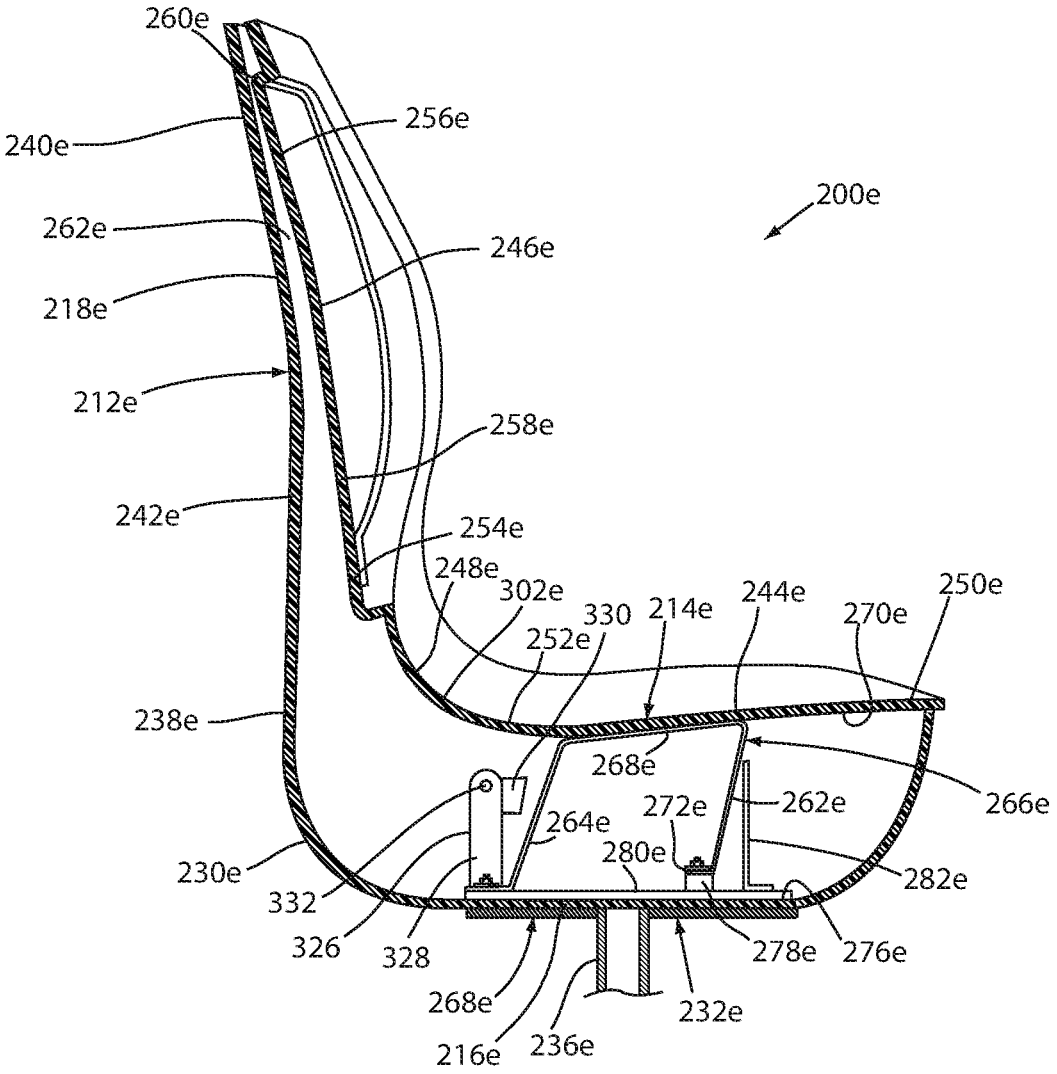
FIG. 15 is a cross-sectional view of another embodiment of a seating arrangement.

In another alternative embodiment, a chair assembly 200*e* (FIG. 15) includes an alternative stop arrangement 326. In the illustrated example, the chair assembly 200*e* is similar to the chair assembly 200, with the most notable exception being an alteration to the rearward stop arrangement. Since the chair assembly 200*e* is similar to the chair arrangements 200, 200*c*, similar elements appearing in FIGS. 1-4 and FIG. 7 are represented by the same corresponding reference numeral, except for the suffix "e" in the numerals of the latter. The stop arrangement 326 includes a mounting member 328 fixedly secured to the first portion 216*e* and a stop member 330 secured to a distal end 332 of the mounting member 328. In operation, the rearward support member 264*e* abuts the stop member 330, thereby limiting rearward "recline" of the chair back.

Figure 16:
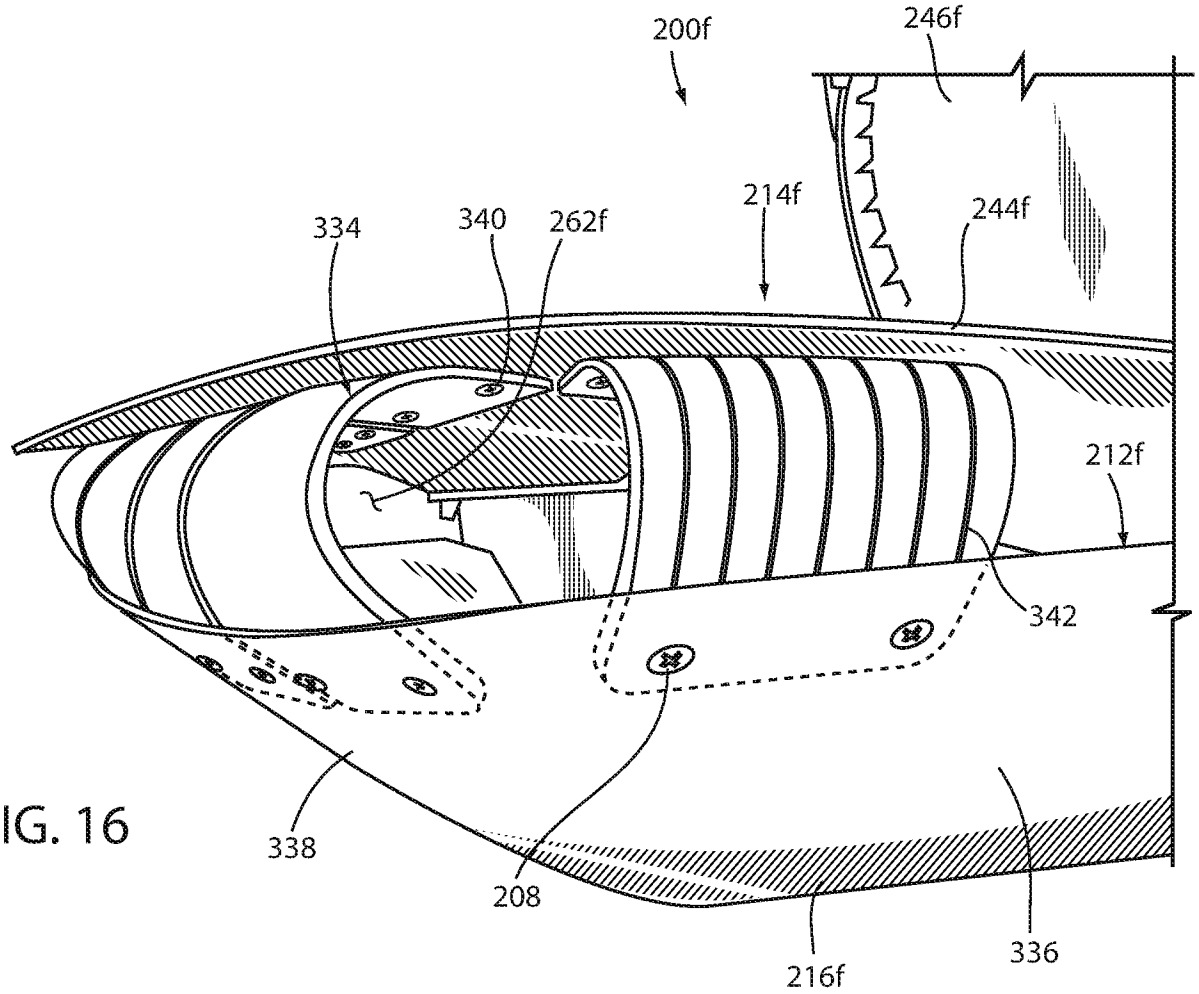
FIG. 16 is a perspective view of yet another embodiment of a seating arrangement including a plurality of edge members.
Figure 17:
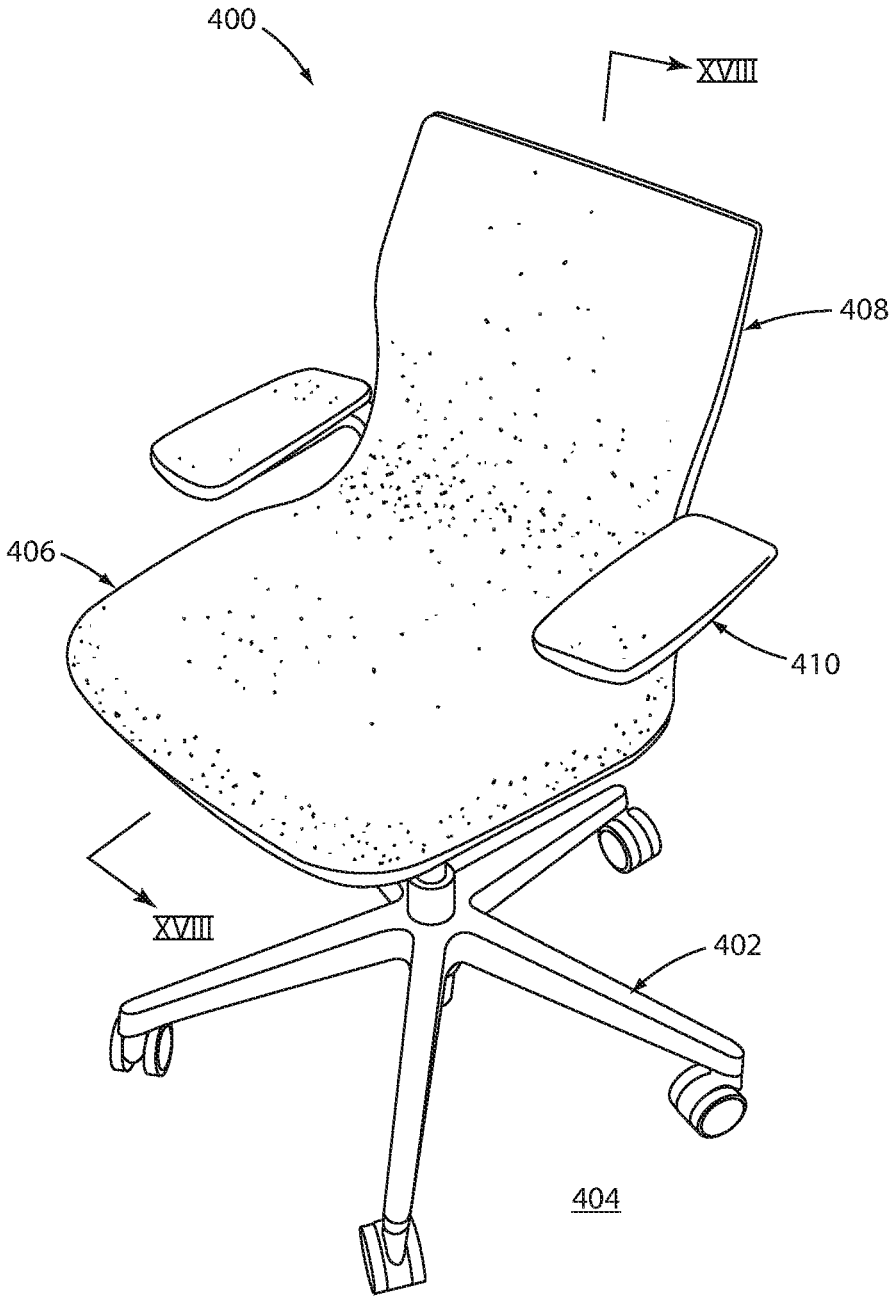
FIG. 17 is a perspective view of another embodiment of a seating arrangement.

In still another alternative embodiment, a chair assembly 200*f* (FIG. 16) includes a plurality of flexibly resilient edge members 334. Since the chair assembly 200*f* is similar to the previously described chair assembly 200, similar parts appearing in FIGS. 9-11 and FIG. 16, respectively are represented by the same, corresponding reference numeral, except for the suffix "f" in the numerals of the latter. In the illustrated example, the bottom or first portion 216*f* of the second shell member 212*f* provides a trough-like shape and includes sidewalls 336 and a front wall 338. The plurality of edge members 334 extend between the sidewalls 336 and/or the front wall 338 and the first portion 244*f* of the first shell member 214*f*. Each edge member 334 comprises a flexibly resilient polymer material and is positioned so as to contact an inside surface of the sidewalls 336 and/or the front wall 338 and the bottom surface of the second portion 244*f* of the second shell member 214*f*, and are secured thereto by a plurality of mechanical fasteners such as screws 340. In some embodiments, edge members 334 may be formed integrally with second shell member 212*f* and/or first shell member 214*f*. The edge members 334 may or may not be provided with a plurality of longitudinally-extending slots 342, which may alter the performance of the members. For example, increasing the number and/or size of the slots 342 may increase the flexibility of the members 334. The edge members 334 may additionally provide a surface between the second shell member 212*f* and the first shell member 214*f* to support an associated cover member (not shown), as well as to prevent access to the gap 262*f* between the second shell member 212*f* and the first shell member 214*f*.

The reference numeral 400 (FIG. 17) generally designates another embodiment of a seating arrangement. In the illustrated example, the seating arrangement 400 includes a cantered base assembly 402 abutting a floor surface 404, a seat assembly 406 and a back assembly 408 supported above the base assembly 402, and a pair of arm assemblies 410.

The chair assembly 10 includes a rear or second shell member 422 (FIGS. 18 and 19) and a front or first shell member 424. The shell members 422, 424 may be formed as a single integral piece or comprise multiple, individual components. In the illustrated example, the shell members 422, 424 each comprise one or more flexibly resilient polymer materials such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 422, 424 to conform and move in response to forces exerted by a user. Although a polymer material is preferred, other suitable materials may also be utilized, such as metals, including, for example, steel or titanium; plywood; or a composite material including plastics, resin-based composites, metals and/or plywood. A variety of other suitable energy-storing materials may also be utilized.

The rear shell member 422 includes a horizontally-extending bottom or first portion 426, a vertically-extending upper or second portion 428 extending upwardly from the first portion 426, and a transition portion 429 extending between the first portion 426 and the second portion 428. In the illustrated example, the first portion 426 is supported by a support plate 430 that abuts a bottom surface 432 of the first portion 426, and which is in turn supported by a column 434 of the pedestal assembly 402. The second portion 428 of the rear shell member 422 includes a lower portion 436, an upper portion 438 and a mid-portion 440 located therebetween. The upper portion 438 of the rear shell member 422 is separated from the mid-portion 440 by a gap 442, thereby allowing the upper portion 438 to move independently from the mid-portion 440, as described below.

The front shell member 424 includes a first portion or seat shell member 444 and a second portion or back support member 446. The seat shell member 444 includes a forward portion 448, a rearward portion 450, an upper surface 452 configured to support a seated user, and a lower surface 454 opposite the upper surface 452. The back support member 446 includes a lower portion 456, an upper portion 458 and a mid-portion 460 located therebetween. The mid-portion 440 of the rear shell member 422 and the mid-portion 460 of the back support member 446 are coupled together by a laterally-extending rib 462 that extends forwardly from a forward surface 464 of the rear shell member 422 and rearwardly from a rearward surface 466 of the back support member 446. The rearward portion 450 of the seat shell member 444 is coupled to the second portion 428 of the rear shell member 422 by a link member 468. In the illustrated example, the link member 468 is integrally formed with both the rear shell member 422 and the seat shell member 444, however, each of these components may be formed as individual, single pieces. A lower end of the lower portion 456 of the back support member 446 extends through an aperture or slot 470 formed within the link member 468 and couples to an underside 472 of the link member 468 after passing through the aperture 470.

The seating arrangement 400 further includes a pair of laterally-extending, flexibly resilient support members including a forward support member 474 and a rearward support member 476 each extending between the seat shell member 444 and the second portion of the rear shell member 422. In the illustrated example, the support members 474, 476 are integrally formed with the seat shell member 444 and the rear shell member 422, and extend from the lower surface 454 of the seat shell member 444 to an upper surface 478 of the first portion 426 of the rear shell member 422, however each of these components may comprise individual pieces. The first portion 426 of the rear shell member 422, the seat shell member 444 and the pair of support members 474, 476 cooperate to define a deformable four-bar linkage allowing movement of the seating arrangement 400 as described below. In the illustrated example, the front support member 474 is slightly longer than the rear support member 476, the relevance of which is also described below.

In operation, a user can move or recline the second portion 428 of the rear shell member 422 from an upright position A to a reclined position B by flexing the rear shell member 422 and the front shell member 424. Movement of the second portion 428 of the rear shell member 422 from the upright position A to the reclined position B causes the seat shell member 444 to move from a first position C to a rearward and reclined position D. Specifically, the link member 468 draws the seat shell member 444 rearwardly with the second portion 428 of the rear shell member 422 as the second portion 428 of the rear shell member 422 is moved from the upright position A to the reclined position B. As noted above, the front support member 474 is slightly longer than the rear support member 476, thereby causing the forward portion 448 of the seat shell member 444 to vertically raise at a rate slightly faster than the rearward portion 450 of the seat shell member 440 as the seat shell member 444 is moved from the first position C to the reclined position D. It is also noted that the upper portion 438 of the rear shell member 422 and the upper portion 458 of the back support member 446 tend to recline about a pivot point located forwardly of the gap 442 at a slightly greater rate than the rate of recline of the mid-portion 440 of the rear shell member 422 and the mid-portion 460 of the back support member 446 as the rear shell member 422 and the back support member 446 are moved between the upright position A and the reclined position B.

Figure 18:
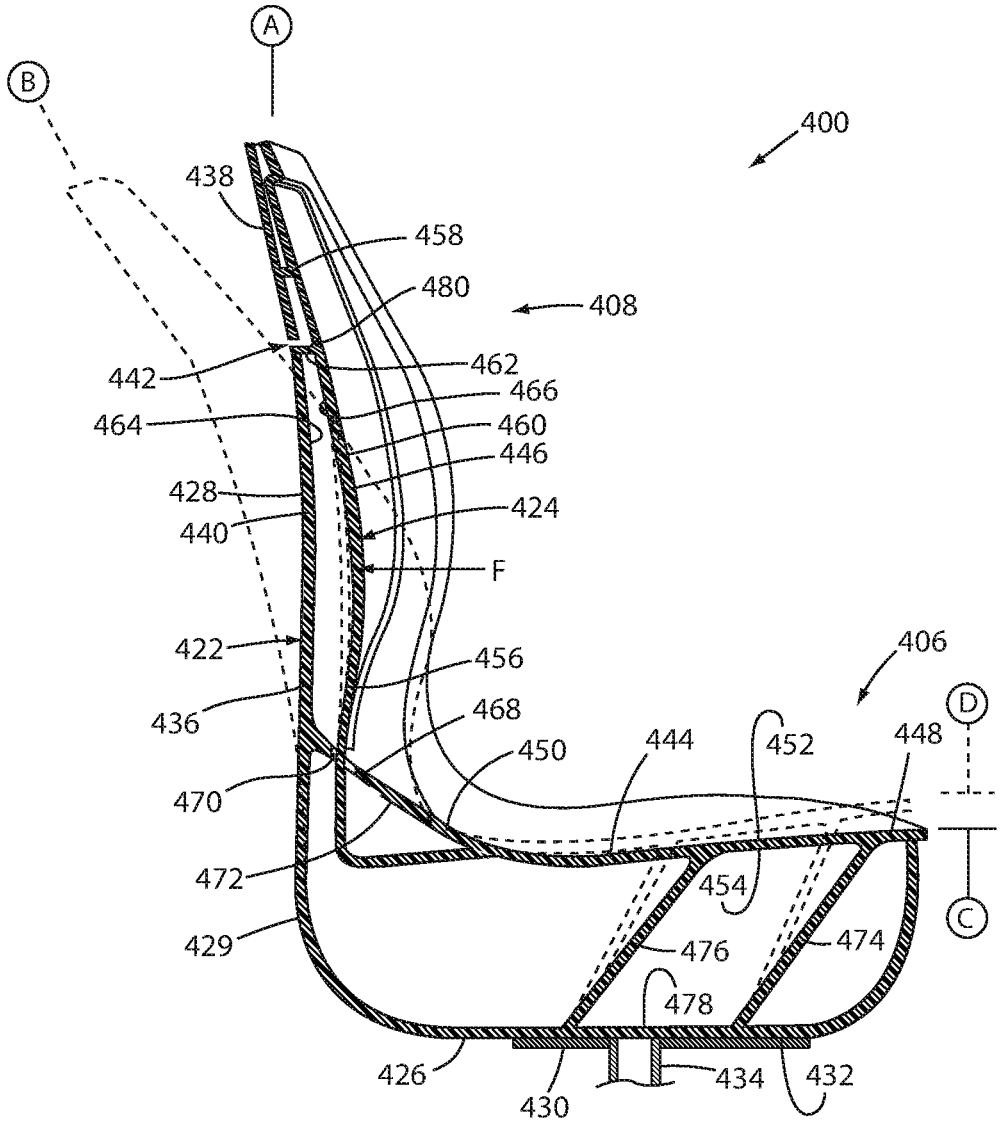
FIG. 18 is a cross-sectional view of the embodiment of the seating arrangement shown in FIG. 17 taken along the line XVIII-XVIII, FIG. 17.
Figure 19:
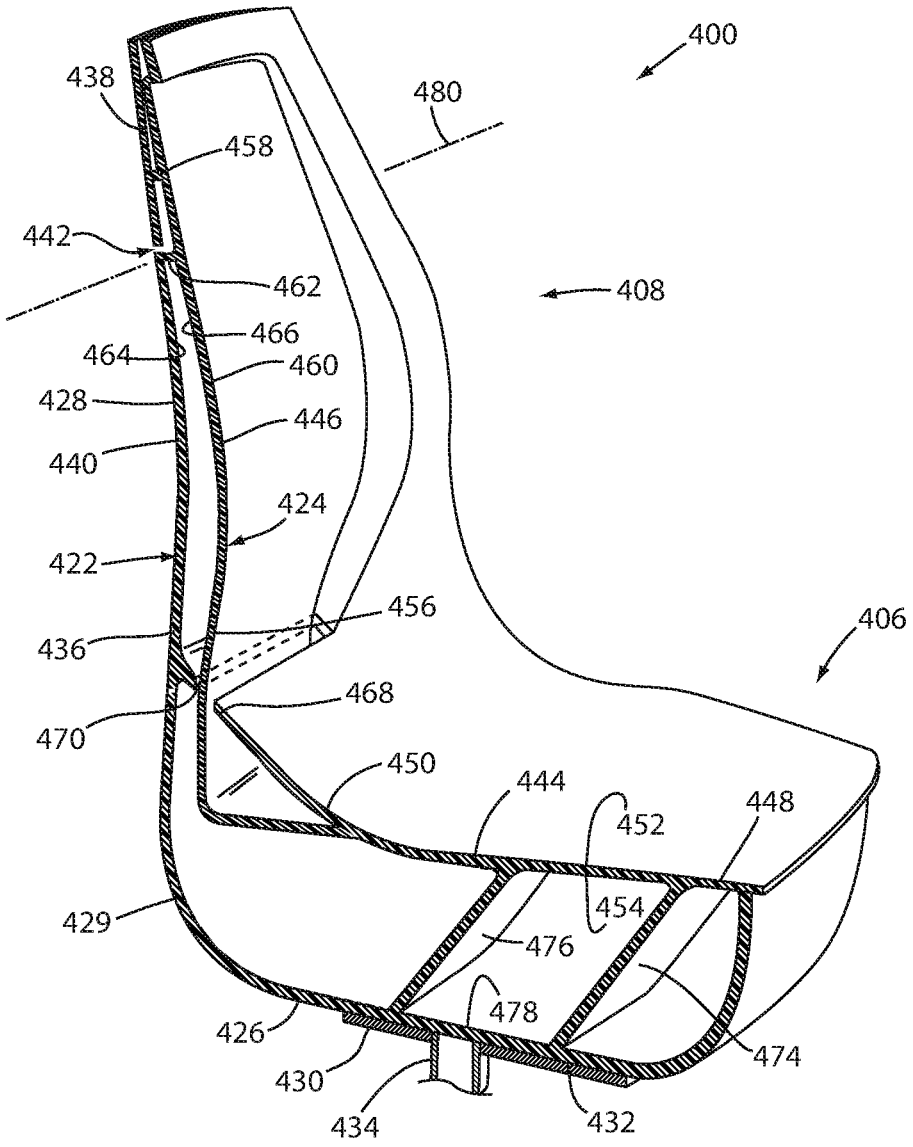
FIG. 19 is a cross-sectional perspective view of the embodiment of the chair assembly shown in FIG. 17 taken along the line XVIII-XVIII, FIG. 17.

As best illustrated in FIG. 18, the mid-portion 460 of the back support member 446 may be compressed or moved separately from movement of the seat shell member 444. As noted above, a lowermost end of the lower portion 456 of the back support member 446 extends through the aperture or slot 470 of the link member 468. This configuration effectively decouples certain movements of the back support member 446 from movements of the seat shell member 444. For example, a force F may be exerted to the mid-portion 460 of the back support member 446 thereby flexing the back support member 446 rearwardly. In this instance, the position of the seat shell member 444 remains relatively constant as the back support member 446 is allowed to move within the aperture or slot 470.

Figure 20:
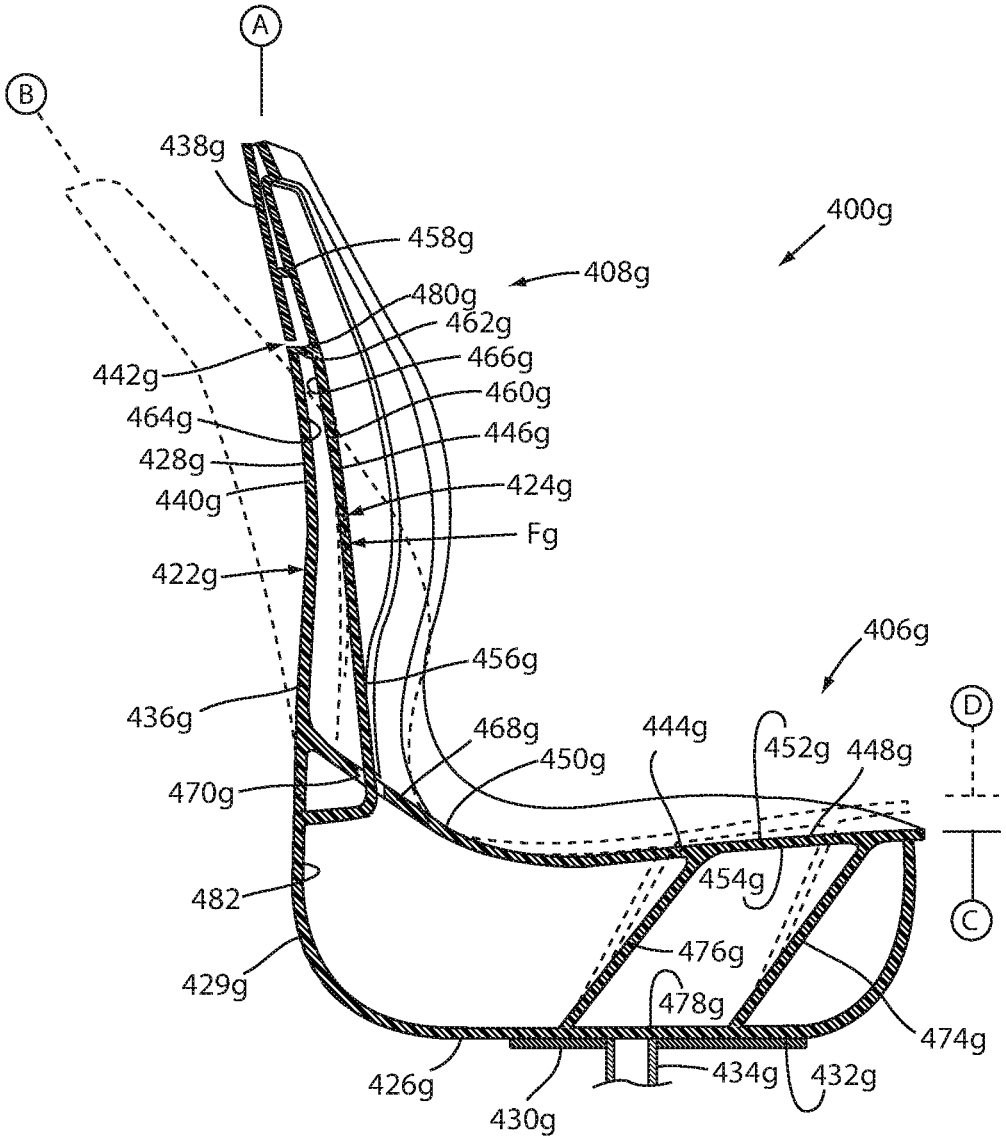
FIG. 20 is a cross-sectional side elevational view of yet another embodiment of the chair assembly.
Figure 21:
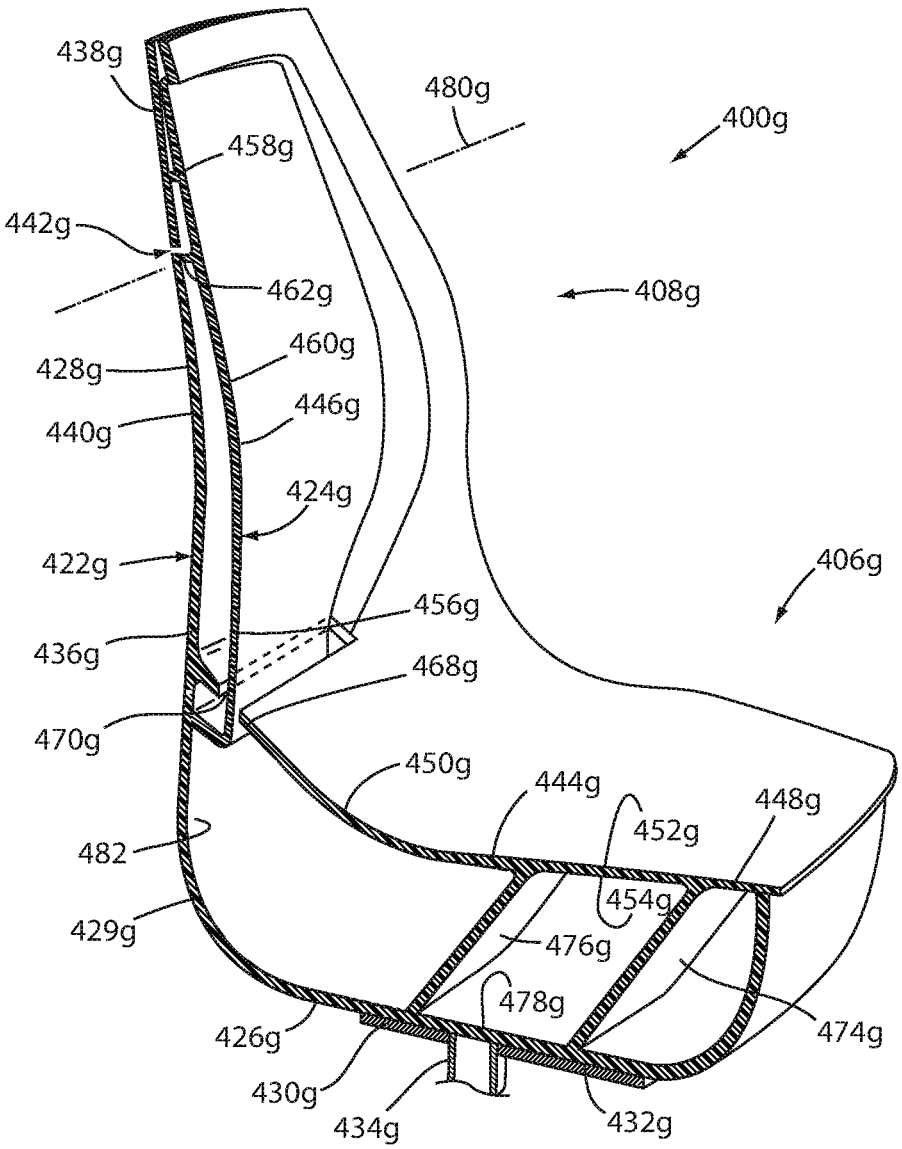
FIG. 21 is a cross-sectional perspective view of the embodiment of the chair assembly shown in FIG. 20.
Figure 22:
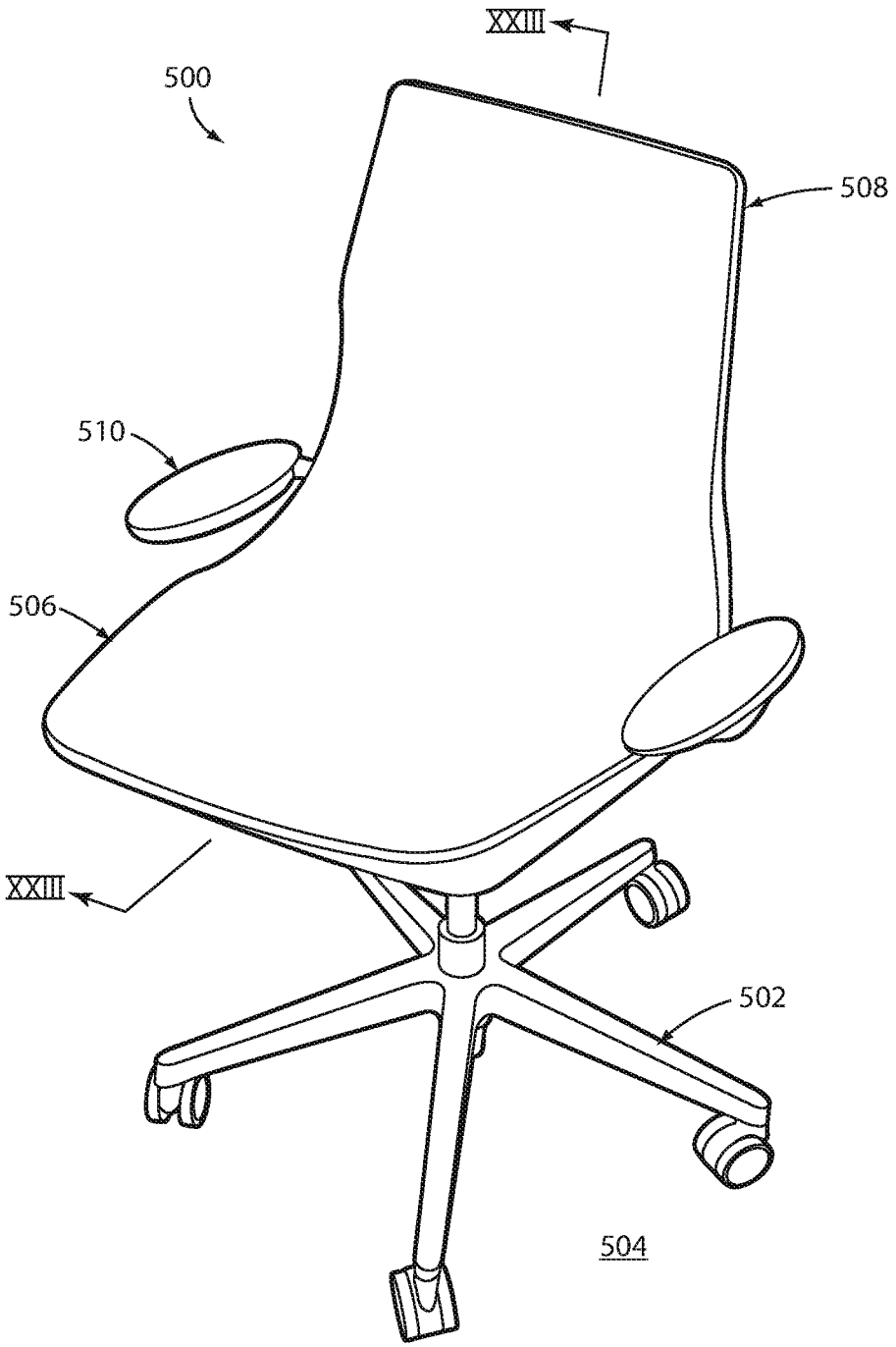
FIG. 22 is a perspective view of another embodiment of a seating arrangement.

In yet another embodiment, a seating arrangement 400*g* (FIGS. 20 and 21) includes a lowermost end of the lower portion 456*g* of the back support member 446*g* extending through the slot 470*g* of the link member 468*g* and attached to a forward surface 482 of the rear shell member 422*g*. Similar to the embodiment as described above, this arrangement effectively decouples movement or compression of the mid-portion 460*g* of the back support member 446*g* from movement of the seat shell member 444*g*, such that the back support member 446*g* can be compressed without moving the seat shell member 444*g*.

Figure 23:
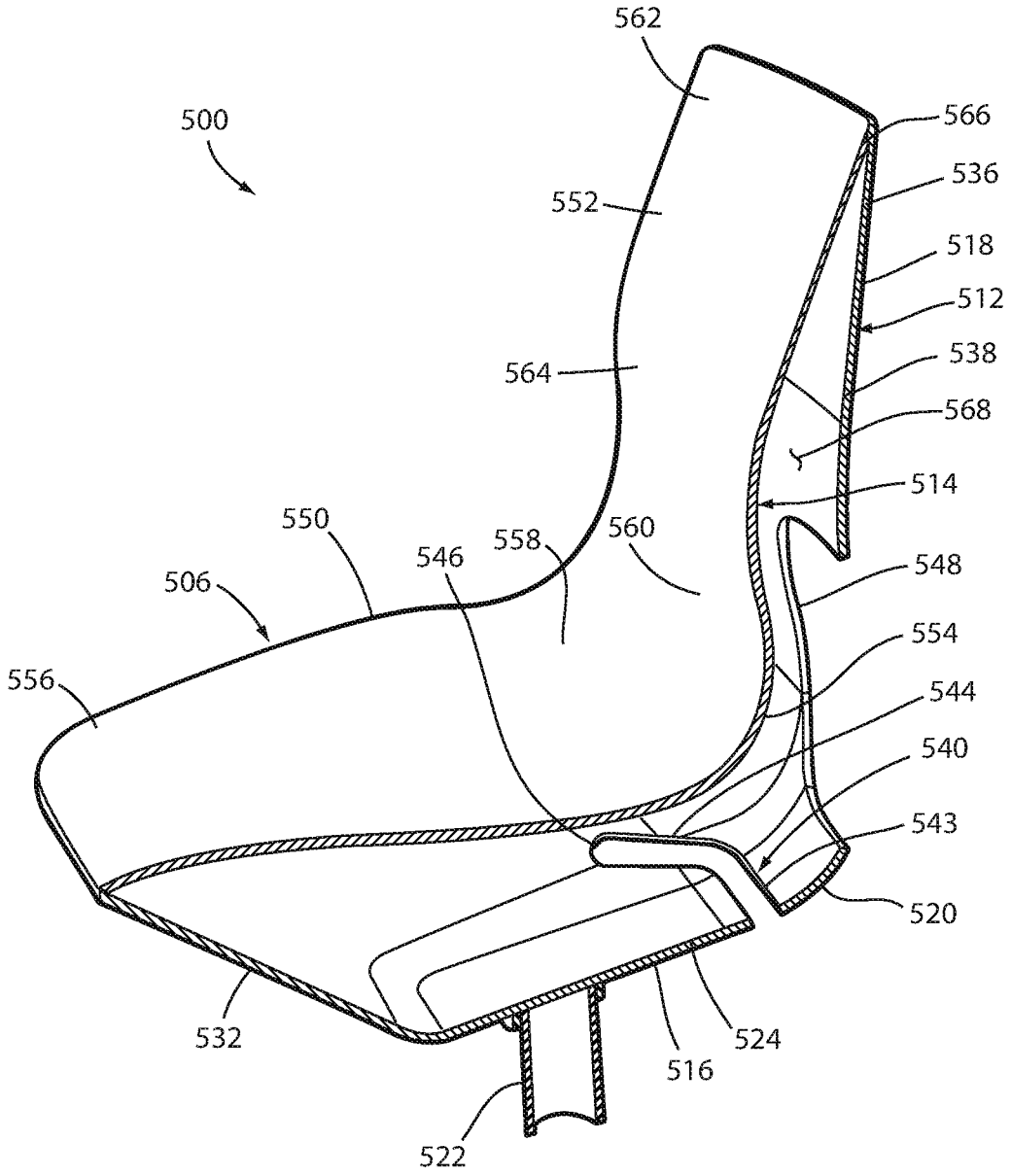
FIG. 23 is a cross-sectional front perspective view of the embodiment of the seating arrangement shown in FIG. 22 taken along the line XXIII-XXIII, FIG. 22.
Figure 24:
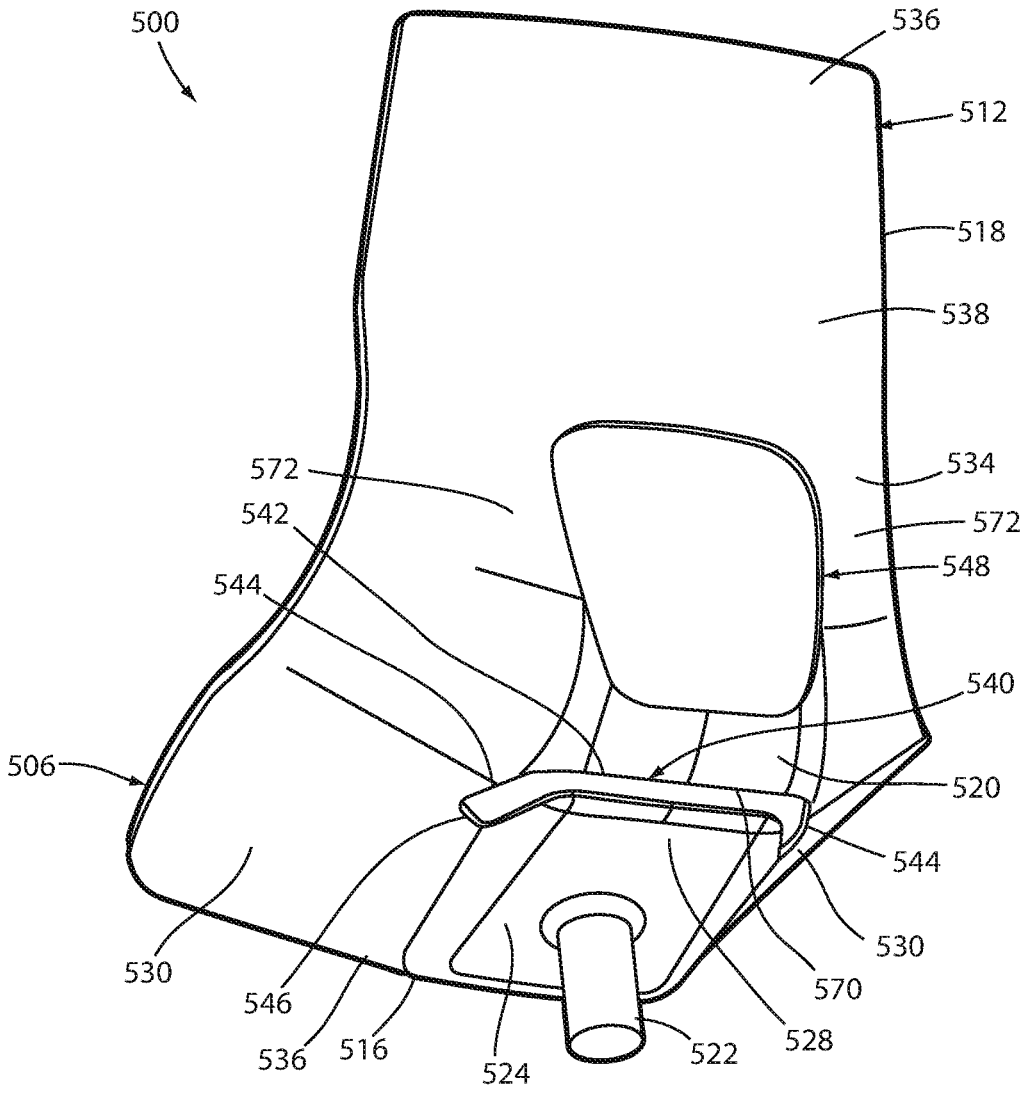
FIG. 24 is a rear perspective view of the embodiment of the seating arrangement shown in FIG. 22.

The reference numeral 500 (FIG. 22) generally designates another embodiment of a seating arrangement. In the illustrated example, the seating arrangement or chair assembly 500 includes a cantered base assembly 502 abutting a floor surface 504, a seat arrangement 506 and a back arrangement 508 each supported above the base assembly 502, and a pair of arm assemblies 510. In the illustrated example, the chair assembly 500 (FIG. 23) includes a rear or second shell member 512 and a front or first shell member 514. The shell members 512, 514 may be formed as a single, integral piece or comprise multiple, individual components. The shell members 512, 514 each comprise one or more flexibly resilient polymer materials such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 512, 514 to conform and move in response to forces exerted by a user. Although a polymer material may be preferred, other suitable materials may also be utilized, such as metals, including, for example, steel or titanium; plywood; ora composite material including plastics, resin-based composites, metals and/or plywood. A variety of other suitable energy-storing materials may also be utilized.

The second shell member 512 includes a horizontally-extending bottom or first portion 516, a vertically-extending upper or second portion 518 extending upwardly from the first portion 516, and an arcuately-shaped transition portion 520 extending between the first portion 516 and the second portion 518. In the illustrated example, the first portion 516 is supported by a column 522 of the pedestal assembly 502.

The first portion 516 of the second shell member 512 includes a bottom wall 524 having a forward portion 526 and a rearward portion 528, a pair of sidewalls 530 extending angularly upward and laterally from the bottom wall 524, and a front wall 532 extending angularly upward and forwardly from the bottom wall 524. The upper or second portion 518 of the second shell member 512 includes a lower portion 534, an upper portion 536 and a mid-portion 538 located therebetween.

The rear or second shell member 512 further includes a U-shaped aperture 540 that includes a laterally-extending base portion 542 and a pair of forwardly-extending arm portions 544. In the illustrated example, the base portion 542 of the aperture 540 is positioned proximate the rearward portion 528 of the bottom wall 524 of the first portion 516 and proximate the transition portion 540, while the arm portions 544 extend forwardly from the base portion 542 and are located proximate the bottom wall 524 and proximate the sidewalls 530. The arm portions 544 angle or flare outwardly from one another from the base portion 542 to a distal end 546 of each of the arm portions 544. The second shell member 512 further includes an aperture 548 that extends from the transition portion 520 into the lower portion 534 of the second portion 518.

The front shell member 514 includes a horizontally-extending bottom or first portion 550, a vertically-extending upper or second portion 552 extending upwardly from the first portion 550, and an arcuately-shaped transition portion 554 extending between the first portion 550 and the second portion 552. The first portion 550 includes a forward portion 556 and a rearward portion 558, while the second portion 552 includes a lower portion 560, an upper portion 562, and an arcuately-shaped, forwardly convex mid-portion 564 located therebetween and configured to support the lower area of a user's back. The upper portion 562 of the second portion 552 of the first shell member 514 is connected to the upper portion 536 of the second portion 518 of the second shell member 512 at a location 566, such as by sonic welding, an adhesive, integral molding, mechanical fasteners, and the like. The second shell member 512 and the first shell member 514 are configured so as to define a gap 568 between at least a portion of the upper portion 562 and the upper portion 536, between the mid-portion 564 and the mid-portion 538, between the lower portion 560 and the lower portion 534, between the transition portion 554 and the transition portion 520, and between the second portion 552 and the second portion 518.

Figure 25:
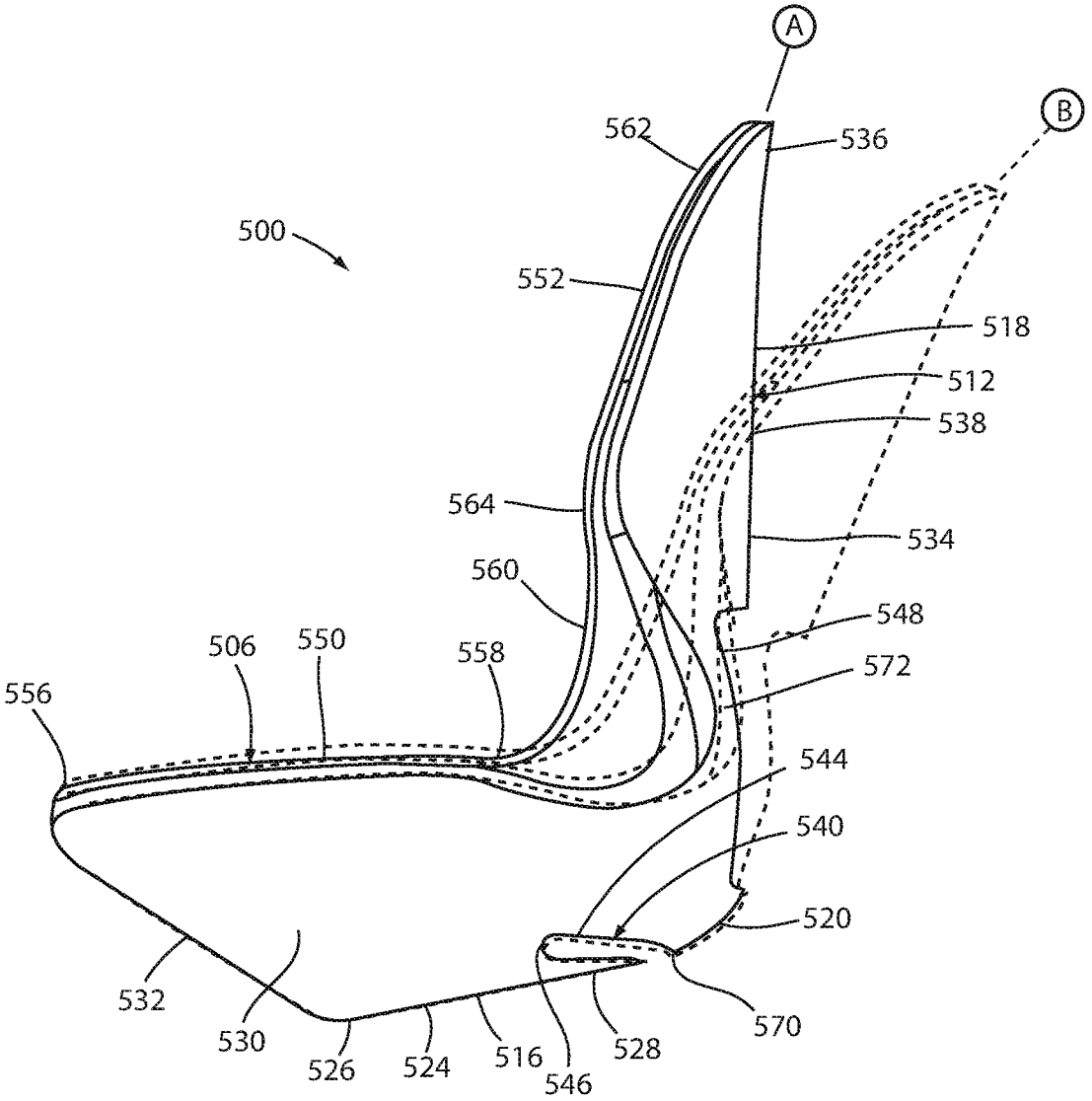
FIG. 25 is a side elevation view of the embodiment of the seating arrangement shown in FIG. 22 with a back arrangement in an upright position in solid line and in a reclined position in dashed line.

In operation, the second portion 518 (FIG. 25) of the second shell member 512 and the second portion 552 of the first shell member 214 are movable or reclinable from an upright position A to a reclined position B. The configuration of the U-shaped aperture 540 allows the first shell member 214 to deflect as the second shell member 212 is moved from the upright position A to the reclined position B. In the illustrated example, a portion 570 of the second shell member 512 located immediately rearwardly of the aperture adjacent to the base portion 542 of the aperture 540 travels downwardly as the second portion 518 of the second shell member 512 moves from the upright position A to the reclined position B. It is further noted that the location and configuration of the aperture 548 within the transition portion 520 and the second portion 518 of the second shell member 512 allows portions of the second shell member 512 located laterally outward of the aperture 548 to more easily flex as the second portion 218 of the second shell member 512 is moved from the upright position A to the reclined position B.

Figure 26:
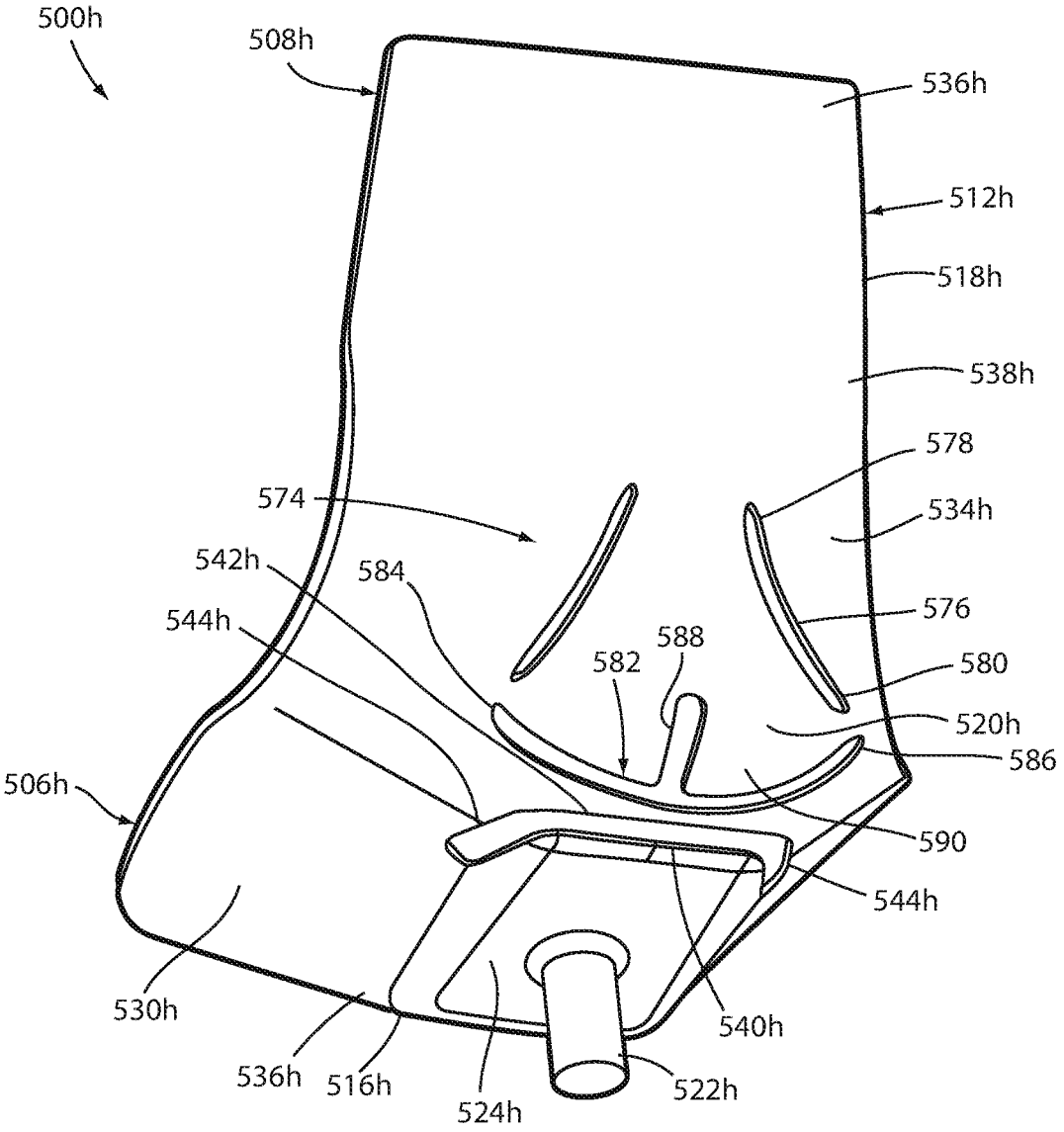
FIG. 26 is a rear perspective view of another embodiment of the seating arrangement.

The reference numeral **500*h* (FIG. 26) generally designates another embodiment of a seating arrangement. Since the chair assembly 500*h* is similar to the previously described chair assembly 500, similar parts appearing in FIGS. 22-25 and FIG. 26 respectively are represented by the same, corresponding reference numeral, except for the suffix "h" in the numerals of the latter. In the illustrated example, the chair assembly 500*h* is similar to the chair assembly 500 with the most notable exception being the replacement of the aperture 548 of the chair assembly 500 with a plurality of apertures 574. The plurality of apertures 574 includes a pair of arcuately-shaped apertures 576 that extend both vertically and laterally from a first end 578 located within the lower portion 534*h* of the second portion 518*h* of the second shell member 512*h*, and a second end 580 located within the transition portion 520*h* of the second shell member 512*h*. As illustrated, the apertures 574 sweep downwardly and outwardly from the first ends 578 to the second ends 580. An upwardly-concave, arcuately-shaped second aperture 582 extends laterally across the transition portion 520*h* and includes a first end 584 and a second end 586 respectively located proximate the second ends 580 of the corresponding apertures 576. The second aperture 582 also includes a center portion 588 extending vertically upward from the arcuate portion of the second aperture 582 and along a centroidal axis of the first shell member 212*h*. The plurality of apertures 574 cooperate to define a pair of downwardly-extending tabs 590. The plurality of apertures 574 serve to increase the flexibility of the lower portion 534*h* of the second portion 518*h* of the second shell member 514*h* and the transition portion 520*h* as the second shell member 512*h* is moved between an upright and reclined position, similar to the upright position A and the reclined position B illustrated in FIG. 25**.

Figure 27:
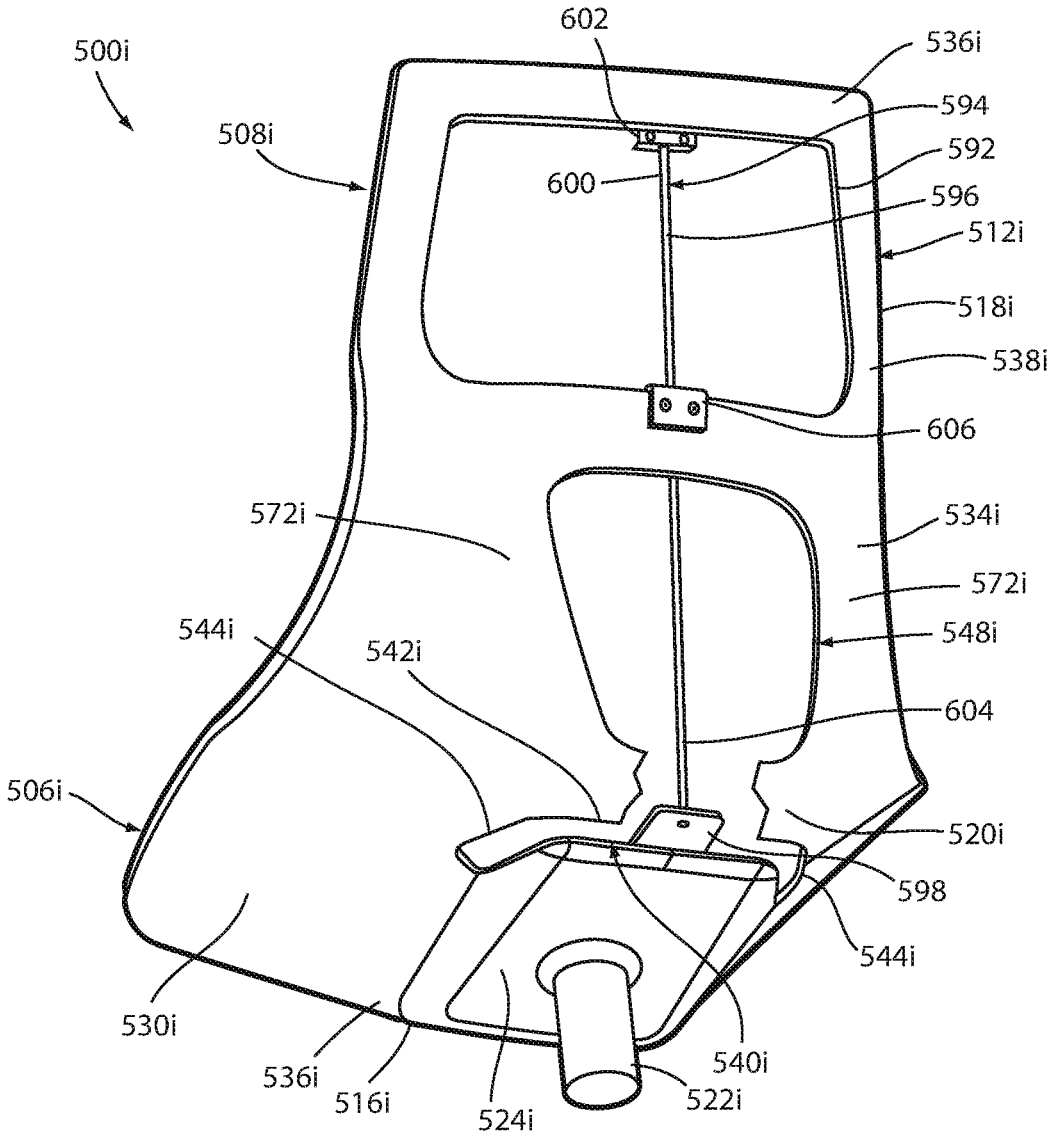
FIG. 27 is a rear perspective view of yet another embodiment of the seating arrangement.

The reference numeral **500*i* (FIG. 27) generally designates another embodiment of a seating arrangement 500. Since the chair assembly 500*i* is similar to the previously described chair assembly 500, similar parts appearing in FIGS. 22-24 and FIG. 27 respectively are represented by the same, corresponding reference numeral, except for the suffix "i" in the numerals of the latter. The chair assembly 500*i* is similar to the chair assembly 500 with the most notable exception being the inclusion of an upper aperture 592 and a structural reinforcement and biasing assembly 594. In the illustrated example, the upper aperture 592 extends across and comprises the majority of the upper portion 536***i* of the second portion 518*i* of the second shell member 512*i* and extends downwardly into the mid-portion 538*i* of the second portion 518*i* of the second shell member 512*i*. The structural reinforcement and biasing assembly 592 includes a flexibly resilient rod 596 extending vertically between the upper portion 536*i* and a mounting plate 598. In the illustrated example, an upper end 600 of the rod 596 is attached to the upper portion 536*i* of the second portion 518*i* of the second shell member 512*i* by a mechanical fastener 602, while a second end 604 of the rod 596 is attached to the mounting plate 598 positioned either above or below the bottom wall 524*i* of the first portion 516*i* of the second shell member 512*i*. The rod 596 may also be attached along the length thereof to the mid-portion 538*i* of the second portion 518*i* of the second shell member 512*i* by a mechanical fastener 606. In operation, the rod 596 serves to structurally reinforce the second portion 518*i* of the second shell member 512*i* as well as to bias the second portion 518*i* of the second shell member 512*i* from a reclined position to an upright position, similar to the reclined position B and upright position A illustrated in FIG. 25.

Figure 28:
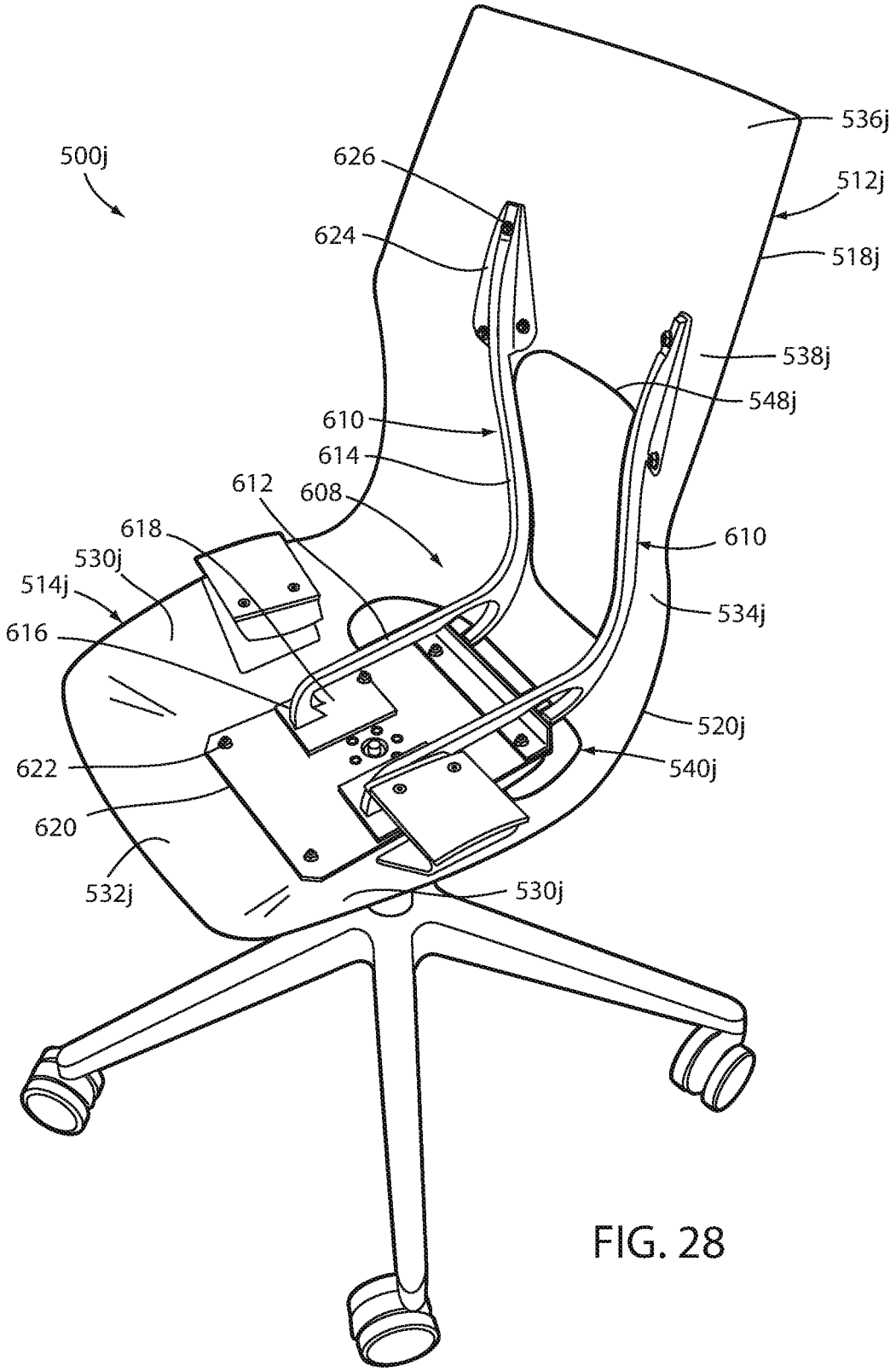
FIG. 28 is a front perspective view of still another embodiment of the seating arrangement.

The reference numeral 500*j* (FIG. 28) generally designates yet another embodiment of a seating arrangement 500. Since the chair assembly 500*j* is similar to the previously described chair assembly 500, similar parts appearing in FIGS. 22-24 and FIG. 28 respectively are represented by the same, corresponding reference numeral, except for the suffix "j" in the numerals of the latter. The chair assembly 500*j* is similar to the chair assembly 500 with the most notable exception being the inclusion of a structural reinforcement and biasing assembly 608. The structural reinforcement and biasing assembly 608 includes a pair of generally L-shaped, flexibly resilient biasing members 610 each having a generally horizontally-extending first portion 612 and generally vertically-extending second portion 614. Each first portion 612 includes a downwardly-turned distal end 616 welded to an attachment plate 618 that is secured to a support plate 620 that is in turn secured to the first portion 516*j* of the second shell member 512*j* by a plurality of mechanical fasteners such as bolts 622. A distal end 624 of the second portion 614 of each of the biasing members 610 is attached to the mid-portion 538*j* of the second portion 518*j* of the second shell member 512*j* by a plurality of mechanical fasteners such as bolts 626. In operation, the biasing members 610 serve to structurally reinforce the second portion 518*j* of the second shell member 512*j* as well as to bias the second portion 518*j* of the second shell member 512*j* from a reclined position and to an upright position, similar to the reclined position B and the upright position A illustrated in FIG. 25.

Figure 29:
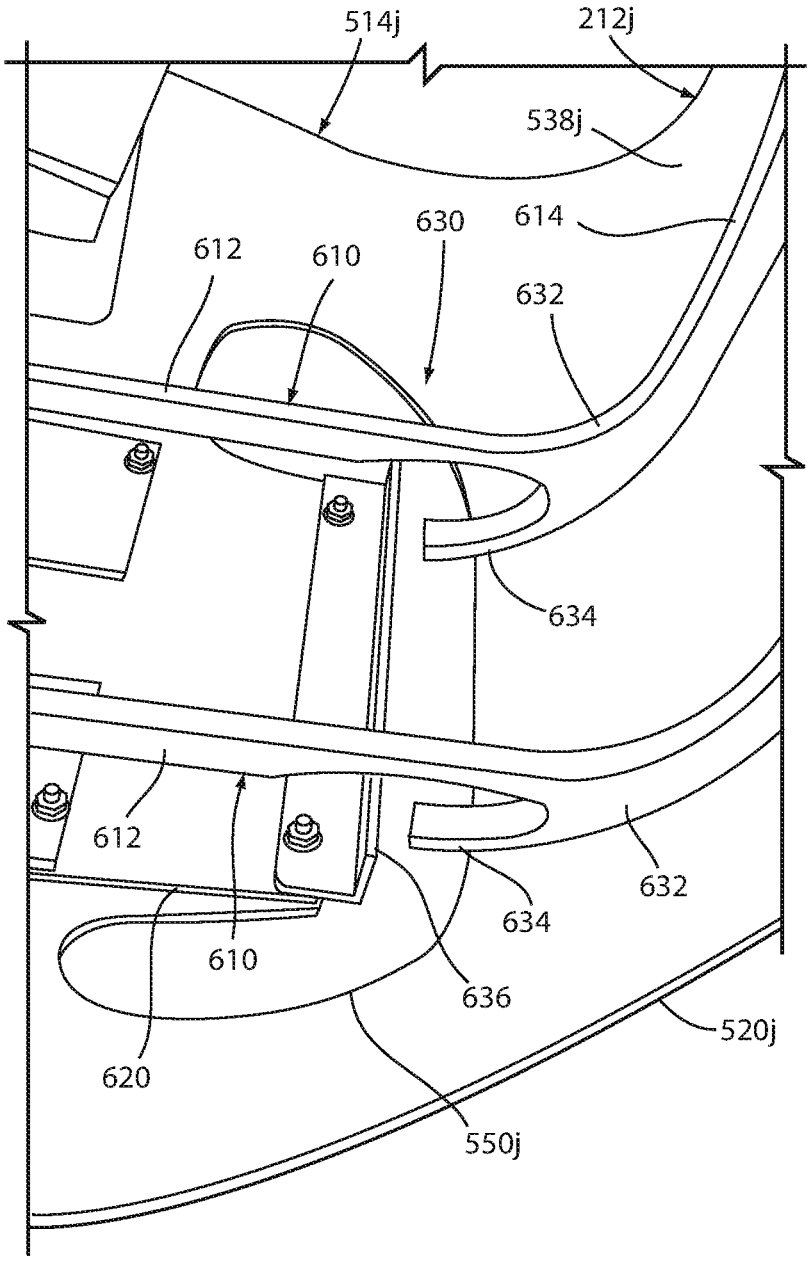
FIG. 29 is an enlarged perspective view of a recline limiting arrangement of the seating arrangement of FIG. 28.

The structural reinforcement and biasing assembly 608 further includes a tilt limiting arrangement 630 (FIG. 29) that limits the rearward recline range of the second portion 518*j* of the second shell member 512*j*. Each biasing member 610 further includes an arcuately-shaped transition portion 632 positioned between the first portion 612 and the second portion 614. Each transition portion 632 includes an arcuately-shaped, downwardly and forwardly extending abutment or stop member 634. In operation, the ends of the stop members 634 are spaced from a stop plate 636, attached to the support plate 620, when the second portion 518*j* of the second shell member 512*j* is in the upright position. During recline, the ends of the stop members 634 contact or abut the stop plate 636 thereby limiting the rearward recline of the second portion 518*j* of the second shell member 512*j*.

The reference numeral 700 (FIG. 30) generally designates another embodiment of a seating arrangement. In the illustrated example, the seating arrangement or chair assembly 700 includes a cantered base assembly 702 abutting a floor surface 704, a seat assembly 706 and a back assembly 708 each supported above the base assembly 702, and a pair of arm assemblies 710. In the illustrated example, the chair assembly 700 (FIG. 31) includes a front or a first shell member 714 and a rear or second shell member 712. The shell members 712, 714 may be formed as a single, integral piece or comprise multiple, individual components. In the illustrated example, the first shell member 712 includes a single, integral piece, while the second shell member 714 includes a two-piece construction as described below. The shell members 712, 714 each comprise a flexibly resilient polymer material such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 712, 714 to conform and move in response to forces exerted by a user. Although a polymer material is preferred, other suitable materials may also be utilized, such as metals, including, for example, steel or titanium; plywood; or a composite material including plastics, resin-based composites, metals and/or plywood. A variety of other suitable energy-storing materials may also be utilized.

Figure 31:
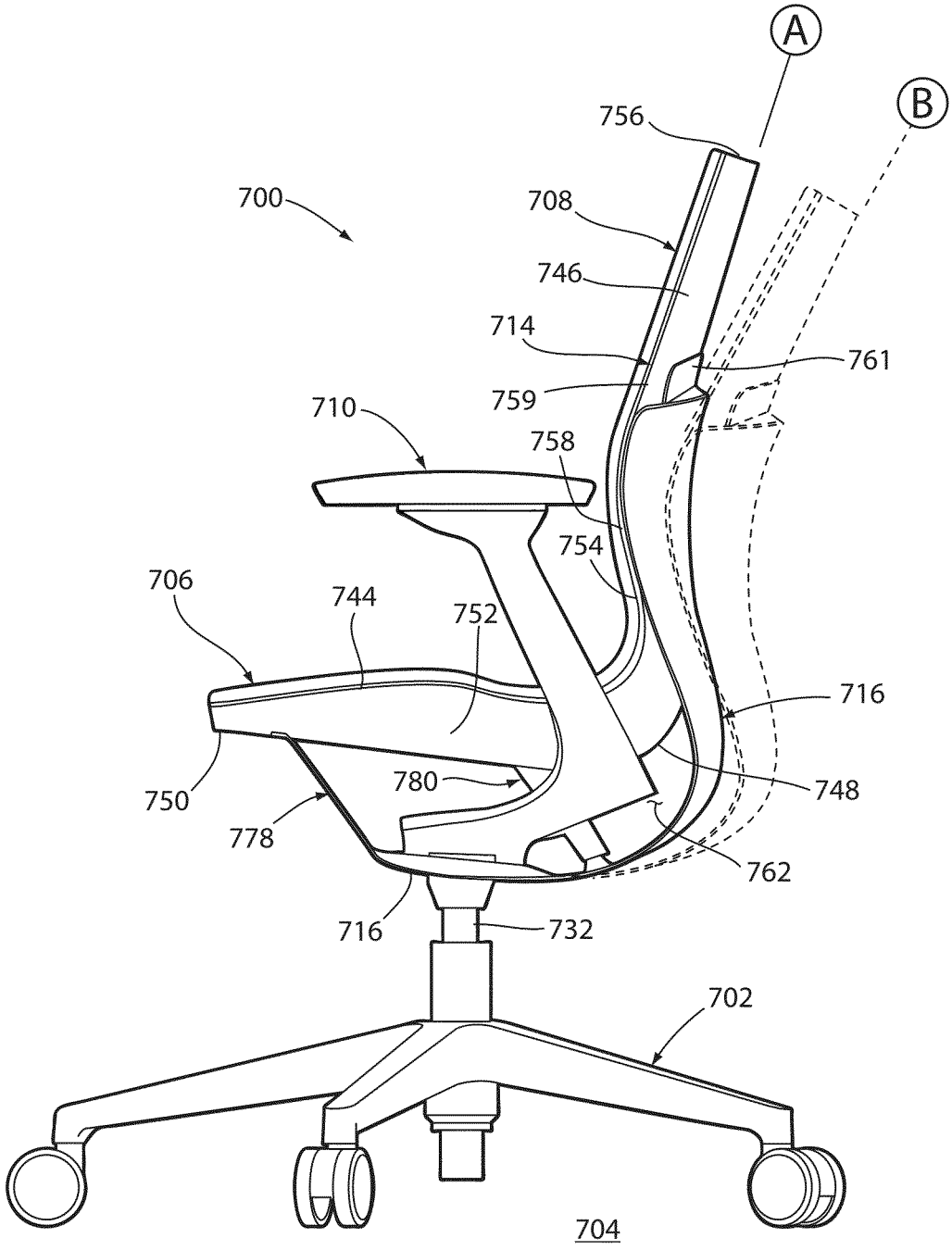
FIG. 31 is a side elevational view of the embodiment of the seating arrangement shown in FIG. 30 with a back assembly shown in an upright position in solid line and a reclined position in dashed line.
Figure 33:
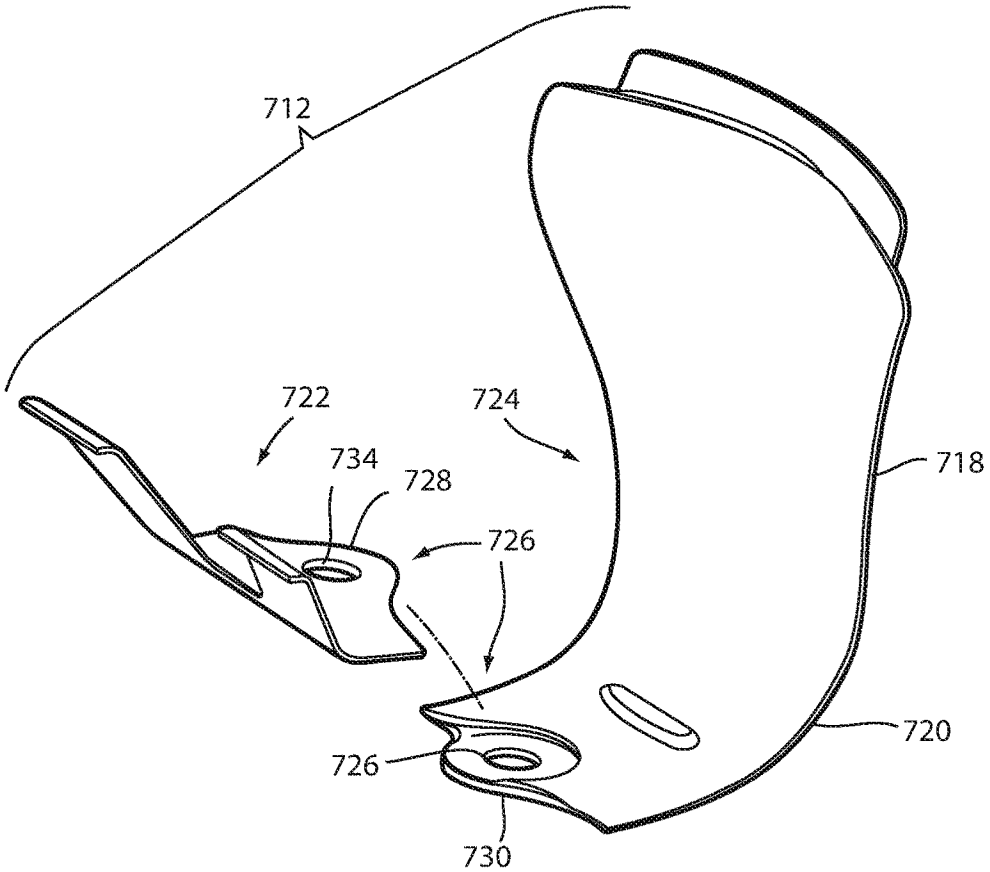
FIG. 33 is a perspective view of the back shell member.
Figure 32:
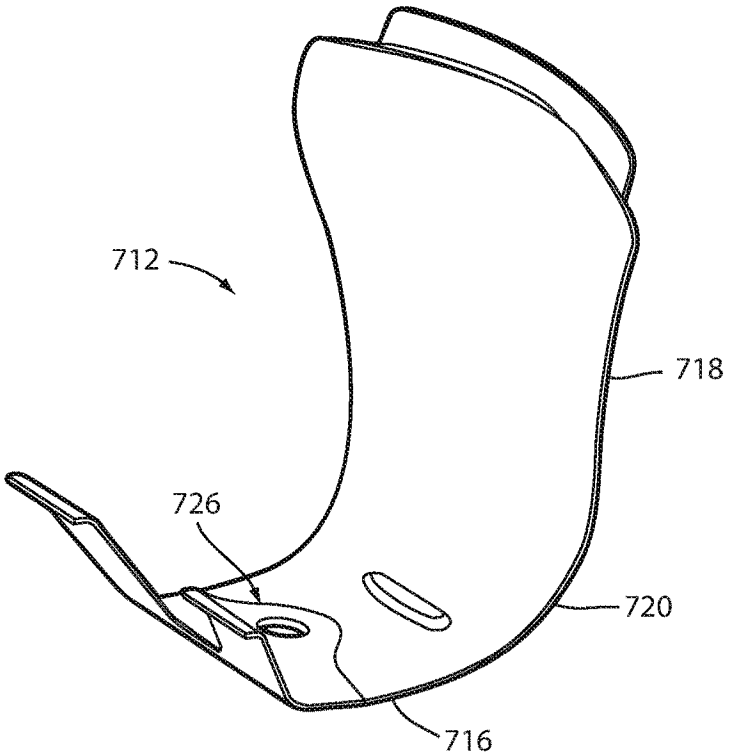
FIG. 32 is a perspective view of a back shell member.

The rear shell member 712 includes a horizontally-extending bottom or first portion 716, a vertically-extending upper or second portion 718 extending upwardly from the first portion 716, and an arcuately-shaped transition portion 720 extending between the first portion 716 and the second portion 718. In the illustrated example, the rear shell member 712 comprises a two-part construction having a first portion 722 and a second portion 724 each having one portion of a lap joint 726. Specifically, the lap joint 726 includes a first portion 728 integral with the first portion 722 of the rear shell member 712 and a second portion 730 integral with the second portion 724 of the rear shell member 712, where the first portion 722 and the second portion 724 each cantilever and overlap with one another to form the lap joint 726. In assembly, a column 732 (FIGS. 31 and 34) of the pedestal assembly 702 is received through an aperture 734 of the first portion 722 and an aperture 736 of the second portion 724, and the first portion 728 and the second portion 730 of the lap joint 726 are held in connection by a lower coupler 738 and an upper coupler 740 as described below. It is noted that while the embodiment illustrated in FIG. 32 shows a two-piece rear shell member 712, alternate embodiments may include more than two pieces, or an integral, single-piece construction.

Figure 35:
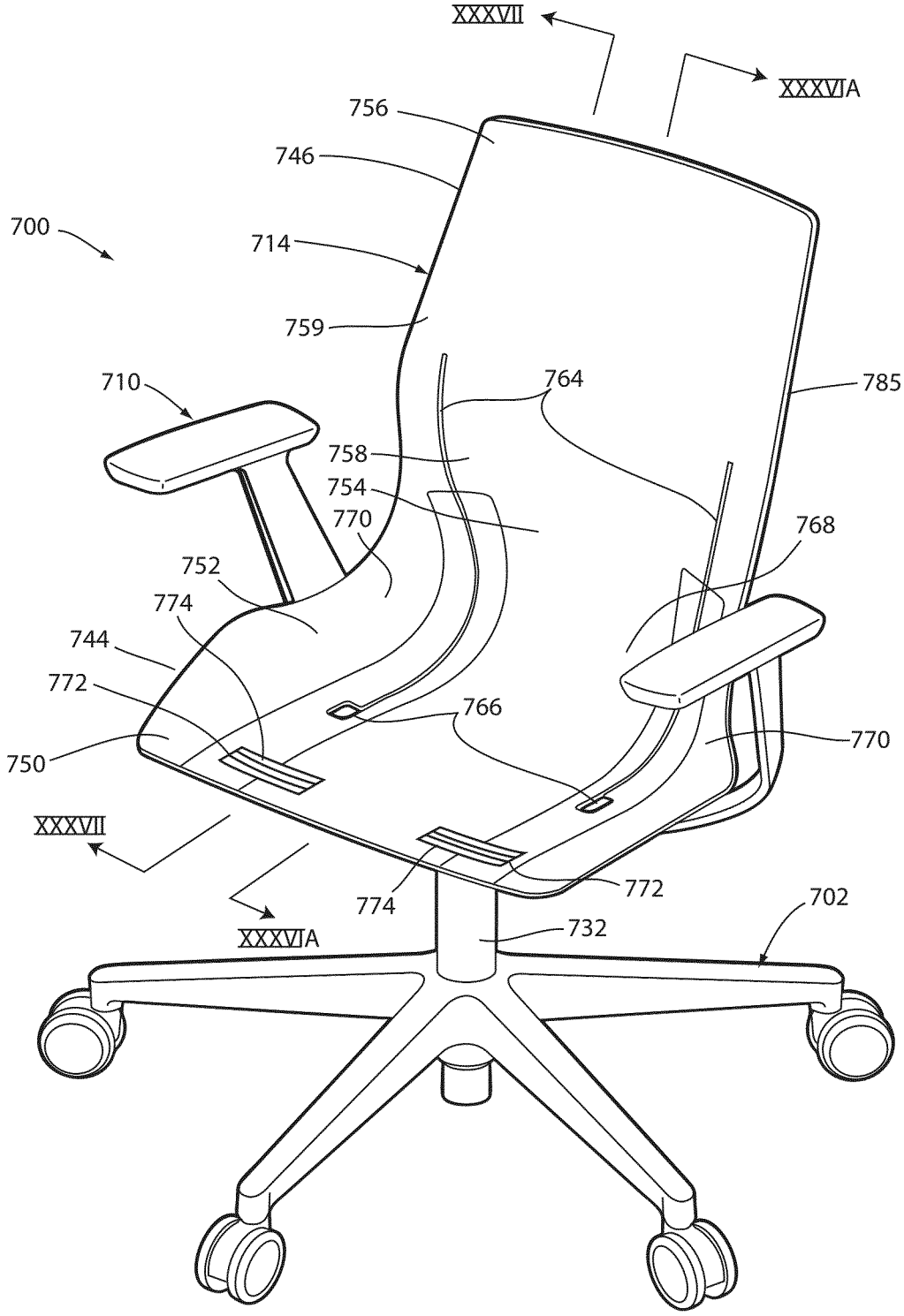
FIG. 35 is a perspective view of the embodiment of the chair shown in FIG. 30 with a fabric cover removed.

The front shell member 714 (FIGS. 31 and 35) includes a horizontally-extending bottom or first portion 744, a vertically-extending upper or second portion 746 extending upwardly from the first portion 744, and an arcuately-shaped transition portion 748 extending between the first portion 744 and the second portion 746. The first portion 744 includes a forward portion 750 and a rearward portion 752, while the second portion 746 includes a lower portion 754, an upper portion 756 and an arcuately-shaped, forwardly convex mid-portion 758 located therebetween and configured to support the lumbar region of a user's back. An intermediate portion 759 of the second portion 746 of the front shell member 714 located between the upper portion 756 and the mid-portion 758 is connected to an upper portion 761 of the second portion 718 of the rear shell member 712, such as by sonic welding, an adhesive, integral molding, mechanical fasteners, and the like. The rear shell member 712 and the front shell member 714 are configured so as to define a gap 762 therebetween.

The front shell member 714 further includes a pair of laterally-spaced slots 764 extending in a fore-to-aft direction from a mid-portion of the second portion 746 to the intermediate portion 759 of the second portion 746, with the fore end of each slot 764 ending in an aperture 766, thereby dividing the front shell member 714 into an inner portion 768 and outer portion 770. The division of the inner portion 768 from the outer portions 770 allows the inner portion 768 to flex separately from the outer portion 770 during recline of the back assembly 708 from an upright position A to a reclined position B. As best illustrated in the FIGS. 36A and 36B, the flexing of the front shell member 714 during recline is such that the inner portion 768 flexes less than the outer portion 770 such that the outer portion 770 descends relative to the inner portion 768, thereby allowing additional flexibility in the front shell member 714 while providing adequate support for the seated user via the inner portion 768. The differentiation of flexure of the inner portion 768 and the outer portion 770 causes the second portion 746 of the front shell member 714 to move from the reclined position toward the upright position and exert an increased pressure to the back of a seated user as the force exerted on the inner portion 768 is increased, such as the force exerted by the weight of a seated user.

Figure 37:
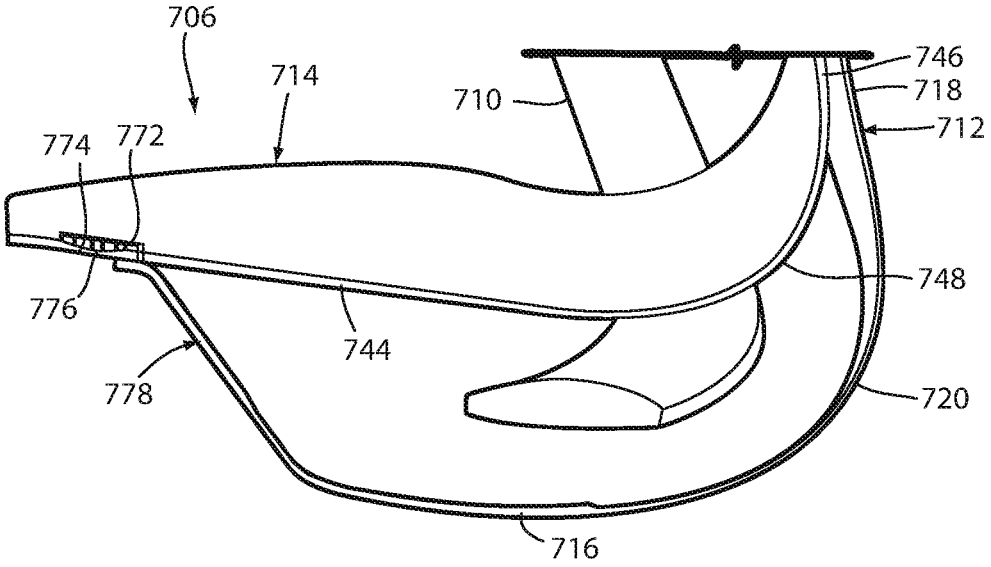
FIG. 37 is a cross-sectional side elevational view of the embodiment of the chair shown in FIG. 35, taken along the line XXXVII-XXXVII.

The front shell member 714 (FIGS. 35 and 37) further includes a pair of C-shaped reliefs or apertures 772 each defining a tab 774. Each tab 774 has a laterally-extending flexing region 776 of relative reduced thickness thereby promoting flexure of each tab 774 in this region as described below.

The chair assembly 700 (FIGS. 30 and 31) further includes a pair of laterally-extending support members or linkage members, including a forward support or linkage member 778 and a rearward support or linkage member 780, each extending between the second portion 746 of the forward shell member 714 and the second portion 716 of the rear shell member 712. In the illustrated example, the forward support member 778 is flexibly resilient along the length thereof, while the rearward support member 780 is relatively rigid. The forward support member 778 is integrally formed within the back shell member 716 and rigidly attached to the front shell member 714, while the rearward support member 780 is rigidly attached to the rear shell member 716, however, the forward support member 778 and the rearward support member 780 may be formed as separate pieces, or as integral portions of the rear shell member 712 and/or the front shell member 714. Further, in the illustrated example, the inner portion 768 cooperates with the forward support member 778 and the rearward support member 780 to form a control mechanism that synchronizes the rearward movement of the first portion 744 of the front shell member 714 with reclining movement of the second portion 746 of the front shell member 714 as further described below.

Figure 36A:
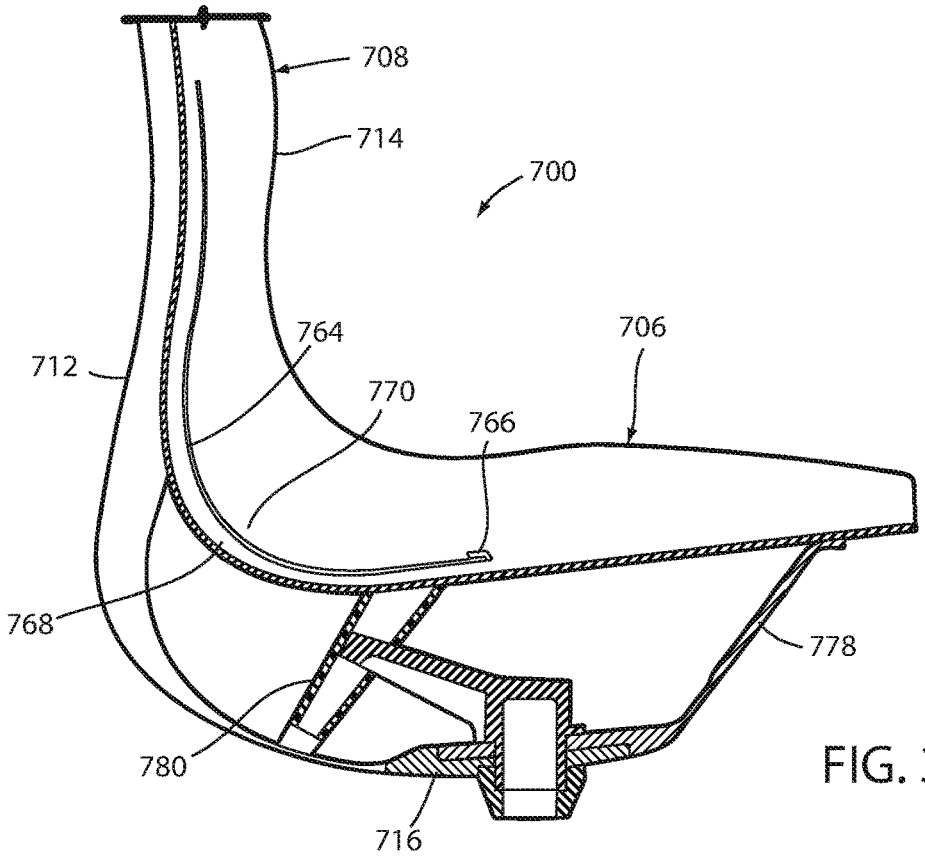
FIG. 36A is a cross-sectional side elevational view of the embodiment of the chair shown in FIG. 35, taken along the line XXXVIA-XXXVIA, with the back assembly shown in the upright position.
Figure 36B:
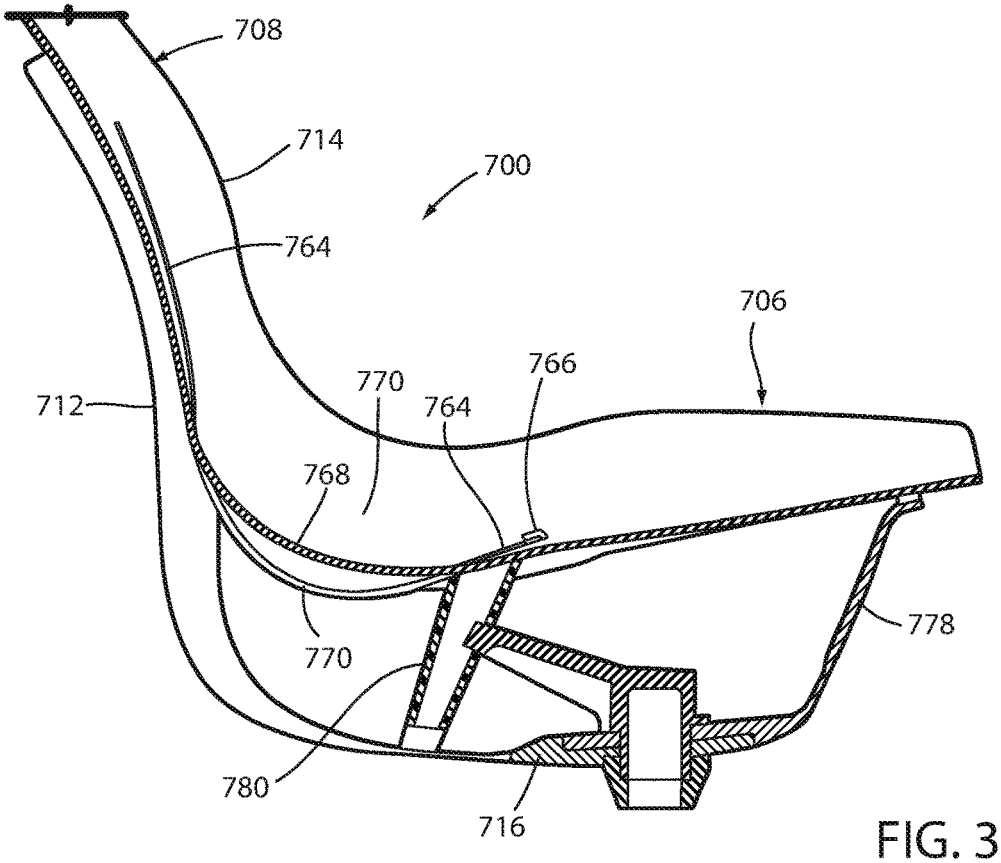
FIG. 36B is a cross-sectional side elevational view of the embodiment of the chair shown in FIG. 35, taken along the line XXXVIA-XXXVIA, with the back assembly shown in the reclined position.

In the present example, the first portion 716 (FIGS. 34, 37) of the rear shell member 712 includes a laterally-extending flexing region 782 of relatively reduced thickness located fore of the attachment location of the rearward support member 780 with the rear shell member 712. The forward support member 778 includes a laterally-extending flexing region 784 of relatively reduced thickness located at a lower end of the forward support member 778 such that flexure of the forward support member 778 is concentrated in the flexing region 782 while the remainder of the forward support member may be relatively rigid and may remain relatively straight. The forward support member 778 connects to each of the tabs 774 aft of the flexing region 776. Referring to FIGS. 36A and 36B, it is noted that the rearward support member 780 remains rigid during recline, while the second portion 746, the second portion 716 and the forward support member 778 flex, with the flexing regions or flexing zones 776, 782, 784 flexing a greater amount than the remainder of each of the associated components. As previously noted, the various thicknesses of the linkages or members comprising the overall supporting four-bar linkage may be varied so as to provide specific support and bending characteristics previously described. It is further noted that this configuration provides adequate flexure to the front shell member 714 while allowing an outer perimeter edge 785 of the front shell member to remain continuous and without breaks or reliefs, thereby providing a continuous aesthetic edge, while simultaneously reducing or eliminating wear of a supported cover assembly 787 (FIGS. 30 and 34) typically caused by repeated flexing of a supporting chair surface. In the illustrated example, the cover assembly 787 includes a flexible resilient substrate layer 791 supported by the front shell member 714 and comprising a thermal plastic, a foam layer 793 molded to the substrate layer 791, and a fabric cover 795 thermally set to the foam layer 793. Alternatively, the fabric cover may be wrapped about the foam layer 793 and secured to an underside of the substrate layer 791 by separate mechanical fasteners such as staples (not shown) or to integral fasteners (not shown) integrally molded with the substrate layer 791, and/or secured about the foam layer 793 and the substrate layer 791 by a drawstring arrangement (not shown). In the illustrated example, the foam layer 793 and the fabric cover 795 are both continuous and free from irregularities along the edges thereof, such as apertures, reliefs, cutouts, stitching, pleats, and the like. In an alternative embodiment, the continuous outer perimeter edge 785 of the front shell member 714 may provide an uninterrupted edge about which to wrap the fabric cover 795. In another alternative arrangement, a separate outermost shell (not shown) comprising a molded thermal plastic may replace the cover assembly 787 and provide an outer, user supporting surface eliminating the need for a fabric-type cover.

Figure 30:
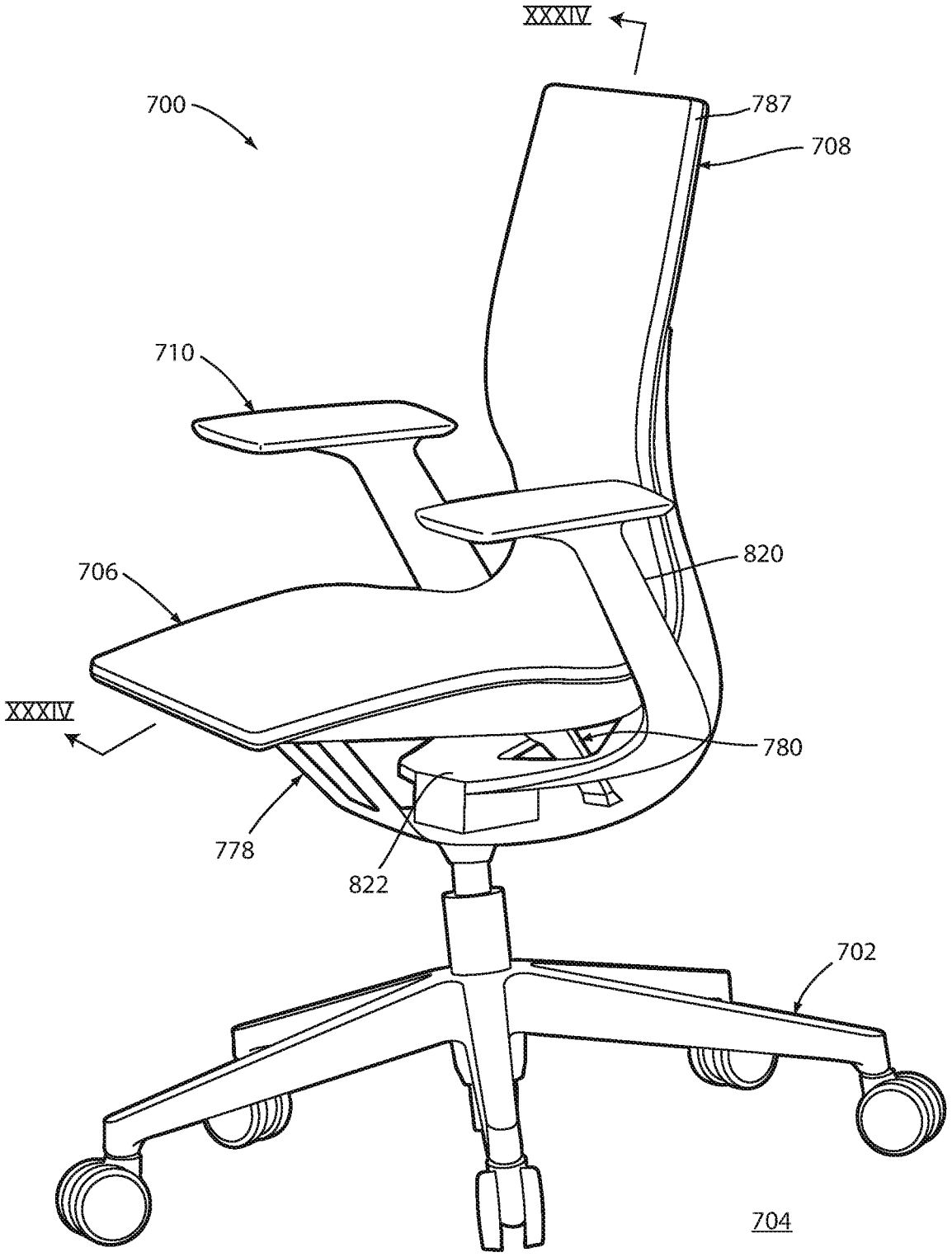
FIG. 30 is a perspective view of another embodiment of a seating arrangement.
Figure 34:
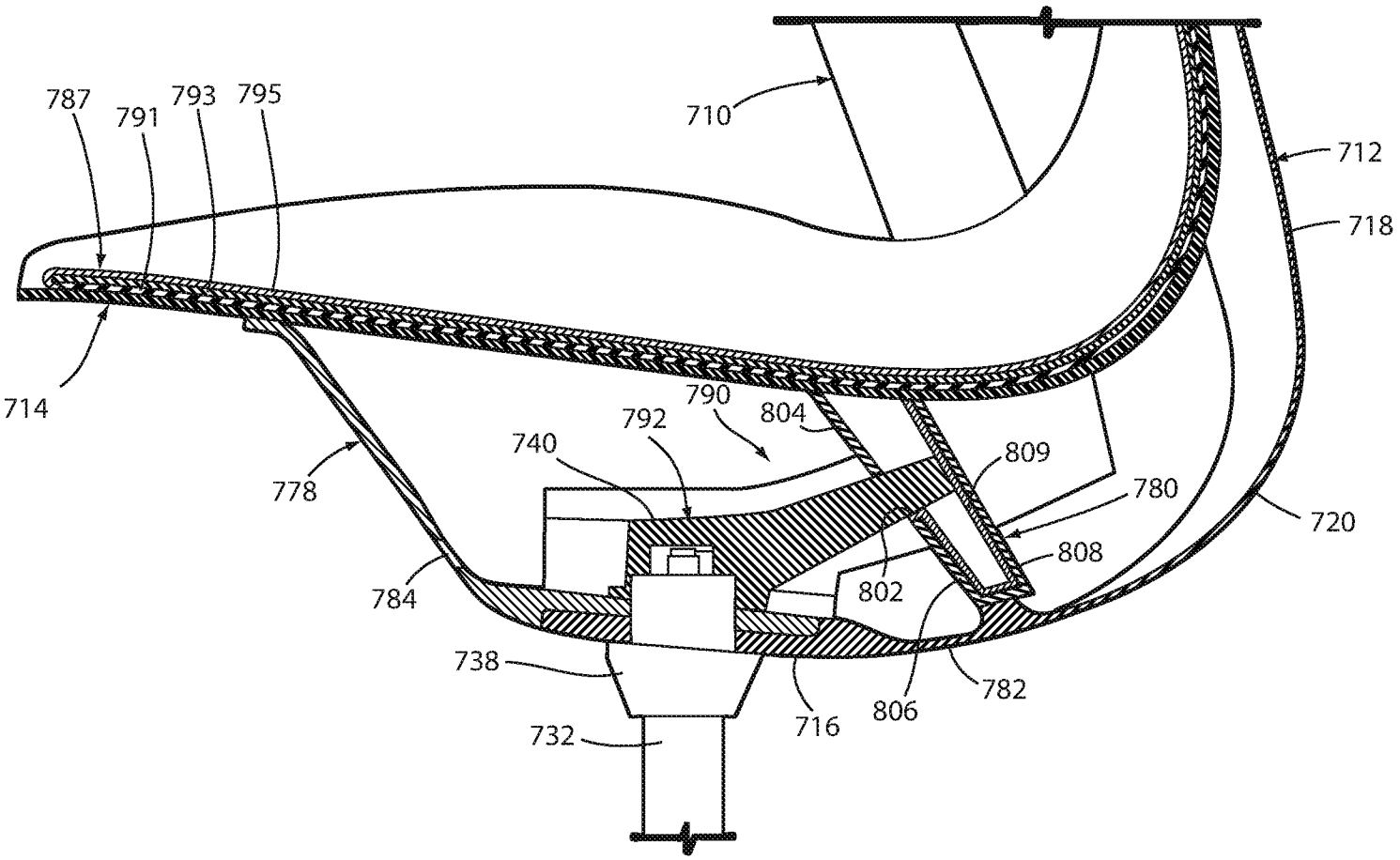
FIG. 34 is a cross-sectional side elevational view of the embodiment of the chair shown in FIG. 30, taken along the line XXXIV-XXXIV, FIG. 30.
Figure 38:
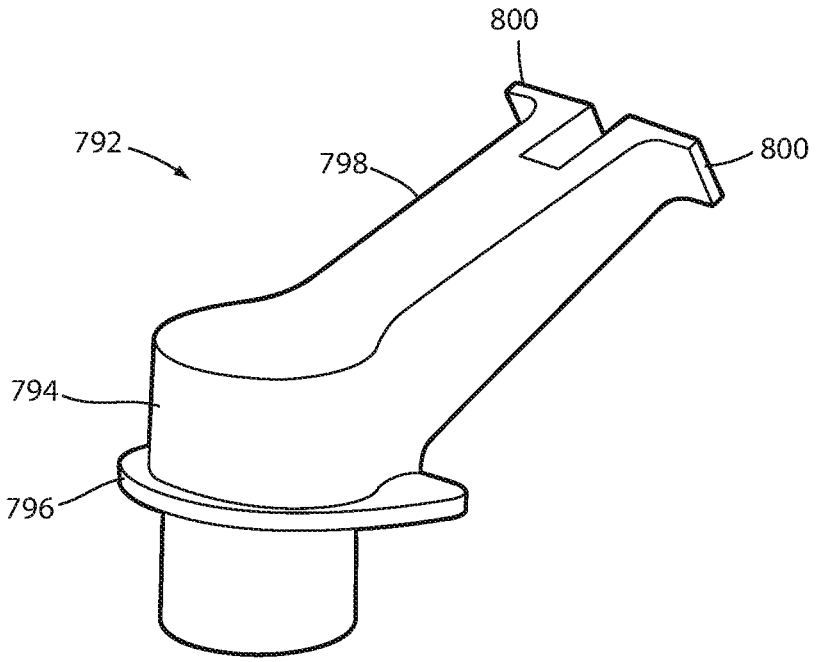
FIG. 38 is a perspective view of a stop member.
Figure 39:
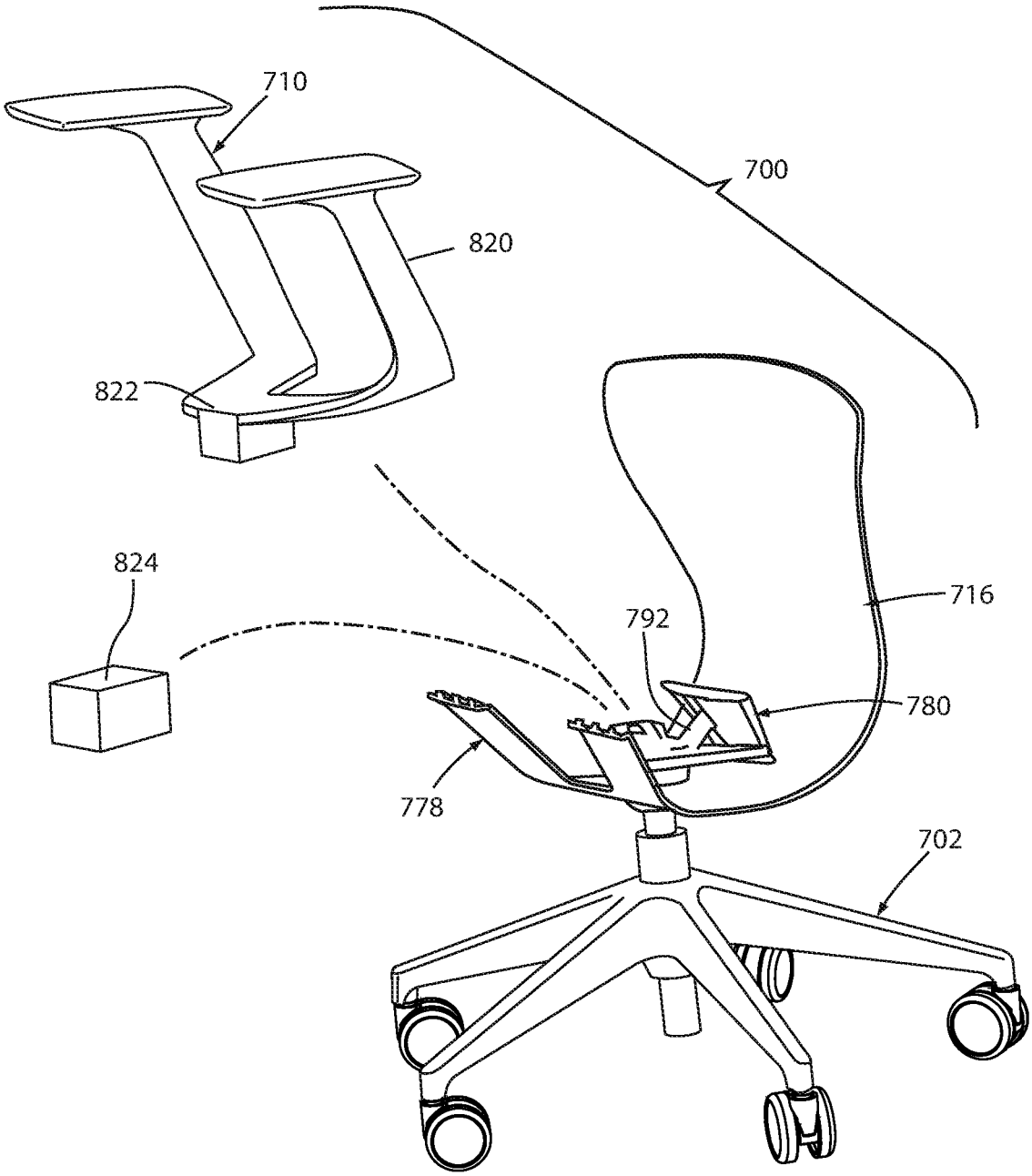
FIG. 39 is an exploded perspective view of another alternative embodiment of a seating arrangement.

The chair assembly 700 further includes a recline stop arrangement 790 (FIG. 34). In the illustrated example, the stop arrangement 790 includes a stop member 792 (FIG. 38) having a cylindrical body portion 794 that receives an upper end of the column 732 therein, a flange 796 that extends about the body portion 794 and that cooperates with the lower coupler 738 to couple the first portion 722 and the second portion 724 of the rear shell member 712 together such that the stop member 792 functions as the upper coupler 740 as previously described, and a stop arm 798 extending rearwardly from the body portion 794. The stop arm 798 extends through an aperture 802 in a front wall 804 of the rearward support member 780 such that a pair of stops 800 located at a distal end of the stop arm 798 are located within an interior space or cavity 806 of the rearward support member 780 defined between the front wall 804 and a rear wall 808. Alternatively, the aperture 802 and the interior space may be lined with a plastic bushing member 809. The stop arm 798 and stops 800 cooperate to form a control rod. In operation, the rearward recline of the back assembly 708 from the upright position A toward the reclined position B is limited by the stops 800 abutting the rear wall 808, while a forward tilting of the chair back 708 from the reclined position B toward the upright position A is limited by the stops 800 abutting the front wall 804. It is noted that the present configuration provides a relatively open chair structure such that the components comprising the four-bar linkage, the arm support structure and portions of the recline limiting arrangement are viewable, while the abutting stop components are concealed from view and within the existing supporting structures and specifically a component of the four-bar linkage. As best illustrated in FIGS. 30 and 39, the arm support members 820 are integral with and supported by a cover portion 822 configured to aesthetically cover the stop arrangement 792. The arm support members 820 and cover portion 822 may be removed from the chair assembly 700 and alternatively replaced with a cover member 824, thereby providing an armless embodiment of the chair assembly on the same underlying platform.

Figure 40:
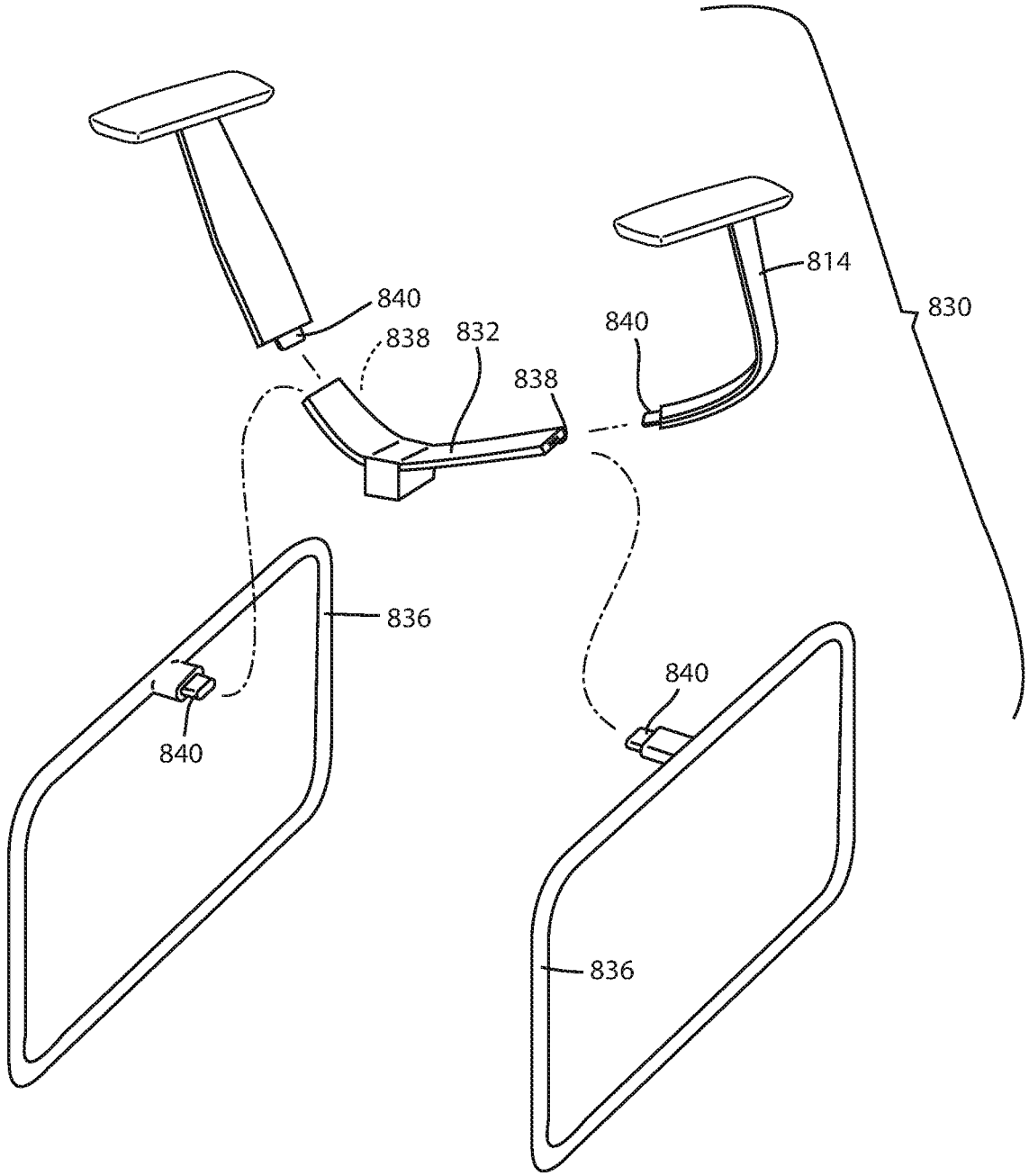
FIG. 40 is an exploded perspective view of an accessory supporting arrangement.

Alternatively, the arm assemblies 710, the arm support members 820 and the cover portion 822 may be replaced by an accessory supporting arrangement 830 (FIG. 40) that includes a support portion 832 configured as a housing to aesthetically cover the stop arrangement 792, and a chair accessory such as an arm assembly 834, or a leg assembly 836 configured to support the chair assembly 700 above a floor surface in place of the support assembly 702. While an arm assembly 834 and a leg assembly 936 are provided as examples, other chair accessories are also contemplated, such as tablet supports, work surfaces, beverage holders, and the like. In the illustrated example, the support portion 832 includes the first portion 838 of a releasable coupling arrangement, while the accessory includes the second portion 840 of the coupling arrangement, thereby allowing multiple accessories to be interchangeably supported from the same underlying support structure.

Figure 41:
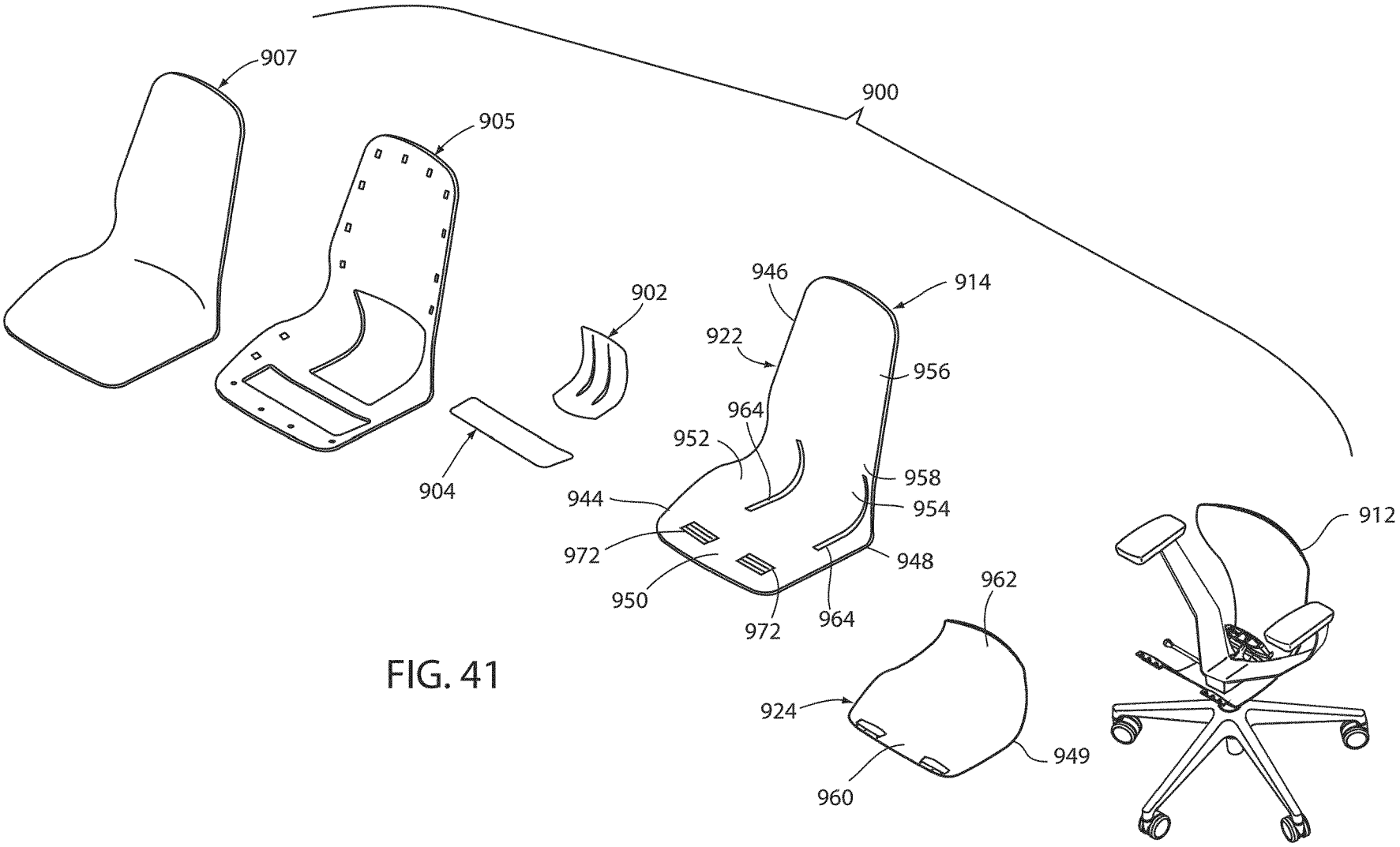
FIG. 41 is an exploded perspective view of another alternative embodiment of a seating arrangement.

The reference numeral 900 (FIG. 41) generally designates another embodiment of a seating arrangement. In the illustrated example, the seating arrangement or chair assembly 900 is similar to the chair assembly 700 previously described with the most notable exceptions being the inclusion of a first structural reinforcement member 902, a second structural reinforcement member 904, and the construction of the front shell member 914 via a multi-layer over-molding process. In the illustrated example, the chair assembly 900 includes the front or first shell member 914, and a rear or second shell member 912, where the front shell 914 is covered by a substrate layer 905 and a fabric cover assembly 907.

Figure 42:
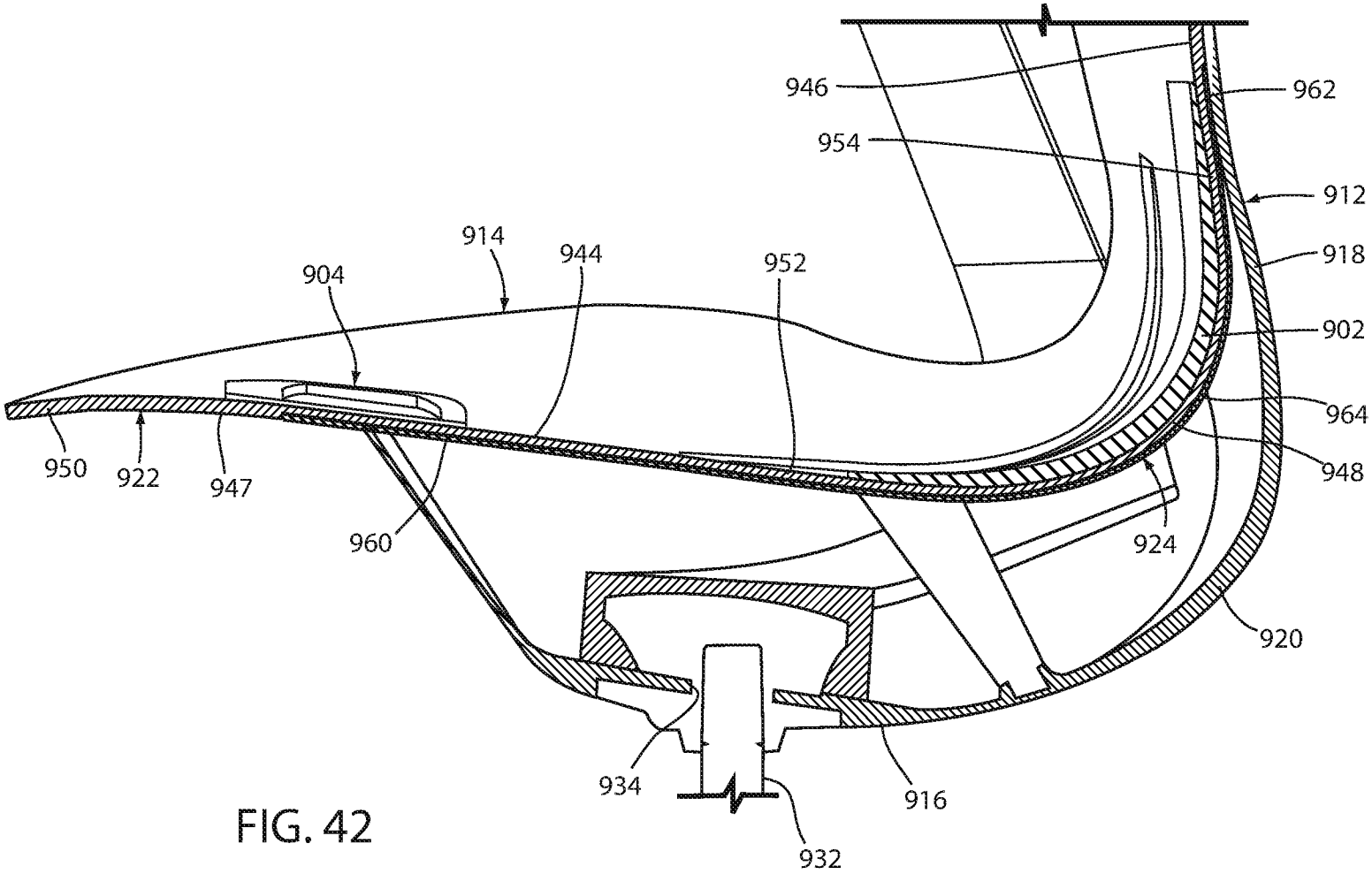
FIG. 42 is a cross-sectional side view of the seating arrangement of FIG. 41.

The rear shell member 912 is similar to the rear shell member 714 of the chair assembly 700 and includes a horizontally-extending bottom or first portion 916 (FIG. 42), a vertically-extending upper or second portion 918 extending upwardly from the first portion 916, and an arcuately-shaped transition portion 920 extending between the first portion 916 and the second portion 918. In the illustrated example, the rear shell member 912 comprises an integral, single-piece construction. In assembly, a pneumatic height adjustable column 932 is received through an aperture 934 of the rear shell member 912.

The front shell member 914 (FIGS. 41 and 42) includes an outer shell member 922 having a horizontally-extending bottom or first portion 944, a vertically-extending upper or second portion 946 extending upwardly from the first portion 944, and an arcuately-shaped transition portion 949 extending between the first portion 944 and the second portion 949. The first portion 944 includes a forward portion 950 and a rearward portion 952, while the second portion 946 includes a lower portion 954, an upper portion 956 and an arcuately-shaped, forwardly convex mid-portion 958 located therebetween and configured to support the lumbar region of a user's back. The front shell member 914 further includes a pair of laterally-spaced slots 964 extending in a fore-to-aft direction similar to the slots 764 of the chair assembly 700 as previously described.

The front shell member 914 further includes an inner shell portion 924 having a horizontally-extending bottom or first portion 960, a vertically-extending upper or second portion 962, and an arcuately-shaped transition portion 964 extending between the first portion 960 and the second portion 962. In assembly, the inner shell portion 924 is over-molded over the outer shell member 922 such that the inner shell portion 924 covers or overlaps with at least a portion of the bottom portion 944, the upper portion 946 and transition portion 946. The inner shell portion 924 is preferably positioned with respect to the outer shell member 922 such that the inner shell portion 924 covers the apertures 964 of the outer shell member 922. Preferably, the inner shell portion 924 comprises a material that is more flexible than the material from which the outer shell member 922 is constructed, more preferably the inner shell portion 924 and outer shell member 922 each comprise a thermoplastic polymer, and most preferably, the outer shell member 922 comprises polyethylene terephthalate or polybutylene terephthalate, and the inner shell portion 924 comprises a thermoplastic polyolefin.

The chair assembly 900 further includes the structural reinforcement member 902 located in the transition portion 948 of the front shell member 914. In the illustrated example, the structural reinforcement member 902 is arcuately-shaped to match the arcuate shape of the transition portion 948. The reinforcement member 902 comprises a relatively stiff material, such as metal, and extends through the transition portion 948, such that the reinforcement member 902 prevents the angle between the bottom portion 944 and the upper portion 946 from increasing as the upper portion 946 is moved from the upright portion to the reclined position, thereby concentrating compliance or bending in the control arrangement forward of the transition portion 948.

The chair assembly 900 further includes the structural reinforcement member 904 extending between the tabs 972 that are similar to the tabs 772 of the chair assembly 700. The reinforcement member 904 overlaps with an area of the bottom portion 944 of the shell member 914 so as to disperse forces transmitted between the rear shell 912 and the front shell 914 in the vicinity of the tabs 972.

It is noted that in each of the aforedescribed embodiments, the seating arrangement is configured such that some, many, or all of the components may be visible from an exterior of the seating arrangements subsequent to the seating arrangements being completely manufactured and assembled, such that the visible components form an outer aesthetic appearance of the seating arrangement, or alternatively may be enclosed within an interior of the chair assembly such that the components are not visible to the casual observer. Specifically, components such as the forward support member, the rearward support member, the support member, as well as the stop arrangements as described are at least partially visible from an exterior of the chair, and cooperate to form an overall outer aesthetic thereof. Certain embodiments may include some, many, or all of the components described herein. For example, an embodiment may include one or more apertures, one or more of the stop systems, and/or components or materials selected for performance purposes, e.g., to bias the seat arrangement to an upright position or for material strength requirements. In some embodiments, a selection of a particular component may influence the selection of various other components. For example, using a particular aperture or apertures may dictate what type of components or materials should be used for performance purposes and vice versa.

Various embodiments of the seating arrangements described herein may provide a platform with the proper fit and function for comfortably supporting a seated user that may also reduce or shift costs, for example by reducing associated part counts, manufacturing costs, and labor costs. Certain aspects of the seating arrangements may include an uncomplicated, durable, and visually appealing design capable of a long operating life, and particularly well adapted for the proposed use.

In the foregoing description, it will be readily appreciated by those skilled in the art that modifications may be made to the described embodiments without departing from the concepts disclosed herein. Such modifications are to be considered as included in the following claims, unless these claims by their language expressly state otherwise.

The invention claimed is:

1. A seating arrangement, comprising:

a base;

a lower shell including a substantially horizontal first portion coupled to the base, a curved transition portion and a backrest portion, the lower shell further including an upper surface;

a pair of laterally spaced front links extending upwardly from a forward portion of the first portion;

a rear link extending upwardly from a rearward portion of the first portion of the lower shell and forwardly of the transition region of the lower shell;

an upper shell comprising a seating portion coupled to the pair of front links and to the rear link, a curved transition portion spaced apart from the curved transition portion of the lower shell, and a backrest portion connected to the backrest portion of the lower shell, where an open lateral pass through is defined between the first portion and the seating portion; and a support member positioned at least partially within the pass through area above the upper surface of the lower shell, wherein the support member is configured to support an armrest assembly, wherein the support member is supported by the lower shell, and wherein the support member is fixed relative to the base.

2. The seating arrangement of claim 1, wherein the support member is further configured to support a tilt limiter configured to limit movement of the backrest portion of the upper shell between upright and reclined positions.

3. The seating arrangement of claim 1, further comprising:

an armrest assembly supported by the support member.

4. The seating arrangement of claim 3, wherein the armrest assembly is located completely in front of the backrest portion of the upper shell.

5. The seating arrangement of claim 2, wherein the lower shell and the upper shell are configured such that the support member is at least partially visible from an exterior of the seating arrangement.

6. The seating arrangement of claim 1, wherein the lower shell, the pair of front links, the rear link and the seating portion of the upper shell cooperate to define the pass through therebetween.

7. The seating arrangement of claim 1, wherein the lower shell and the upper shell are configured such that the front links are visible from an exterior of the seating arrangement.

8. The seating arrangement of claim 2, wherein the lower shell and the upper shell are configured such that the rear link is visible from an exterior of the seating arrangement.

9. The seating arrangement of claim 1, wherein the lower shell includes the pair of front links.

10. The seating arrangement of claim 9, wherein the lower shell includes the rear link.

11. The seating arrangement of claim 1, wherein the seating arrangement comprises an office chair assembly.

12. The seating arrangement of claim 1, wherein the arm assembly includes a first arm extending through a first side of the pass through, and a second arm extending through a second side of the pass through, the second side being opposite the first side.

13. The seating arrangement of claim 1, wherein the support member is supported from an upper surface of the lower shell.

14. A seating arrangement, comprising:

a base;

a lower shell including a substantially horizontal first portion coupled to the base;

a front link extending upwardly from a forward portion of the first portion;

a rear link extending upwardly from a rearward portion of the first portion;

an upper shell comprising a seating portion coupled to the front and rear links and that cooperates with the first portion of the lower shell to define an open lateral pass through therebetween, and a backrest portion extending upwardly from the first portion;

a support member positioned at least partially within the pass through, wherein at least a portion of the support member is centrally located across a width of the seating arrangement; and an armrest assembly supported by the support member within the pass through, wherein the armrest assembly is coupled to the portion of the support member at a location that is centrally located across the width of the seating arrangement.

15. The seating arrangement of claim 14, further comprising:

a tilt limiter supported by the support member, wherein the tilt limiter is configured to limit movement of the backrest portion between upright and reclined positions.

16. The seating arrangement of claim 14, wherein the lower shell and the upper shell are configured such that the support member is at least partially visible from an exterior of the seating arrangement.

17. The seating arrangement of claim 14, wherein the lower shell, the front link, the rear link and the seating portion of the upper shell cooperate to define the pass through.

18. The seating arrangement of claim 14, wherein the lower shell and the upper shell are configured such that the front link is visible from an exterior of the seating arrangement.

19. The seating arrangement of claim 18, wherein the lower shell and the upper shell are configured such that the rear link is visible from an exterior of the seating arrangement.

20. The seating arrangement of claim 14, wherein the lower shell includes the front link.

21. The seating arrangement of claim 20, wherein the lower shell includes the rear link.

22. The seating arrangement of claim 14, wherein the seating arrangement comprises an office chair assembly.

23. The seating arrangement of claim 14, wherein the armrest assembly extends from a positon below the seating portion and exits the pass through on opposite sides of the seating arrangement.

24. A seating arrangement, comprising:

a base;

a lower shell comprising a first portion coupled to the base and including a substantially horizontal portion, the lower shell further including an upper surface;

a front link extending upwardly from a forward portion of the first portion;

a rear link extending upwardly from a rearward portion of the first portion;

an upper shell comprising a seating portion coupled to the front and rear links and that cooperates with the substantially horizontal portion of the first portion of the lower shell to define an open lateral pass through therebetween, and a backrest portion extending upwardly from the seating portion;

a support member positioned at least partially within the pass through above the upper surface of the lower shell, wherein the support member is a single member; and an armrest assembly supported by the support member, wherein the armrest assembly is connected to the support member at a location centrally located across a width of the seating arrangement, and wherein the support member is fixed with respect to the base.

25. The seating arrangement of claim 24, wherein the lower shell and the upper shell are configured such that the support member is at least partially visible from an exterior of the seating arrangement.

26. The seating arrangement of claim 24, wherein the lower shell, the front link, the rear link and the seating portion of the upper shell cooperate to define the pass through.

27. The seating arrangement of claim 24, wherein the lower shell and the upper shell are configured such that the front link is visible from an exterior of the seating arrangement.

28. The seating arrangement of claim 24, wherein the lower shell and the upper shell are configured such that the rear links are visible from an exterior of the seating arrangement.

29. The seating arrangement of claim 24, wherein the lower shell includes the front link.

30. The seating arrangement of claim 29, wherein the lower shell includes the rear link.

31. The seating arrangement of claim 24, wherein the seating arrangement comprises an office chair assembly.

32. The seating arrangement of claim 24, wherein the support member is positioned below the seating portion and the arms extend laterally outward from the seating portion.

33. The seating arrangement of claim 24, wherein the support member is an integral member.

34. A seating arrangement, comprising:

a base;

a lower shell including a first portion coupled to the base and comprising a substantially horizontal portion, a curved transition portion and a backrest portion, the lower shell including an upper surface;

a pair of laterally spaced front links extending upwardly from a forward portion of the first portion;

a rear link extending upwardly from a rearward portion of the first portion of the lower shell and forwardly of the transition region of the lower shell;

an upper shell comprising a seating portion coupled to the pair of front links and to the rear link, a curved transition portion spaced apart from the curved transition portion of the lower shell, and a backrest portion connected to the backrest portion of the lower shell, where an open lateral pass through is defined between the first portion and the seating portion, wherein the lower shell and the upper shell each include lateral outermost edges, and wherein at least one of the lower shell and the upper shell is substantially uninterrupted between the lateral outermost edges thereof; and a support member positioned at least partially within the pass through area above the upper surface of the lower shell, such that an upper surface of the support member is spaced away from the upper surface of the lower shell, wherein a portion of the support member is fixed with respect to the base, and wherein the portion of the support member that is fixed with respect to the base is configured to support an armrest assembly.

35. The seating arrangement of claim 34, wherein both the lower shell and the upper shell are substantially uninterrupted between the lateral outermost edges thereof.

* * * * *